US012486063B2

(12) United States Patent
Zagnoni et al.

(10) Patent No.: US 12,486,063 B2
(45) Date of Patent: Dec. 2, 2025

(54) CARTONING MACHINE

(71) Applicant: PLUSLINE S.R.L., Zola Predosa (IT)

(72) Inventors: Christian Zagnoni, Calcara Valsamoggia (IT); Leonardo Stamati, Milan (IT)

(73) Assignee: PLUSLINE S.R.L., Zola Predosa (IT)

( * ) Notice: Subject to any disclaimer, the term of this patent is extended or adjusted under 35 U.S.C. 154(b) by 0 days.

(21) Appl. No.: 18/838,625

(22) PCT Filed: Mar. 10, 2023

(86) PCT No.: PCT/IT2023/050072
§ 371 (c)(1),
(2) Date: Aug. 15, 2024

(87) PCT Pub. No.: WO2023/175637
PCT Pub. Date: Sep. 21, 2023

(65) Prior Publication Data

US 2025/0153879 A1 May 15, 2025

(30) Foreign Application Priority Data

Mar. 15, 2022 (IT) ..... 102022000004976

(51) Int. Cl.
*B65B 43/12* (2006.01)
*B65B 41/06* (2006.01)
(Continued)

(52) U.S. Cl.
CPC ..... *B65B 43/126* (2013.01); *B65B 41/06* (2013.01); *B65B 41/10* (2013.01); *B65B 43/145* (2013.01);
(Continued)

(58) Field of Classification Search
CPC ..... B65H 2301/4213; B65B 43/126; B65B 43/145; B65B 43/165; B65B 43/185;
(Continued)

(56) References Cited

U.S. PATENT DOCUMENTS 3,500,980 A * 3/1970 Calistrat ..... B65H 29/00 414/791.3
4,192,496 A * 3/1980 Baselice ..... B65H 3/042 271/10.07
5,019,026 A * 5/1991 Jaton ..... B65H 9/166 493/182
5,341,626 A * 8/1994 Beckmann ..... B65B 43/145 53/574
(Continued)

FOREIGN PATENT DOCUMENTS

EP 0729888 A1 * 9/1996 ..... B65B 43/12
FR 2762830 A1 * 11/1998 ..... B65H 1/30
GB 1289282 A * 9/1972 ..... B65B 43/185

*Primary Examiner* — Joshua G Kotis
(74) *Attorney, Agent, or Firm* — Rivka Friedman

(57) ABSTRACT

Cartoning machine comprising: a store unit (M) for cardboard blanks (F); an unfolding station(S); a feeding station (A) for products (RC) to be packaged. Means for picking the blanks from the store unit by moving them along a picking direction (DP), a conveyor (CB), and means for transferring the blanks from the store unit to the conveyor are arranged between the store unit and the unfolding station. The transfer means comprise a dragging unit (T) and a compartment (VR) below the dragging unit, provided with unloading means (VR2). The dragging unit comprises an active zone (TY) with means (T1, T2) which can be selectively activated and deactivated suitable for engaging the blanks and moving them along said picking direction. The collection compartment comprises a front wall (VRA) and a rear wall (VRB) whose positions are adjustable with respect to said direction (DP).

10 Claims, 42 Drawing Sheets

(51) Int. Cl.

| | |
|---|---|
| ***B65B 41/10*** | (2006.01) |
| ***B65B 43/14*** | (2006.01) |
| ***B65B 43/18*** | (2006.01) |
| ***B65B 43/22*** | (2006.01) |
| ***B65B 43/26*** | (2006.01) |
| ***B65B 59/00*** | (2006.01) |
| *B65B 5/02* | (2006.01) |
| *B65B 7/20* | (2006.01) |
| *B65B 43/30* | (2006.01) |
| *B65B 61/28* | (2006.01) |

(52) U.S. Cl.
CPC ..... *B65B 43/185* (2013.01); *B65B 43/225* (2013.01); *B65B 43/265* (2013.01); *B65B 59/003* (2019.05); *B65B 59/005* (2013.01); *B65B 5/024* (2013.01); *B65B 7/20* (2013.01); *B65B 43/305* (2013.01); *B65B 61/28* (2013.01); *B65H 2801/81* (2013.01)

(58) Field of Classification Search
CPC ..... B65B 43/225; B65B 43/265; B65B 41/06; B65B 41/10
See application file for complete search history.

(56) References Cited

U.S. PATENT DOCUMENTS

| | | | | |
|---|---|---|---|---|
| 6,855,100 | B1 * | 2/2005 | Bailey | B65B 19/228 198/461.2 |
| 11,014,770 | B2 * | 5/2021 | Bär | B65H 3/126 |
| 2002/0012036 | A1 * | 1/2002 | Dante | B41J 11/0015 347/102 |
| 2004/0162204 | A1 * | 8/2004 | Petratto | F16B 2/12 493/71 |
| 2004/0251176 | A1 * | 12/2004 | Alonso | B65H 29/62 209/576 |
| 2008/0119341 | A1 * | 5/2008 | Monti | B65H 1/30 493/182 |
| 2008/0141632 | A1 * | 6/2008 | Monti | B65B 5/024 53/566 |
| 2014/0162862 | A1 * | 6/2014 | Shimura | B31B 50/00 493/56 |
| 2015/0375880 | A1 * | 12/2015 | Ford | B65B 11/105 53/147 |
| 2016/0176666 | A1 * | 6/2016 | Niuchi | B65H 7/02 271/10.1 |
| 2019/0193885 | A1 * | 6/2019 | Bonetsmüller | B65H 1/025 |
| 2020/0254707 | A1 * | 8/2020 | Iwasa | B65B 5/024 |

* cited by examiner

CAL
M
DP
W
S
FM
E
FS
N
G
U
FN
FG
RC
RC
A
RC
RC
CM
SP
AP

CARTONING MACHINE

The present invention relates to a cartoning machine.

It is known that a cartoning machine, also known as "case packer", is intended to package products inside cardboard boxes. Typically, a cartoning machine comprises: a product entry station; a store unit in which the cartons are stacked in an "extended" or flattened form; means for picking up the flat cartons from the store unit and putting them in shape or "unfolding", suitable for picking up individual flat cartons from the store unit and arranging them in an open configuration allowing the introduction of the products inside them; means for folding the lateral, upper and lower flaps of the opened cartons after or before the insertion of the products inside the latter; means for gluing said flaps to close the cartons; and means for transporting the closed cartons along a predefined exit path. Since the flat cartons vary in size according to the packages to be made, the cartoning machine must be reconfigured or rearranged each time to allow the format to be changed.

A machine in accordance with the present invention is a cartoning machine generally configured as described above, which implements technical solutions aimed at increasing its production through its more effective management as the format of the flat cartons and the opened cartons varies.

This result has been achieved, in accordance with the present invention, by adopting the idea of realizing a machine having the features indicated in the claims.

Thanks to the present invention, it is possible to increase the production of the cartoning machines, i.e. the number of complete packs per minute, without compromising the quality of the packs thus made. Furthermore, it is possible to realize a mechanism for reconfiguring the means for moving the processed materials which is particularly advantageous in terms of mechanical and structural simplicity and operating accuracy. These and further advantages and characteristics of the present invention will be more and better understood by any person skilled in the art thanks to the following description and the annexed drawings, provided by way of example but not to be considered in a limiting sense, in which:

FIG. 1 represents a block diagram illustrating the operating stations of a cartoning machine according to the present invention seen in top view;

FIG. 2 schematically represents a plan view of a cardboard blank (F);

FIG. 3 schematically illustrates a cardboard box obtained by unfolding the blank of FIG. 2;

Figure 1:
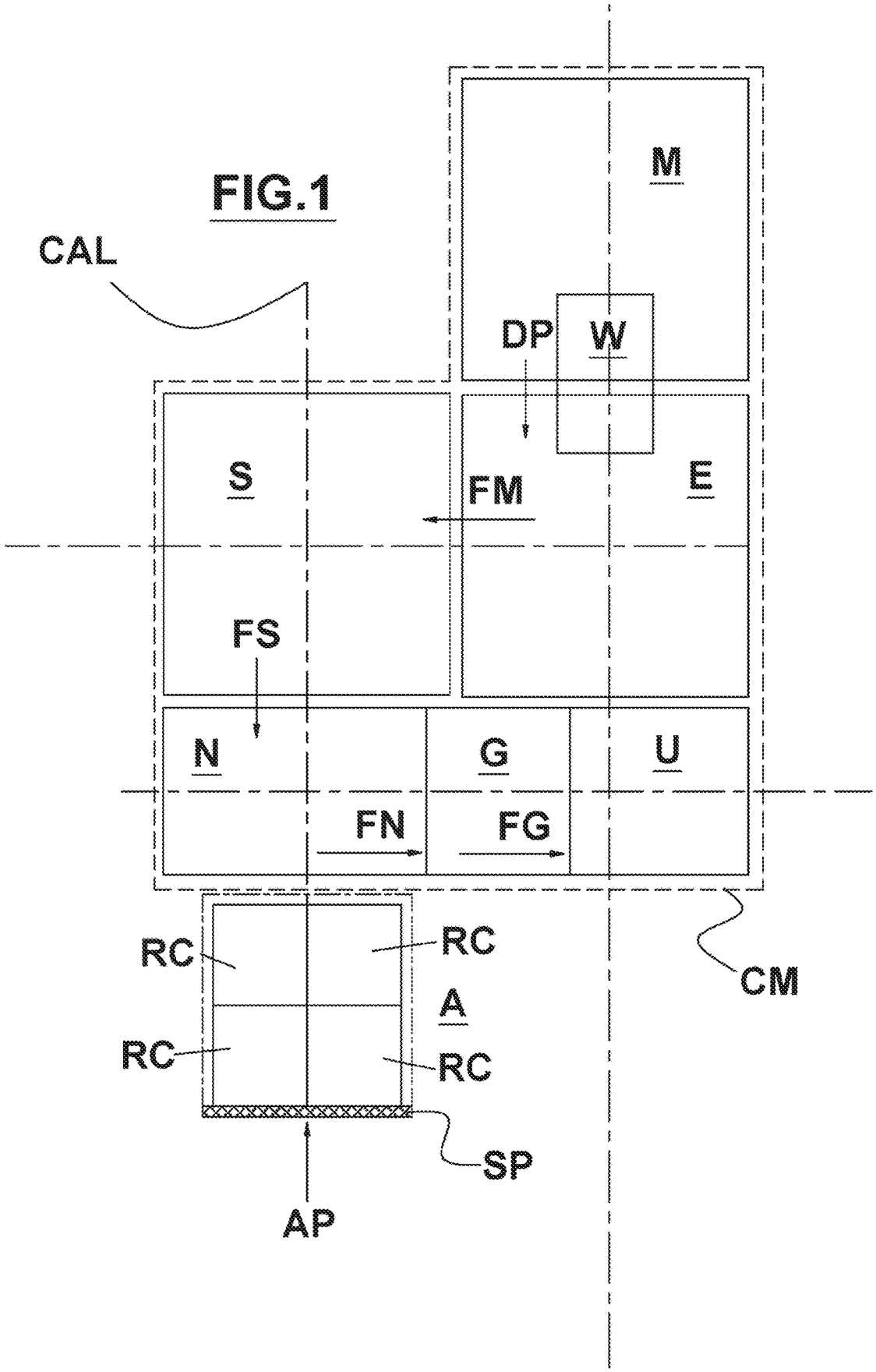
Figure 2:
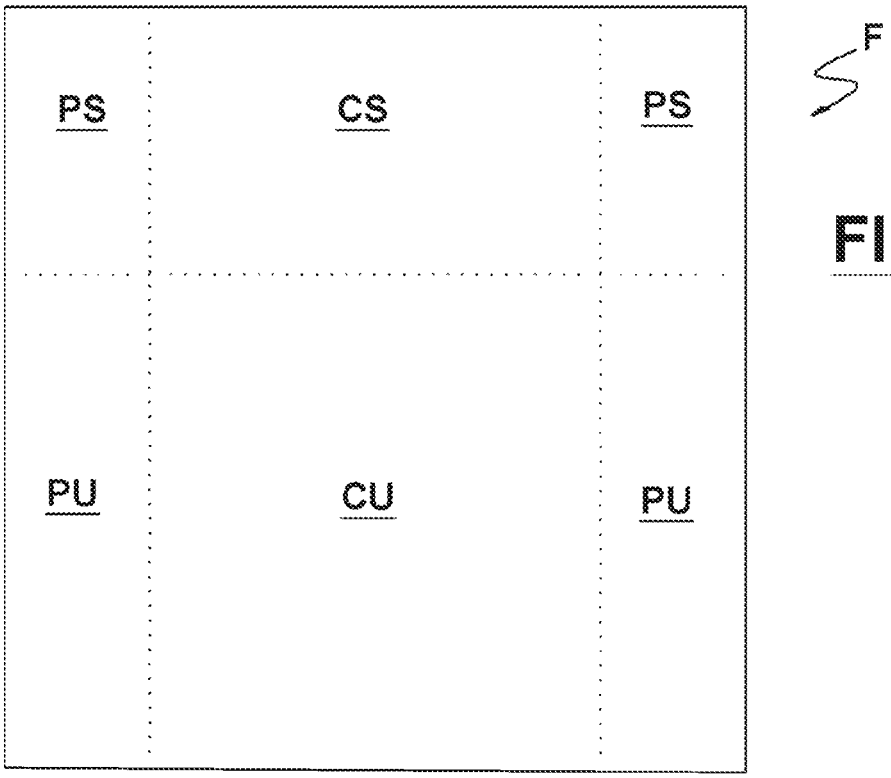
Figure 3:
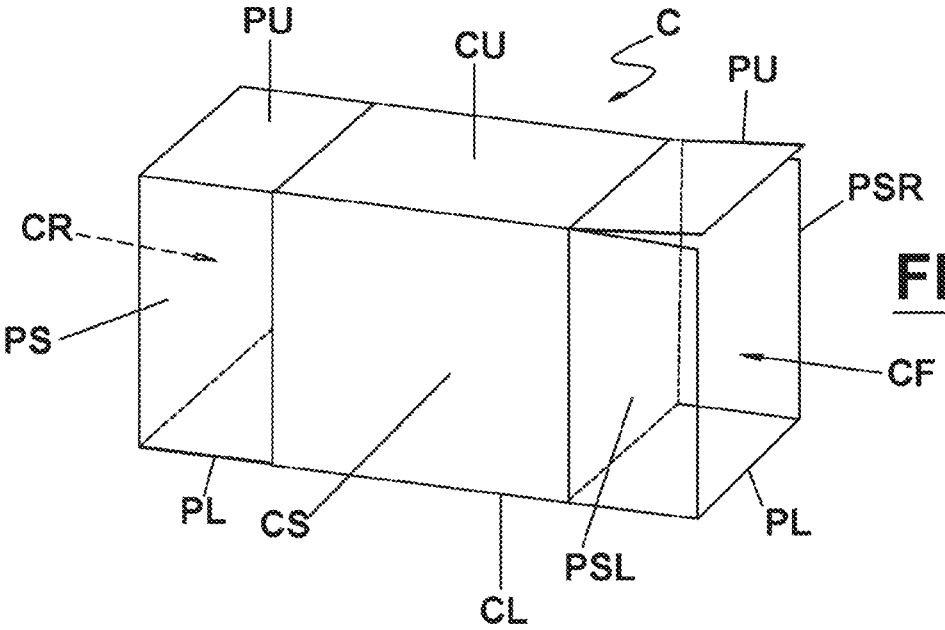

Reduced to its essential structure and with reference to the figures of the accompanying drawings, a cartoning machine according to the present invention comprises:

- a store unit (M) configured to store a stack (P) of flat cartons (F), also called "blanks" in jargon;
- a station (E) for supplying the individual blanks, arranged downstream of the store unit (M);
- an unfolding station (SR), in which the blanks (F) are shaped, assuming the configuration of a substantially parallelepiped open box (C) defined by an upper base (CU), a lower base (CL), two lateral bases (CS), a front base (CF) and a rear base (CR), in which the front base and the rear base are open but intended to be closed by flaps made up of appendixes (PU, PL) of the upper and lower bases and appendixes (PS, PSL, PSR) of the lateral bases: said lateral, upper and lower bases being defined by respective portions of the blanks (F);
- a product feeding station (A), into which the products (RC) intended to be packaged in the boxes (C) obtained from the blanks (F) are fed;
- an insertion station (N), in which the products (RC) are inserted into the open boxes (C)
- a station (G) for gluing the aforementioned flaps, i.e. for closing the boxes (C);
- an exit station (U) for the completed packages.

In the drawings, the flaps (PSL, PSR) are part of the front side of the box (C) through which the products are introduced (RC), while the flaps (PS) are part of the rear side of the box. Furthermore, in the drawings the line "FFS" indicates a plane in the middle of the unfolding station(S) and the line "FIP" indicates an ideal plane crossed by the products (RC) as they enter the insertion station (N). The line "CAL" indicates a vertical plane in the middle of the products feeding station (A).

In FIG. 1 the arrow "AP" indicates the direction followed by the products (RC) in the feeding station (A). For example, the products (RC) are toilet paper rolls or kitchen towel rolls packaged in plastic or paper wrappings. For example, with per se known methods, the products (RC) are transported to the feeding station (A) by means of conveyors (represented by the arrow "AP") and a pusher (SP) is arranged in the feeding station (A) for pushing the products, along the direction (AP), towards the insertion station (N) to insert the products into the open boxes (C). The "FM" arrow indicates the direction followed by the blanks directed to the unfolding station(S), while the "FS" arrow indicates the direction followed by the open blanks from the unfolding station(S) to the inserting station (N). The arrow "FN" indicates the direction followed by the opened and filled boxes from the inserting station (N) to the gluing station (G). The arrow "FG" indicates the direction followed by the boxes from the gluing station (G) to the exit station (U). The "DP" arrow indicates the direction along which the blanks are taken from the store unit (M).

The group consisting of the store unit (M), the blanks feeding station (E), the unfolding station(S) and the product insertion station (N), the gluing station (G) and the exit station (U) constitutes the so-called "machine body" (CM).

Cartoning machines structured according to the diagram described above are known, as well as the functions of the single devices arranged and acting in the operating stations mentioned above.

Preferably, the machine body (CM) develops according to a layout which provides for arranging the aforesaid stations in such a way that the movement of the blanks (F) and of the cartons (C) between the station (E) for supplying the individual blanks, the unfolding station(S), the product insertion station (N) and the exit station (U) follows a "U" or "C" path providing a particular compactness of the machine body which favors its placement even in spaces not particularly extended in length.

Between the store unit (M) and the unfolding station(S) there is a system (W) for feeding the blanks (F) configured to withdraw the single blanks from the store unit (M) and to feed them to the unfolding station(S). In an alternative embodiment of the invention, the gluing station (G) may not be provided. In this case, the boxes filled with the products (RC) will be closed, by gluing or by an adhesive tape, at a site separate from the machine body (CM).

A process for withdrawing the blanks (F) from the store unit (M) and conveying the same blanks to the unfolding station is described below.

Figure 18:
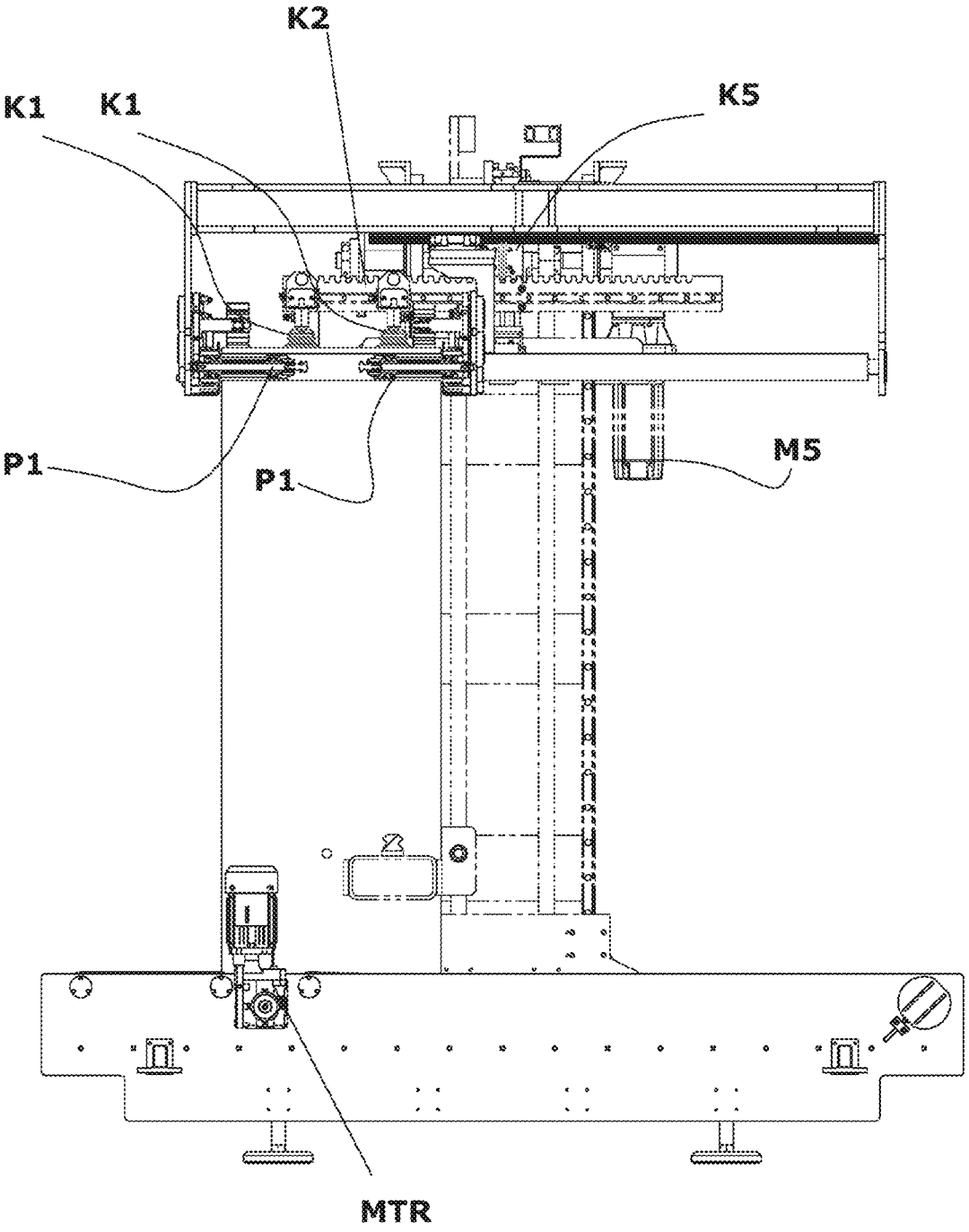
Figure 19:
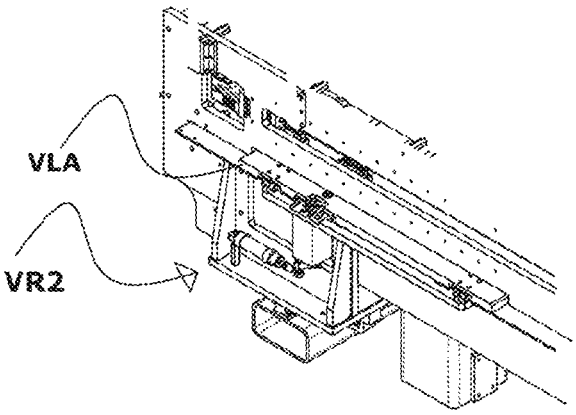
Figure 20:
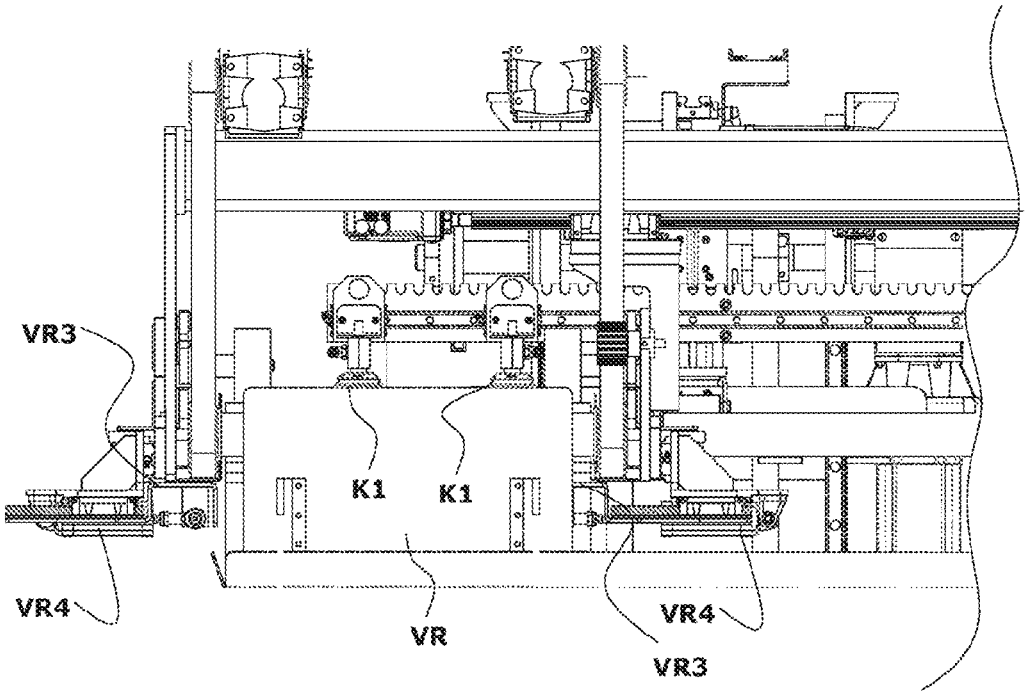

In the attached drawings, the store unit (M) comprises a base roller unit (M1) on which the piles (P) of blanks are stacked and an elevator (M2) provided with forks. The elevator (M2) is of the type known per se, provided with forks (M3) protruding from one side of the elevator itself and connected to two chains (M4) driven by a gearmotor (M5) which allows to raise and lower the forks (M3) making them to pass between the rollers of the base roller unit (M1) when the elevator passes from an inactive waiting position to an active working position. More specifically, when loading a stack (P) onto the roller unit, the forks (M3) are below the rollers so as not to interfere with the transit of the stack (P) during loading, i.e. they are in an inactive waiting position; since it is required that the highest blank (F) of the stack is always at a predetermined height (H) with respect to the base of the machine, as a blank is withdrawn from the stack as described below, the forks (M3) are raised in active working position of a value corresponding to the thickness of the blanks; in the transition from the inactive position to the working position, the forks (M3) pass through the rollers of the roller base (M1). For example, the stacks (P) of blanks can be loaded onto the roller unit (M1) by means of a forklift (not shown in the drawings). In FIG. 18 the reference "MTR" indicates a motor that controls the rotation of the rollers (M1) in the store unit (M).

Above the store unit (M) there is a blank picker (K), i.e. a device configured to separate the highest blank in the stack (P) from the underlying blanks and move it along a predetermined picking direction "DP" up to a dragging unit (T) arranged downstream of the same blank picker (K) with respect to the picking direction (DP).

The picker (K) comprises a plurality of pneumatic suckers (K1) supported by a bar (K2) which is oriented transversally to the picking direction (DP) and is connected to an electric actuator (K3) which controls its movement along the picking direction (DP).

The bar (K2) is mounted on a pneumatic cylinder (K5) which can be moved vertically to and from the underlying area of the store unit (M) occupied by the stack (P). In the operating phase, the picker engages, with the pneumatic suckers (K1), the front edge (AF) of the highest blank of the stack (P), i.e. the edge of the blank closest to the dragging unit (T). Then, the bar (K2) is lifted and transported along the direction (DP) so as to introduce the front edge (AF) of the blank (F) into the dragging group (T). It goes without saying that the run of the bar (K2) along the direction (DP) is of such a value as to allow the front edge (AF) of the blank (F) to be introduced into the dragging unit (T). After the blank (F) has been inserted into the dragging unit (T), the pneumatic suckers release the blank and are brought back to their initial position to engage another blank.

The dragging unit (T) is configured to engage the blanks (F) and move them along the direction (DP) so as to place them in a position suitable for their transfer to an underlying collection compartment (VR) as further described below.

In accordance with the example shown in the annexed drawings, the dragging unit (T) comprises a plurality of motorized rollers (T1) above which corresponding counter-rollers (T2) are arranged which facilitate the engagement of the blanks (F) fed by the picker (K). In particular, the motorized rollers (T1) and the respective counter-rollers (T2) are mounted on two opposite sides of a respective support structure (T3), i.e. on a right side and on a left side of the structure (T3) with respect to the direction (DP). The driven rollers (T1) and the counter-rollers (T2) are oriented with their respective axes orthogonal to the direction (DP). The motorized rollers (T1) are synchronized with each other. The counter-rollers (T2) are rubber-coated rollers each of which is mounted idly on a support arm (RB2) that, in turn, is connected to the respective side of the structure (T3), for example as further described below. The counter-rollers (T2) are pushed downwards by respective springs (8). In practice, the motorized rollers (T1) define a guide on which the blanks (F) are moved along the direction (DP) and the counter-rollers (T2), by exerting pressure on the same blanks, assist the action of the motorized rollers.

The configuration of the assembly composed of the motorized rollers (T1) and the counter-rollers (T2) can be adjusted according to the format of the blanks (F).

In particular, it is possible to adjust the extension of the blanks engagement mechanism (F) along the direction (DP) according to the format of the same blanks.

For example, the rollers (T1) and the respective counter-rollers (T2) are arranged between two support flanks (1L, 1R) arranged at the sides of the path followed by the blanks along the direction (DP). The flank (1L) is fixed while the flank (1R) can be moved closer to or away from the fixed flank. For example, the flank (1R) is constrained to a slide (2) sliding along a structure (3) oriented transversely to said direction (DP) and controlled by an electric actuator (4) which moves the slide (2) along the structure (3) by means of a worm screw (5). In practice, in a possible embodiment, the worm screw (5) can engage a corresponding threaded seat presented by the slide (2) so as to bi-directionally move the flank (1R) (which is integral with the slide 2) in relation to the rotation in one direction or the other of the same screw (5). In this way the value of the distance between the two flanks (1R) and (1L) can be varied according to the different dimensions presented by the blanks.

In accordance with the example shown in the attached drawings, in the inlet section of the dragging unit (T) there is a motorized roller (T1A) which extends transversally between the flanks (1R, 1L) and to which a respective counter-roller is not associated. Immediately downstream of the roller (T1A) there are two other motorized rollers (T1B, T1C) which also extend transversally between the flanks (1R, 1L) and to which are associated respective opposite counter-rollers (T2B, T2C). The assembly formed by the roller (T1A) and the rollers (T1B, T1C) with the respective counter-rollers (T2B, T2C) form a dragging mechanism for the incoming blanks. A belt (CL, CR) with both external and internal teeth is mounted on each flank (1L, 1R). The internal teeth of said belt engages with a toothed pulley (PL, PR) keyed on the shaft of a respective motor (ML, MR). In the drawings, the motor (MR) is integral with the flank (1R) and, therefore, it follows the movement controlled by the actuator (4). Several pairs of rollers and respective counter-rollers (T1, T2) are also mounted on each flank (1R, 1L). In each of said pairs (T1, T2) the motorized roller (T1) is mounted on a first end of a first arm (RB1) which, at the other end, is pivoted at (6) to a respective flank (1R, 1L). The counter-roller (T2) is mounted on a first end of a second arm (RB2) which, at the other end, is pivoted at (7) on the same flank (1R, 1L). The arms (RB1, RB2) are connected to each other by an elastic member (8) which keeps the counter-roller (T2) pushed towards the motorized roller (T1). In this example, each driven roller (T1) is oriented orthogonally to the respective flank (1R, 1L) without extending to the opposite flank (1L, 1R). Furthermore, each driven roller has an initial part (the part facing the respective flank 1R. 1L) on which a toothed pulley (RD) is arranged which is adapted to engage with the external teeth of a respective toothed belt (CR, CL). Each motorized roller (T1) downstream of the input drive mechanism (T1A, T1B, T1C, T2B, T2C) can be placed in an engagement position with the respective toothed belt (CL, CR) and respectively in a disengagement position. For example, each motorized roller (T1) has an axial pin (P1) which has one end (P11) that can be inserted into one of two holes (9, 90) formed in the respective flank (1R, 1L) and an opposite end provided with a knob (P12), the pin (P1) being connected to an internal surface of the motorized roller (T1) by means of an elastic member (P13) which keeps the pin (P1) normally pushed towards the respective flank (1R, 1L). The holes (9, 90) are at a predetermined distance from each other so that, when the end (P11) of the pin (P1) is inserted in a hole (90), the motorized roller (T1) is spaced from the respective belt (CL, CR); and when said end (P11) is inserted in the other hole (9), the motorized roller (T1) is approached to the respective belt (CL, CR) and the respective toothed pulley (RD) engages with the external teeth of this belt. The positioning of the rollers (T1) and of the corresponding counter-rollers (T2) in the active engagement position and respectively in the inactive disengagement position of the toothed belts (CL, CR) can be carried out manually in a setup phase of the machine according to the blank format. The knob (P12) facilitates the manual positioning of the couples (T1, T2) in the described active and inactive configurations. In the passage of the couples (T1, T2) from the active position to the inactive position and vice versa, the rollers (T1) and (T2) rotate around the fulcrums (6) and (7).

Figure 4:
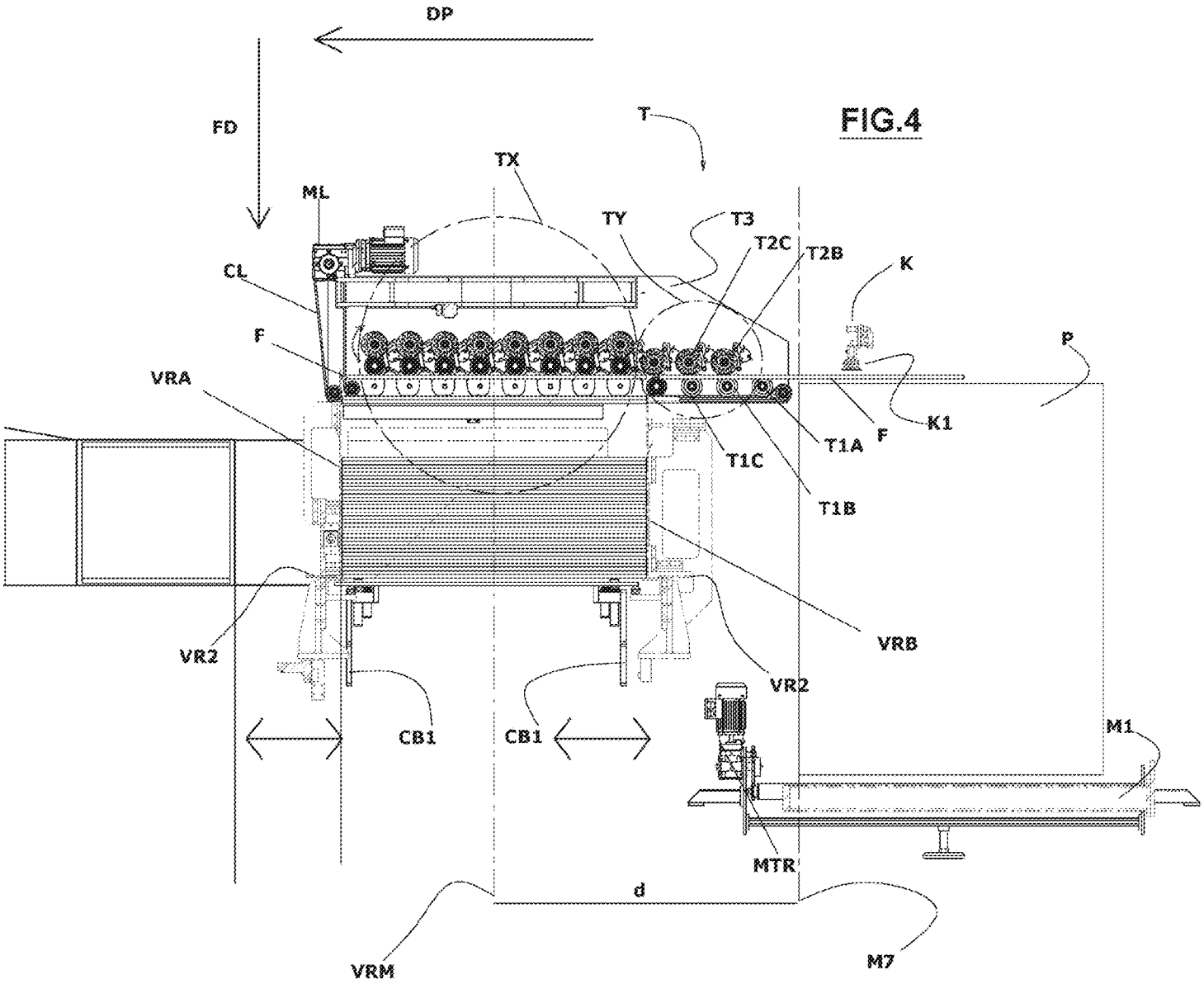
FIGS. 4-27 show a possible embodiment of a mechanism for picking up the blanks in a cartoning machine in accordance with the present invention.
Figure 5:
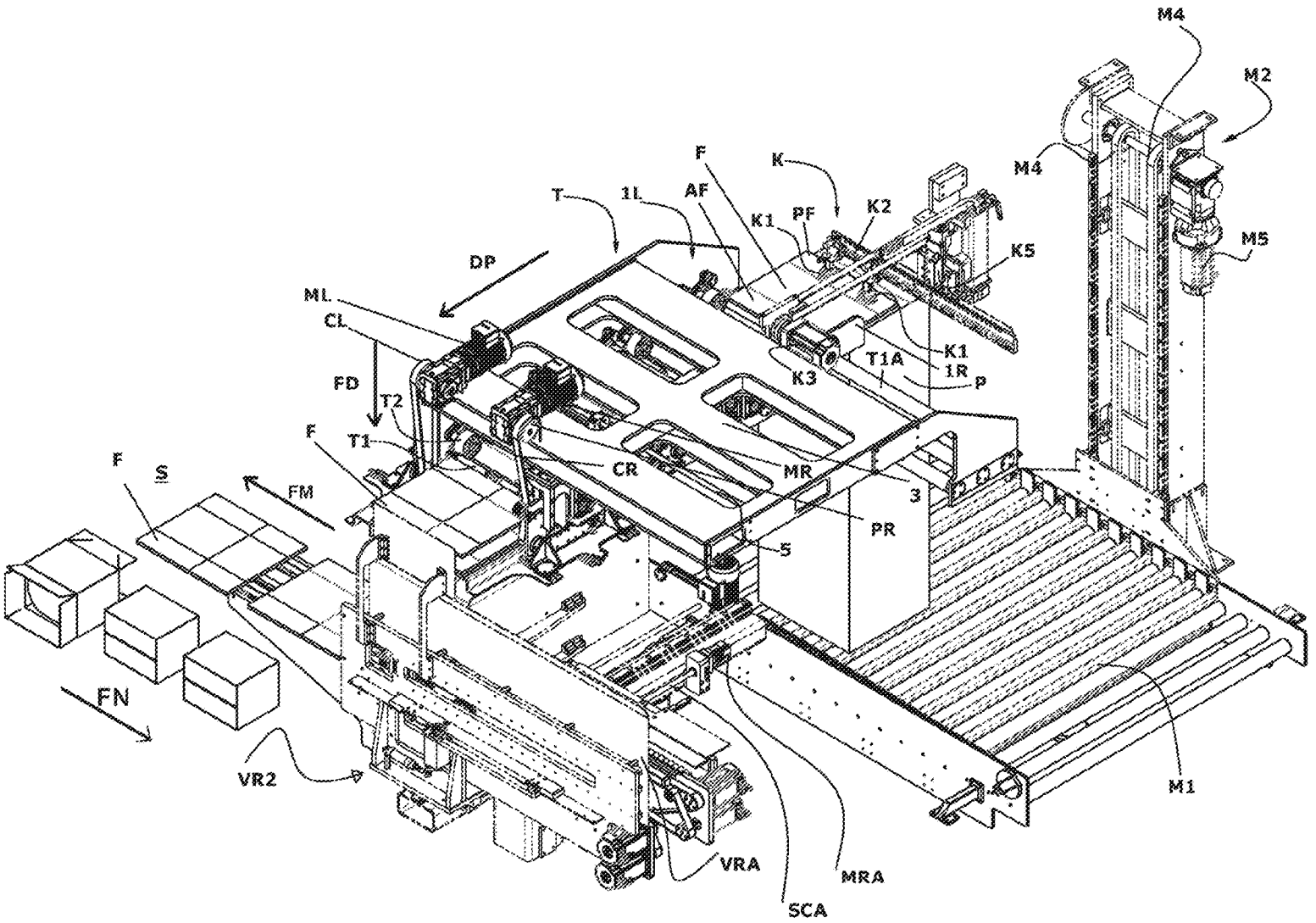
Figure 6:
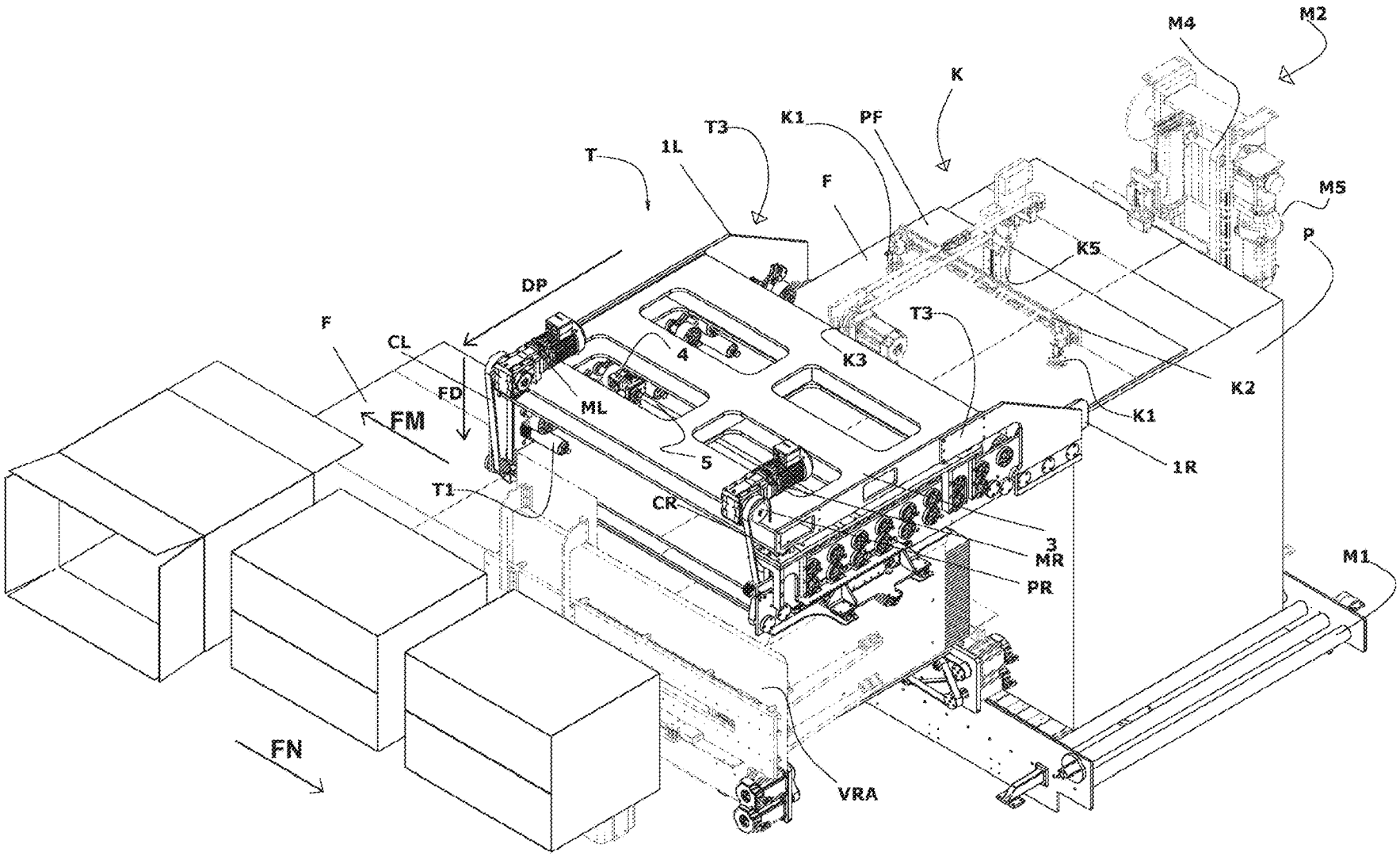

In practice, the dragging unit (T) is a conveyor with variable configuration, the configuration of which can be adjusted according to the format of the blanks (F). In other words, the dragging unit (T) has an active zone (TY) and an inactive zone (TX) and the extension of both said zones (TY, TX) along the direction (DP) can be modified according to of the format of the blanks. By "active zone" it is meant the part of the dragging unit (T) which engages the blanks progressively introduced into the same unit and dragged along the direction (DP); by "inactive" area it is meant the part of the dragging unit (T) that does not engage the blanks (F) while the latter are engaged in the active zone. For example, in FIG. 4 the active zone (TY) of the dragging unit (T) is formed by the first three motorized rollers (T1) and the respective three counter-rollers (T2) closest to the store unit (M), i.e. by the first three motorized rollers (T1) and respective three counter-rollers (T2) of the entry section of the blanks into the dragging unit (T). Such a configuration may be suitable for dragging larger blanks (F). Conversely, in FIG. 11 the active area of the dragging unit (T) consists of all the motorized rollers (T1) with the respective counter-rollers (T2). Such a configuration can be suitable for dragging smaller blanks (F).

Figure 11:
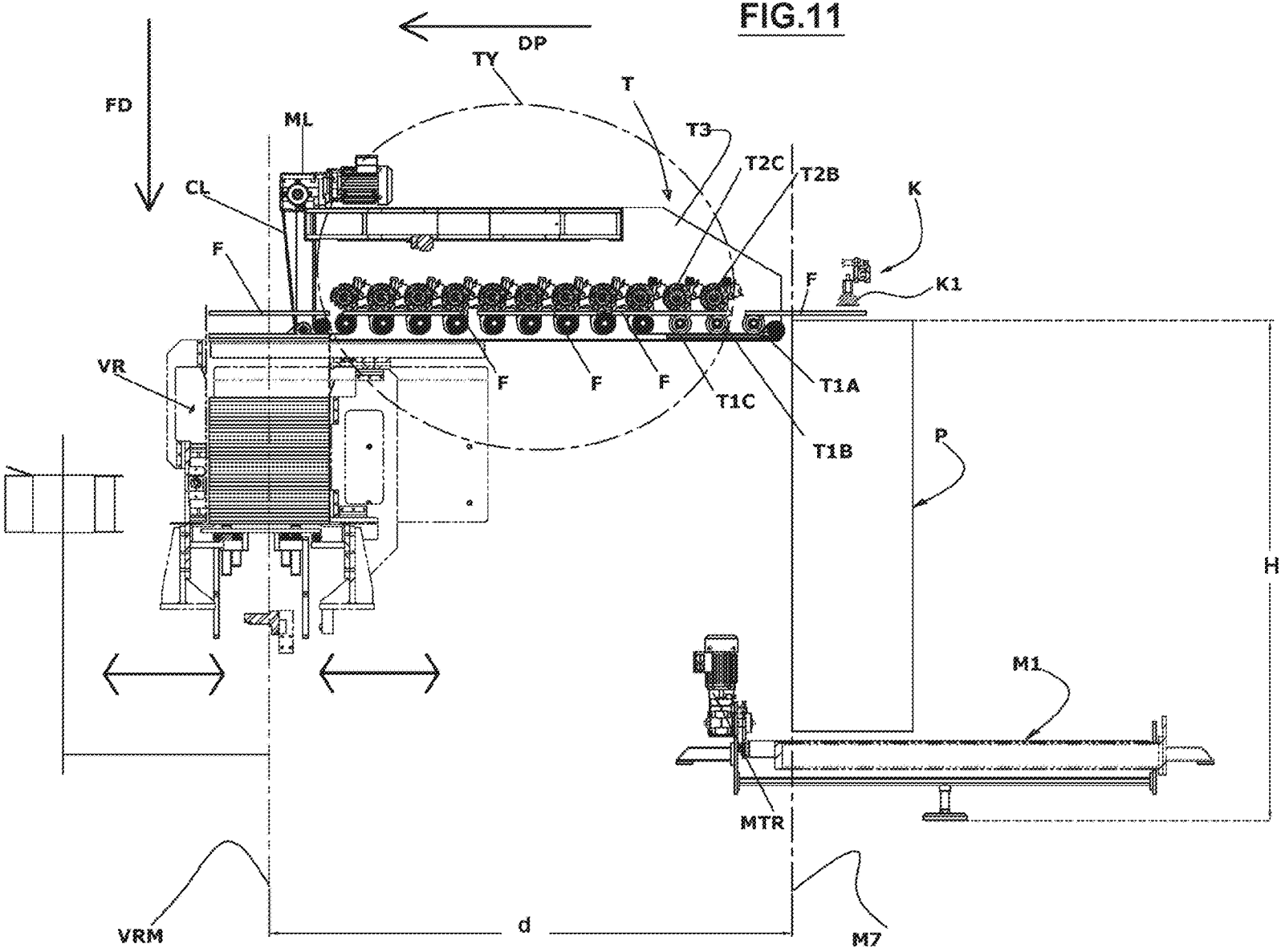
Figure 13:
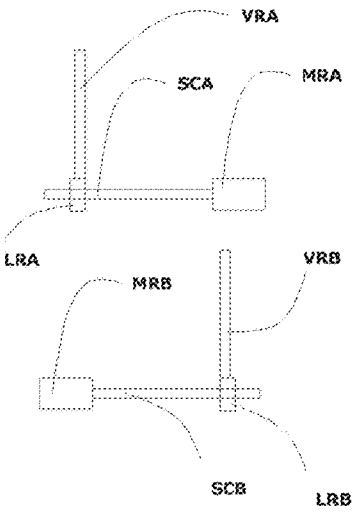
Figure 12:
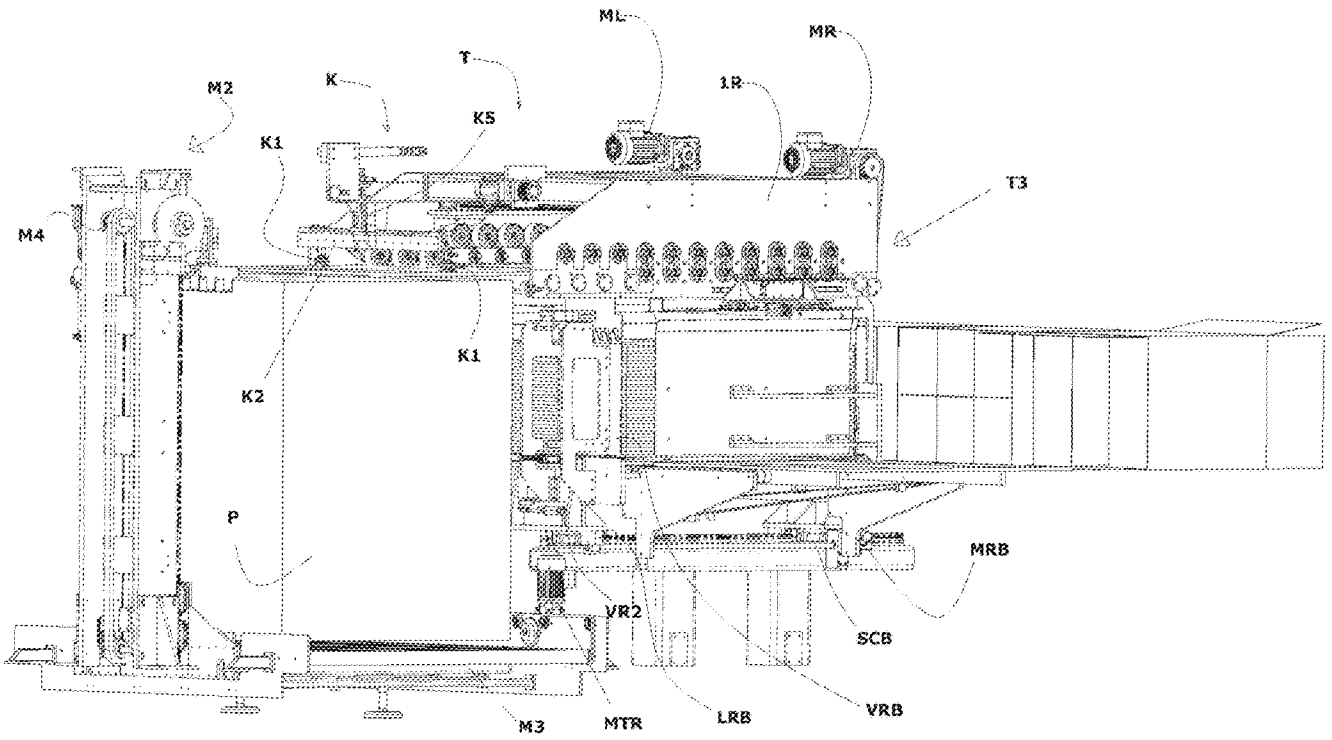
Figure 14:
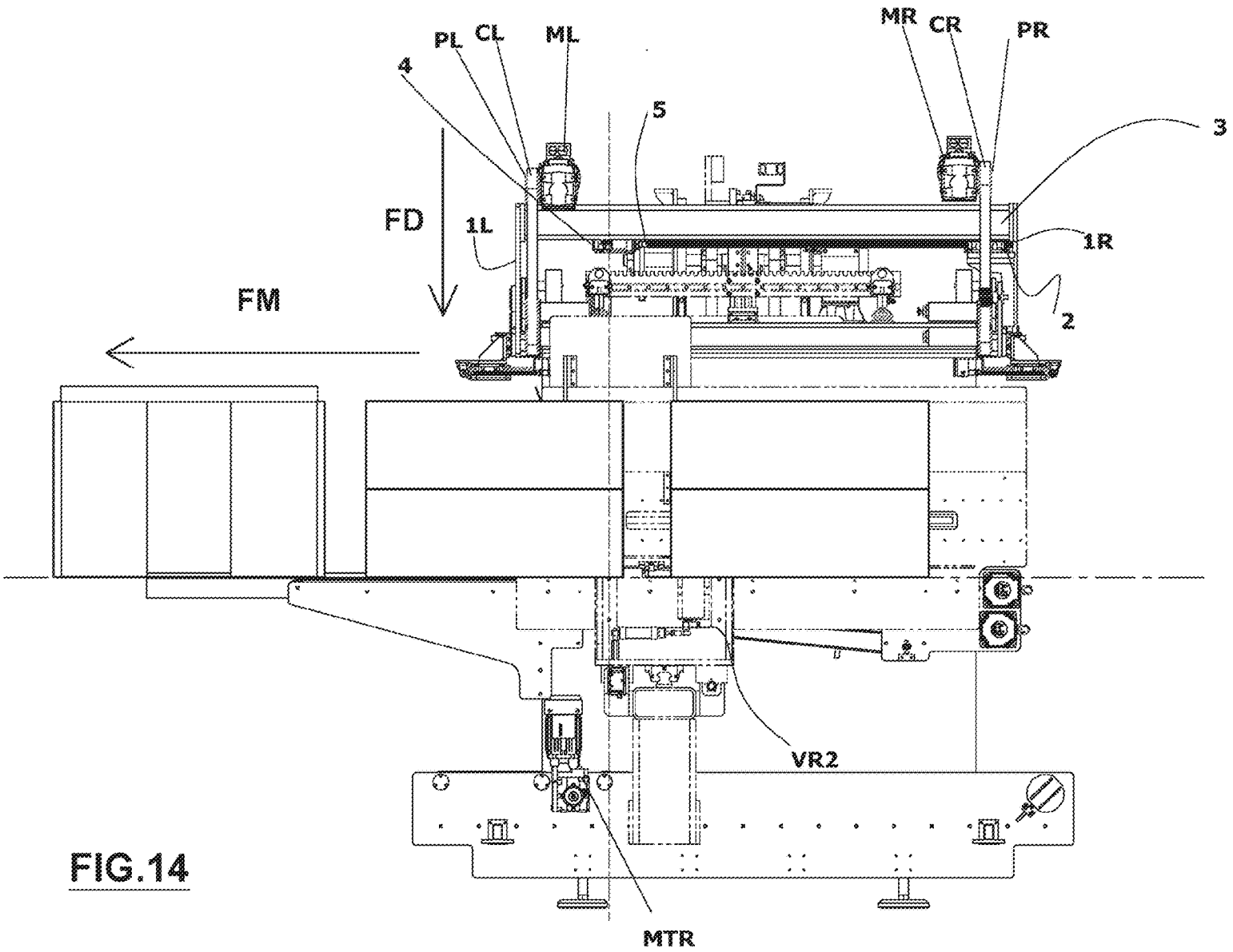
Figure 15:
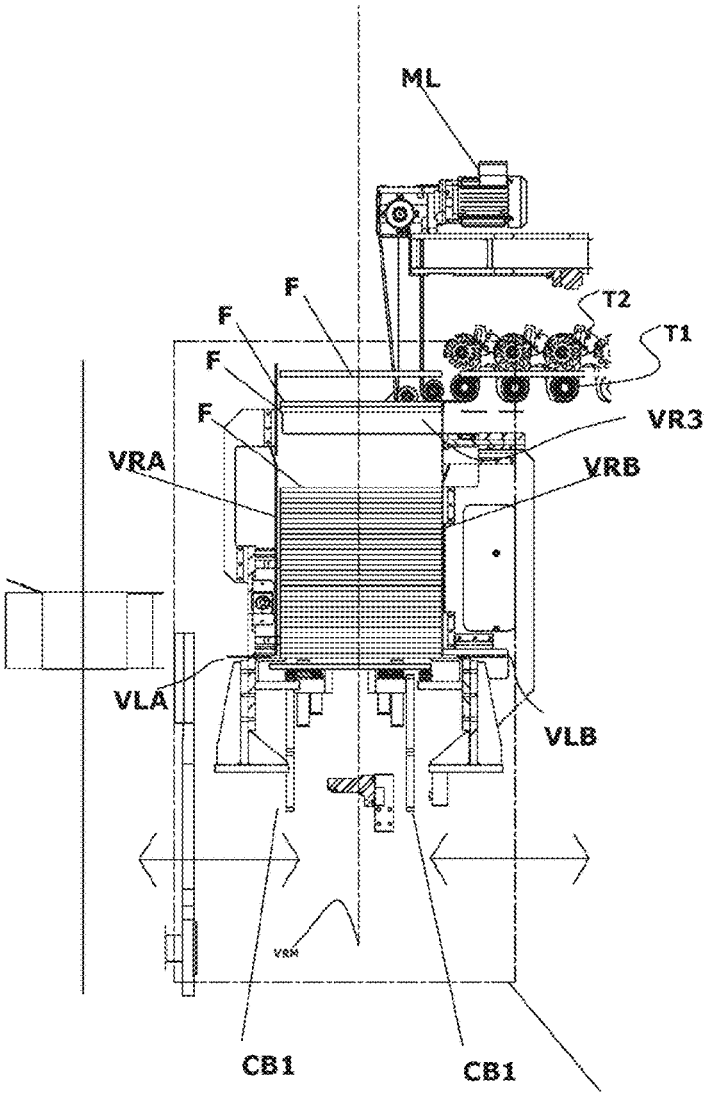
Figure 16:
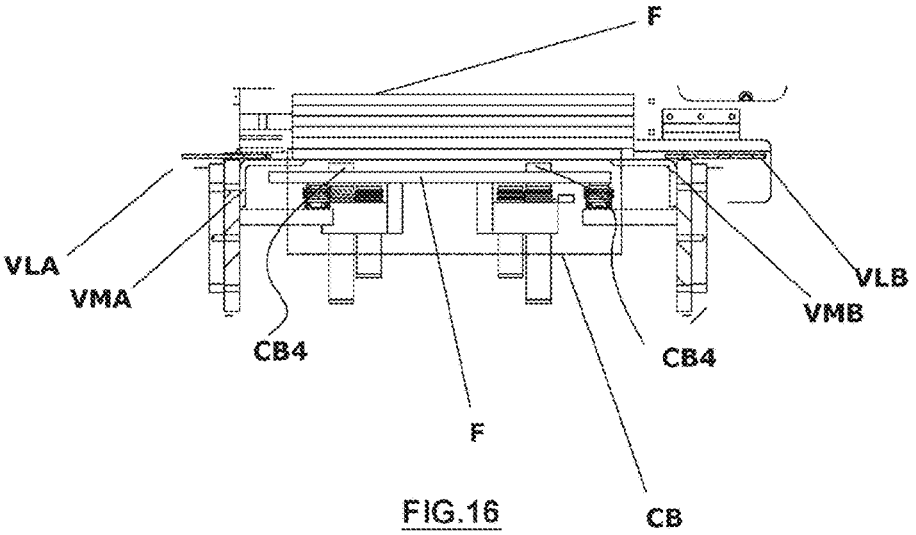
Figure 17:
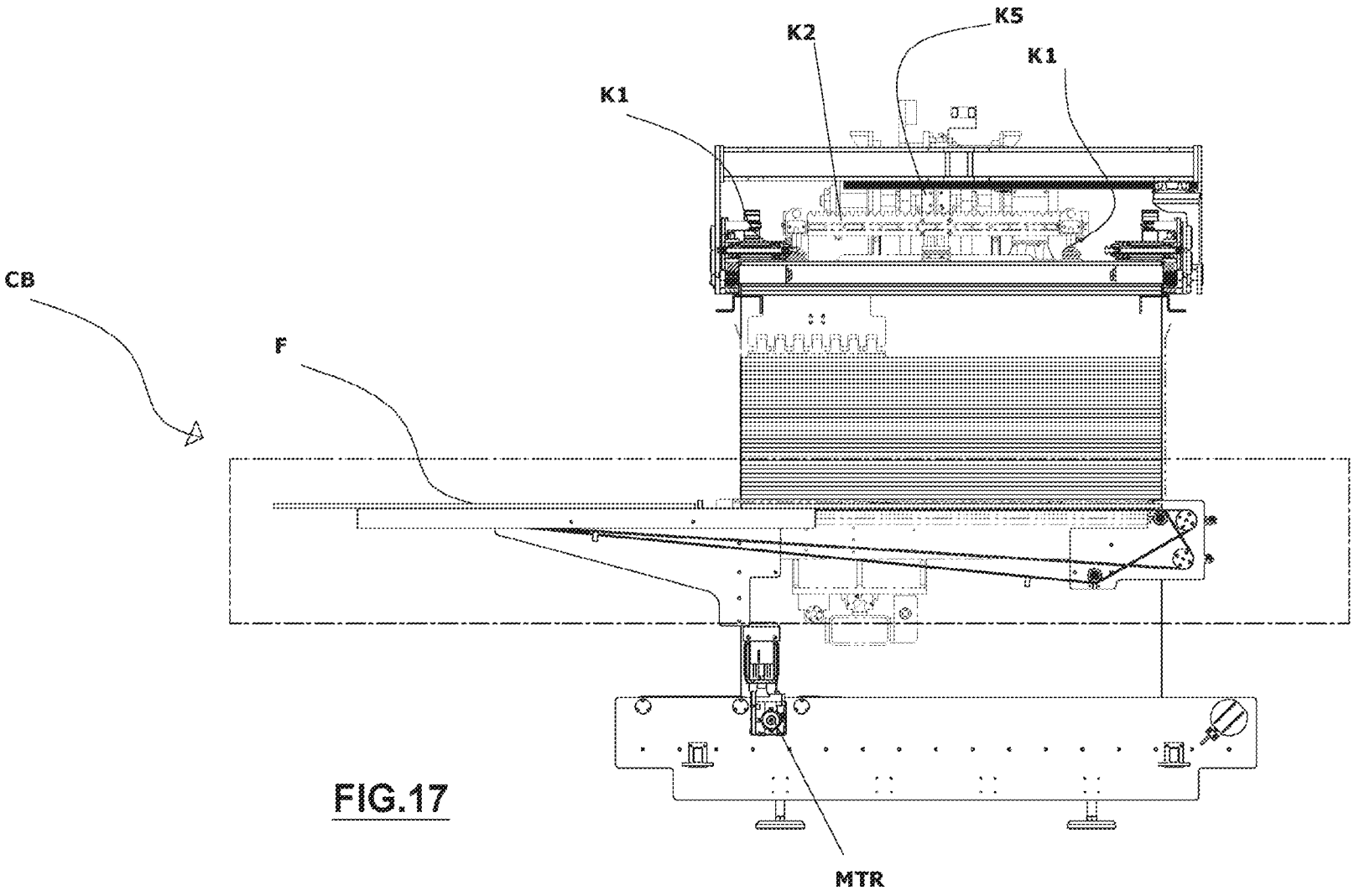

It should be noted that the dragging unit (T) is able to engage several blanks at the same time: in the example of FIG. 11, while a blank (F) is being inserted into the dragging group (T), three other blanks (F) are engaged by the same unit, and another blank is being unloaded into the underlying collection compartment (VR).

The blanks (F) progressively dragged along the direction (DP) by the dragging unit (T) fall into the collection compartment (VR) when, upon exiting the dragging group, they are no longer supported by the dragging unit itself.

The collection compartment (VR) arranged below the dragging unit (T) is a containment structure suitable for receiving and containing a predefined number of superimposed blanks (F), individually coming from the dragging group (T). Said containment structure is a structure with an open mouth at the top and comprises two containment walls (VRA, VRB) oriented transversally to the aforementioned direction (DP) and a respective separator device (VR2) arranged in the lower part of the walls (VRA, VRB), the function of which is to control the exit of one blank at a time from the collection compartment (VR) with a cadence correlated to the production of the machine as further described below. Said walls (VRA, VRB) are a front wall and a rear wall of the collection compartment (VR) with respect to the direction (DP). Preferably, the collection compartment (VR) has, at a predetermined distance from the upper mouth, two interception bars (VR3) controlled by a respective actuator (VR4) so as to intercept the blanks coming from above before they reach the area where the separator device (VR2) is arranged. In practice, an upper pre-collection area is preferably formed inside the collection compartment (VR) in which a predetermined number of superimposed blanks is collected (for example, five in number) coming from the dragging unit (T): upon reaching the preset number of blanks in the pre-collection area, the bars (VR3) release the overlapping blanks, letting them to fall downwards by gravity. The greater weight determined by the set of pre-collected dies compared to the weight of a single blank determines a more stable fall of the same blanks towards the lower part of the collection compartment.

The blanks present in the collection compartment (VR) constitute a buffer which avoids necessarily having to stop the machine when the stack (P) present in the store unit (M) runs out.

The lower part of the collection compartment (VR) is formed by a discharge mouth delimited by two shelves (VMA, VMB) each integral with a respective wall (VRA, VRB), oriented transversely to the walls (VRA, VRB) and both facing towards the inside of the collection compartment (VR). In practice, the shelves (VMA, VMB) define a lower bottleneck of the collection compartment (VR) which prevents the blanks from falling freely through the lower discharge mouth.

The separator (VR2) arranged on the lower side of the collection compartment (VR) comprises two blades (VLA, VLB), i.e. a front blade (VLA) and a rear blade (VLB) with respect to the direction (DP), each arranged above a respective bracket (VMA, VMB) and each slaved to a corresponding actuator which controls its movement to and from the other blade. To obtain the unloading of one blank at a time through the lower discharge mouth of the loading compartment (VR), first a blade (VLA) pushes on the corresponding edge (front edge with respect to the DP direction) of the blank which at that moment is resting on the shelf (VMA), so that this edge of the blank completely goes beyond the shelf (VMA) but the blank, even if at that instant is inclined as is not supported by the shelf (VMA), is not yet completely free to fall down because it is still in part resting on the other shelf (VMB). Subsequently, the front blade (VLA) is brought back and the rear blade (VLB) is advanced to exert a push on the corresponding edge (rear edge with respect to the DP direction) of the same blank, so that the rear edge of the blank is pushed towards the front side of the load compartment (VR) and goes beyond the shelf (VMB). At this point, the blank is free to fall downwards and also the rear blade (VLB) is brought back to its starting position. The place of the blank thus unloaded is taken by the blank immediately above and the process of unloading the blanks from the loading compartment (VR) is cyclically repeated.

In the drawings, the arrow "FD" indicates the movement of the blanks through the loading compartment.

Advantageously, the position of each of the aforesaid walls (VRA, VRB) can be adjusted according to the format of the blanks. For example, in FIG. 4 the walls (VRA, VRB) are more spaced apart than in the configuration of FIG. 11. Since the position of both walls (VRA, VRB) can be adjusted in relation to the format of the blanks in use, the distance (d) of the center line (VRM) of the collecting compartment (VR) from the front side (M7) of the store unit (side of the store unit M facing the dragging unit T) can be adjusted accordingly.

For example, each of said walls (VRA, VRB) is connected to a respective actuator (MRA, MRB) which controls the movement thereof along a direction parallel to the direction (DP) of origin of the blanks. For example, each actuator (MRA, MRB) is connected to the respective wall (VRA, VRB) by means of a worm screw (SCA, SCB) that engages a corresponding nut screw formed in a lower appendage (LRA, LRB) of the wall itself.

Below the collection compartment (VR) there is a conveyor (CB) that receives the blanks released one by one by the collection compartment (VR) and transports them towards the unfolding station(S).

Figure 21:
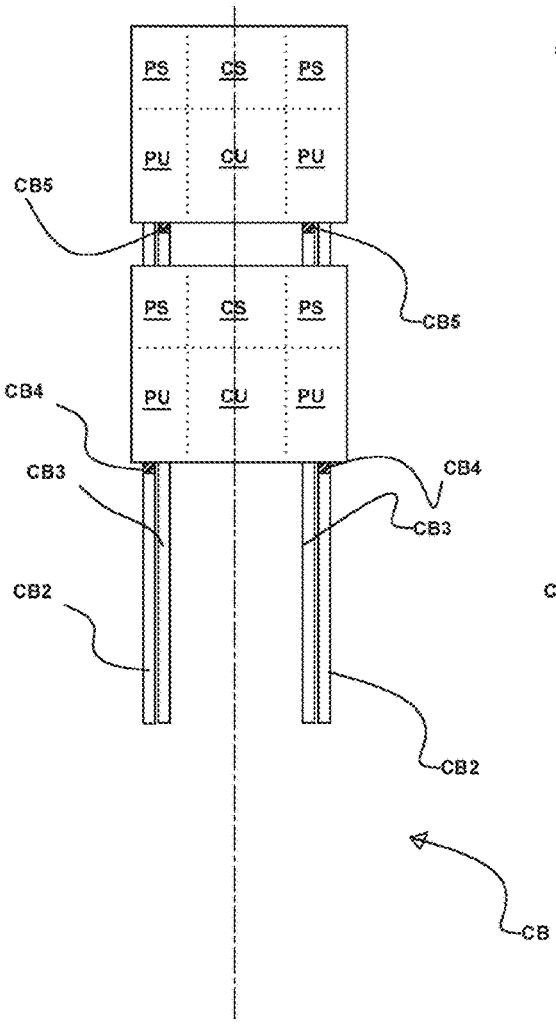
Figure 22:
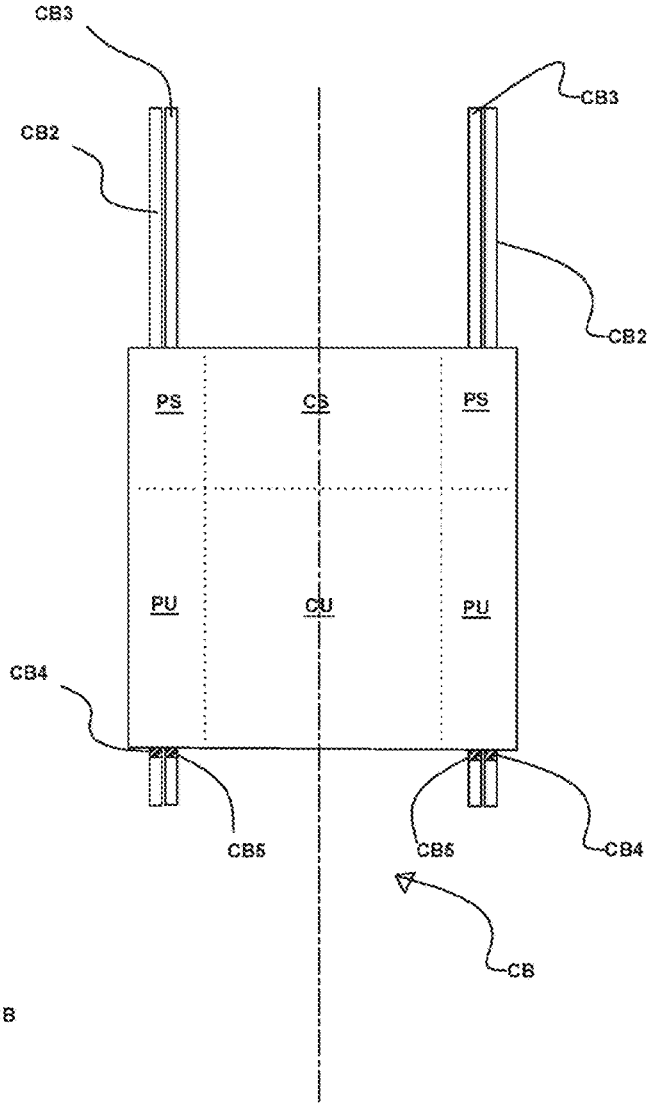
Figure 23:
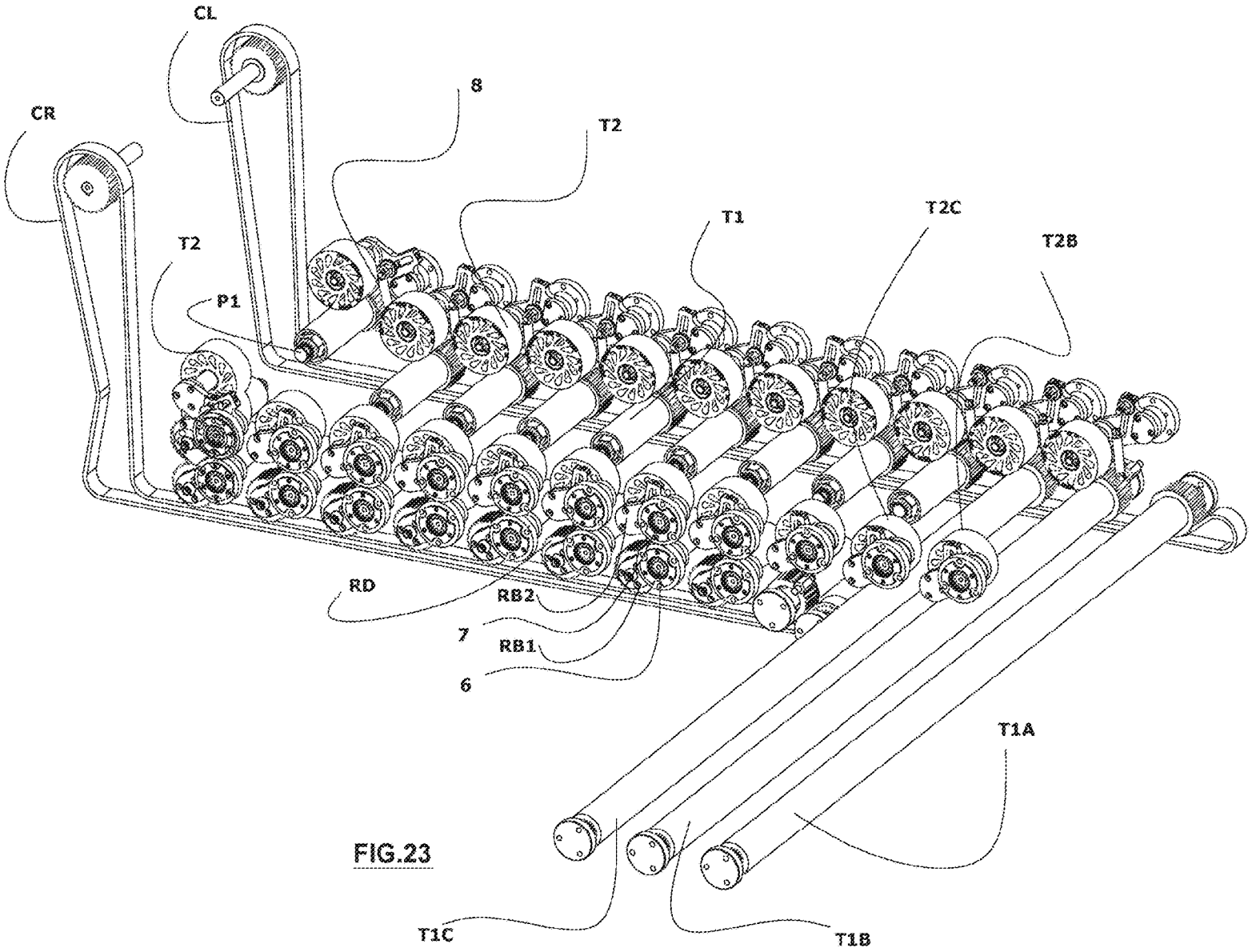
Figure 24:
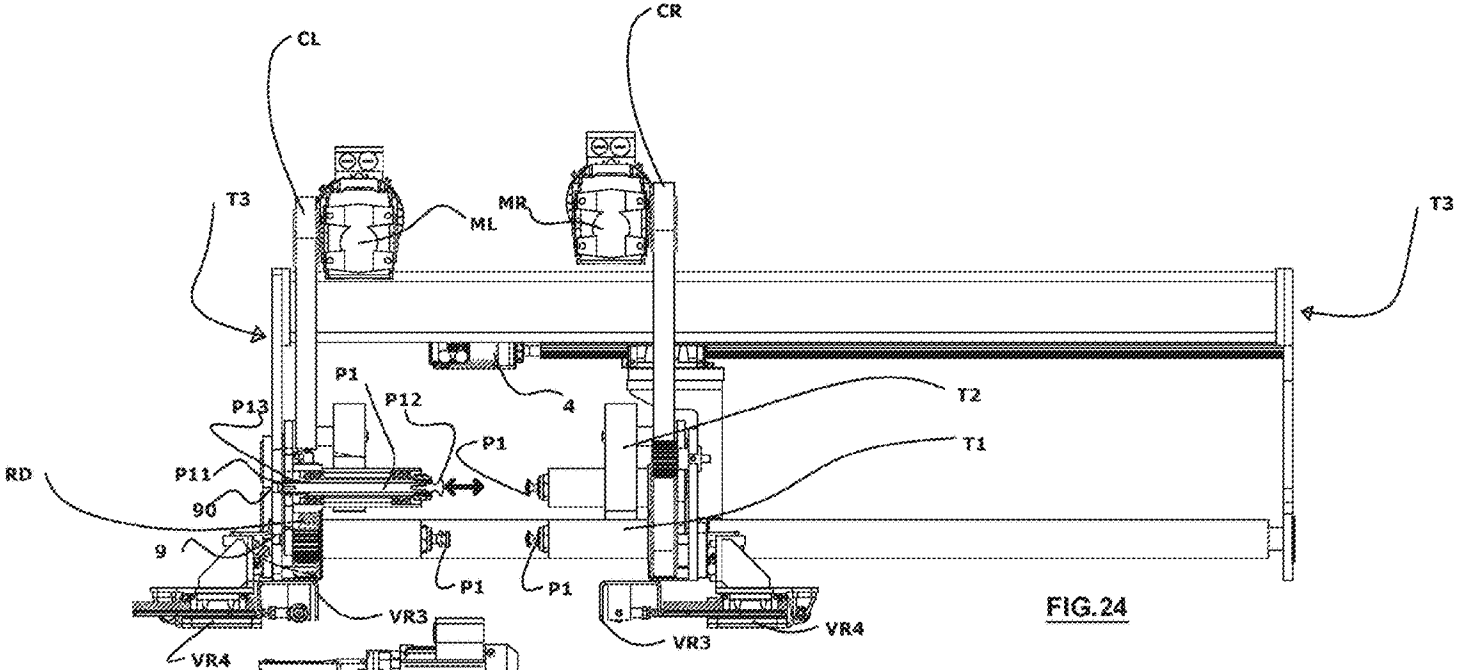
Figure 25:
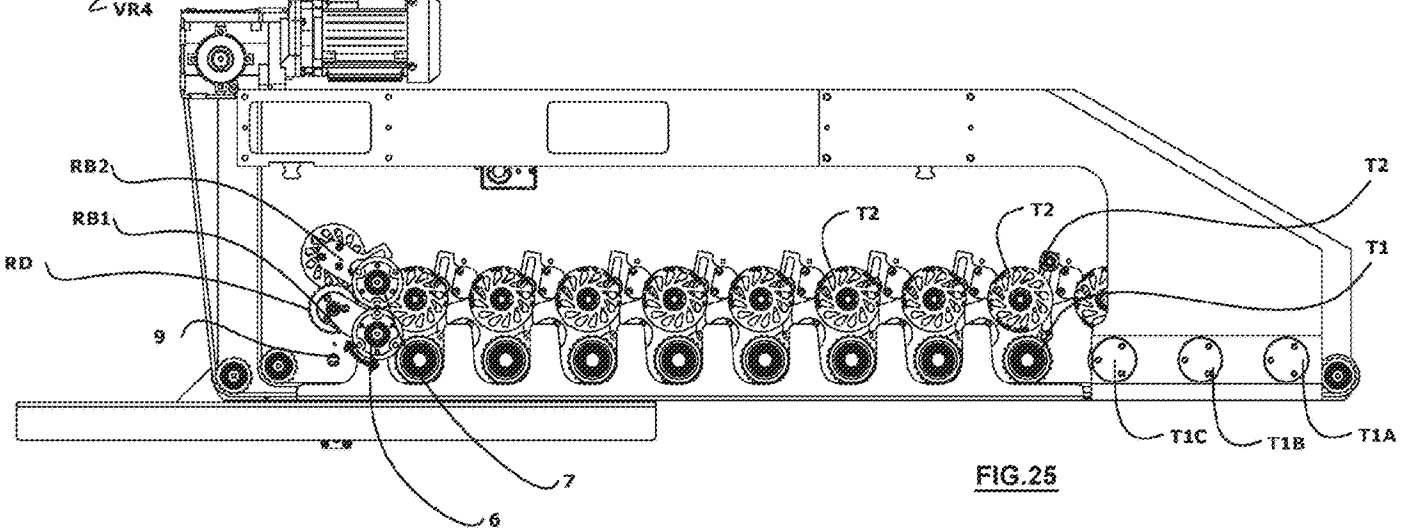
Figures 26, 27:
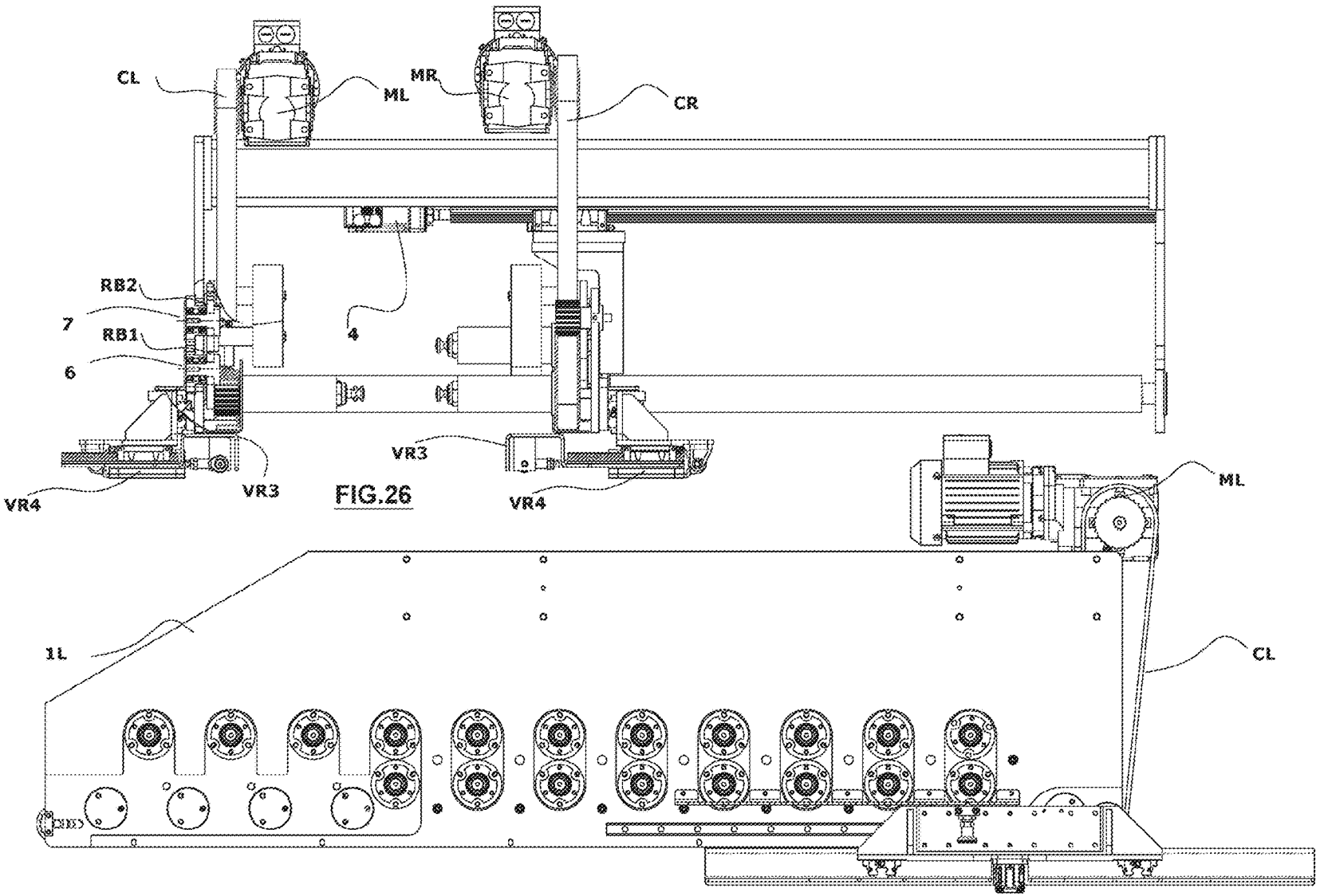
Figure 28:
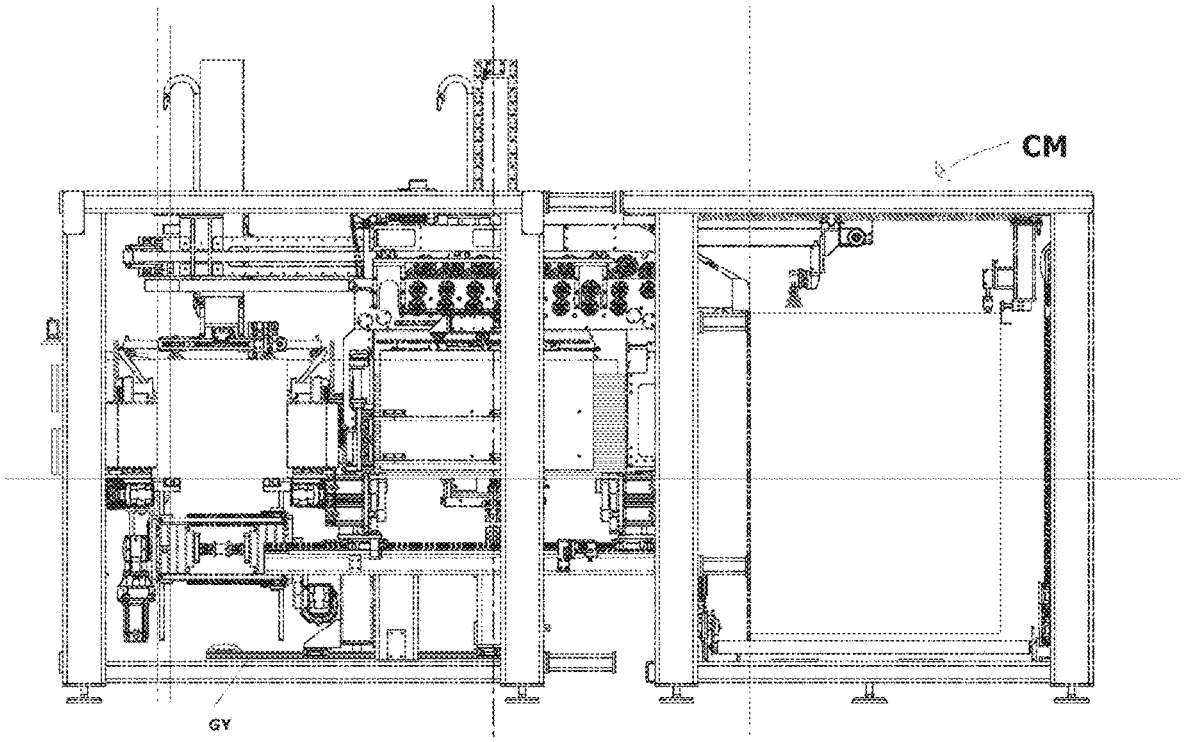
FIGS. 28-50 show a possible embodiment of a system for regulating the position of the unfolding means and of the folding means of the rear vertical flaps of the boxes in a cartooning machine in accordance with the present invention.
Figure 29:
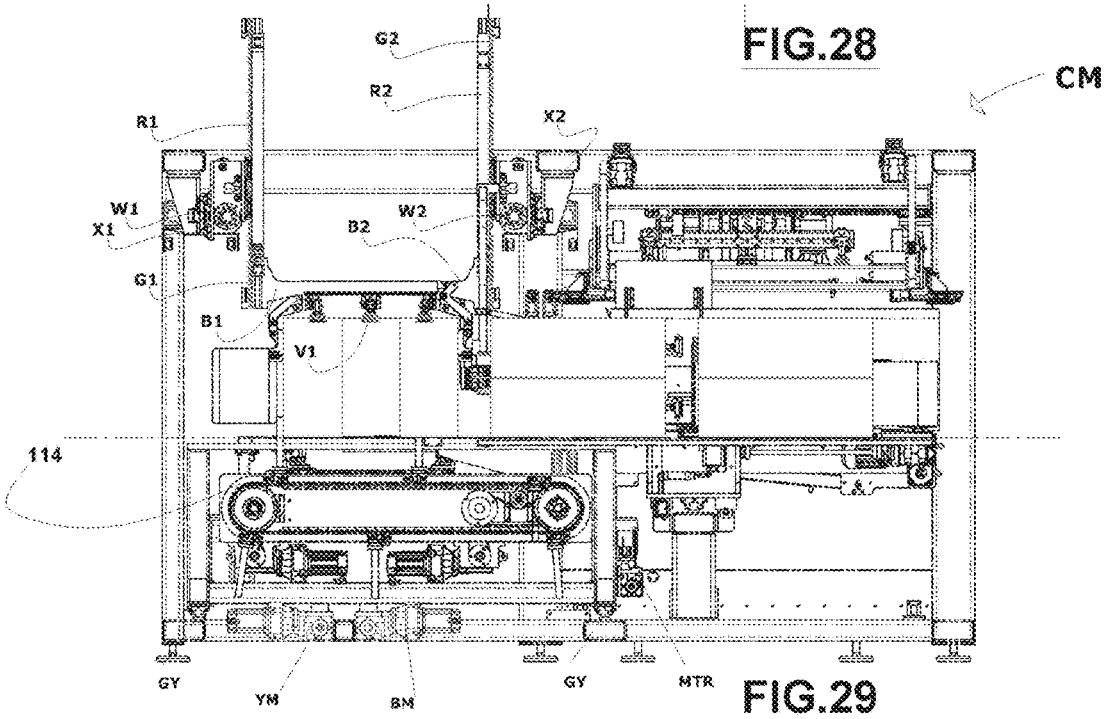
Figure 30:
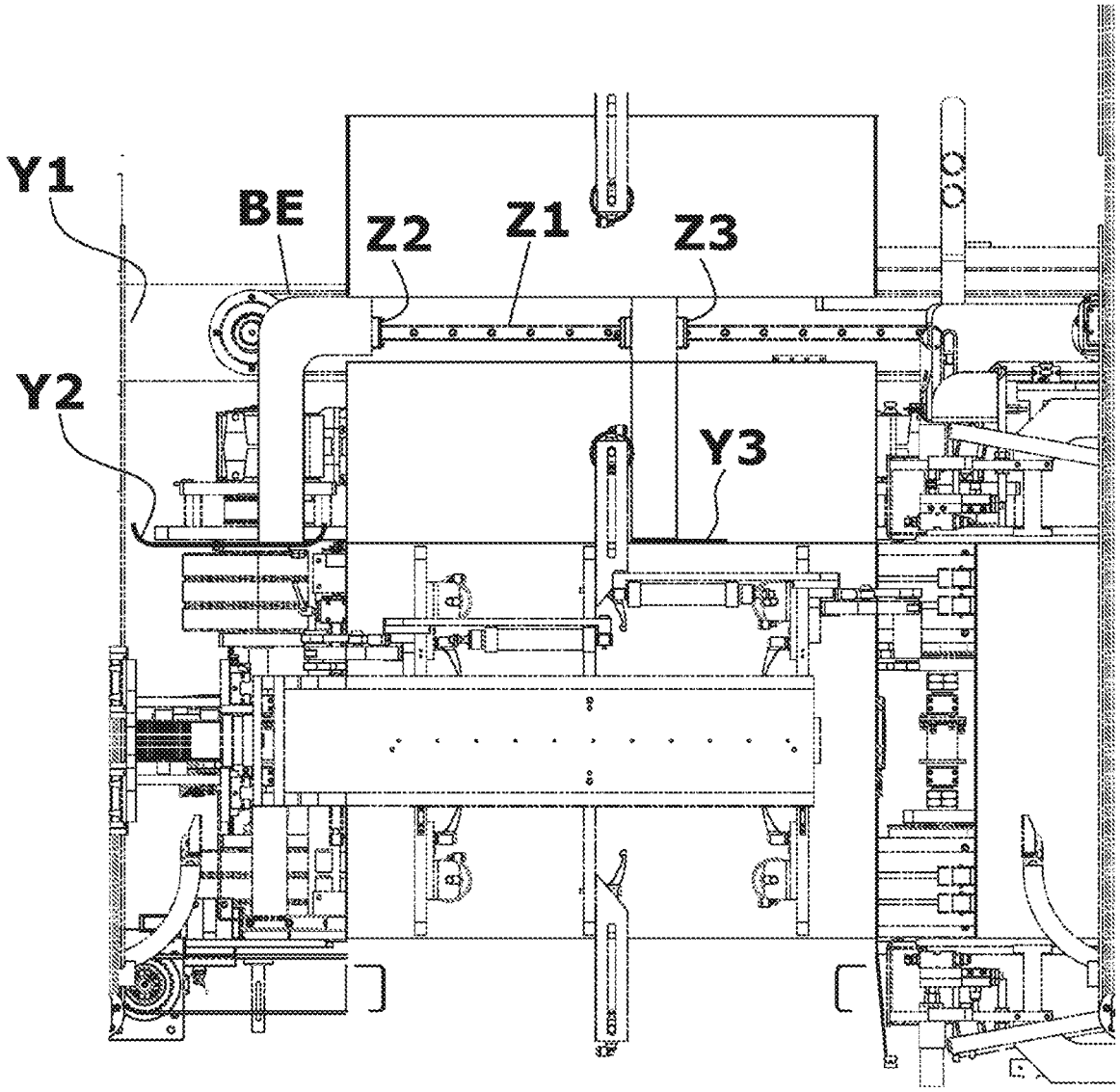
Figure 32:
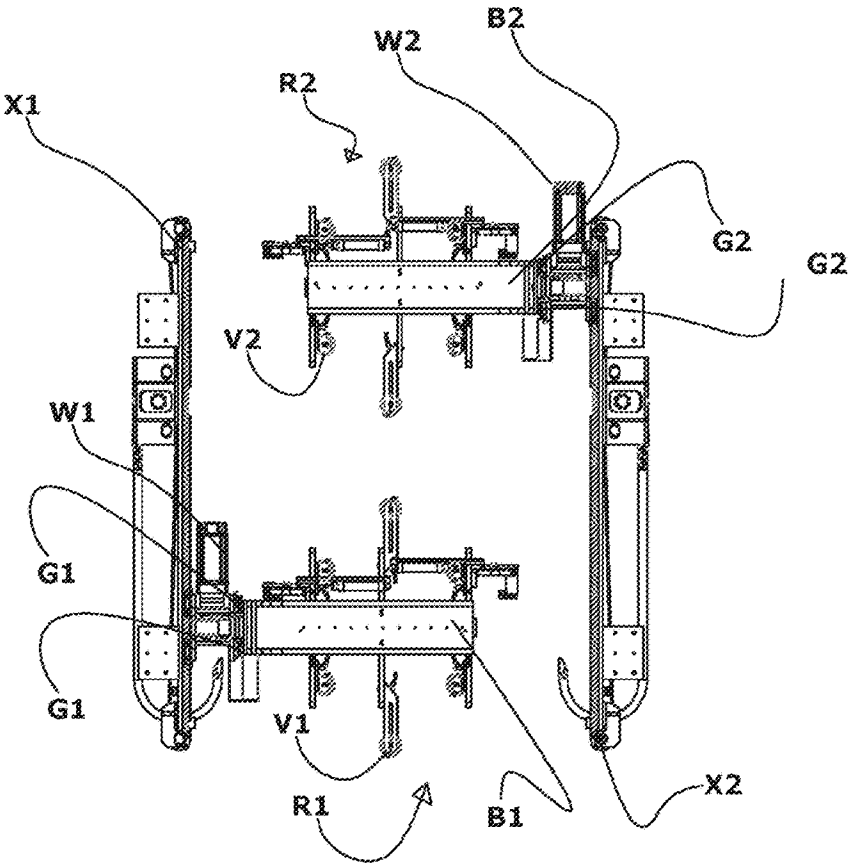
Figure 31:
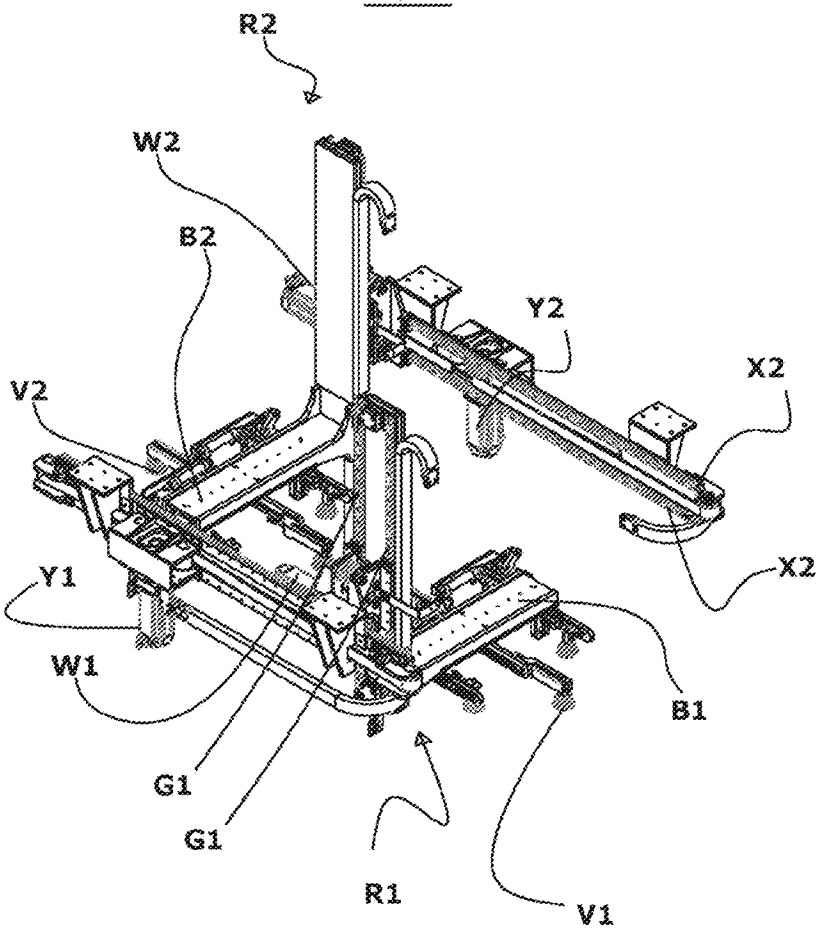
Figure 34:
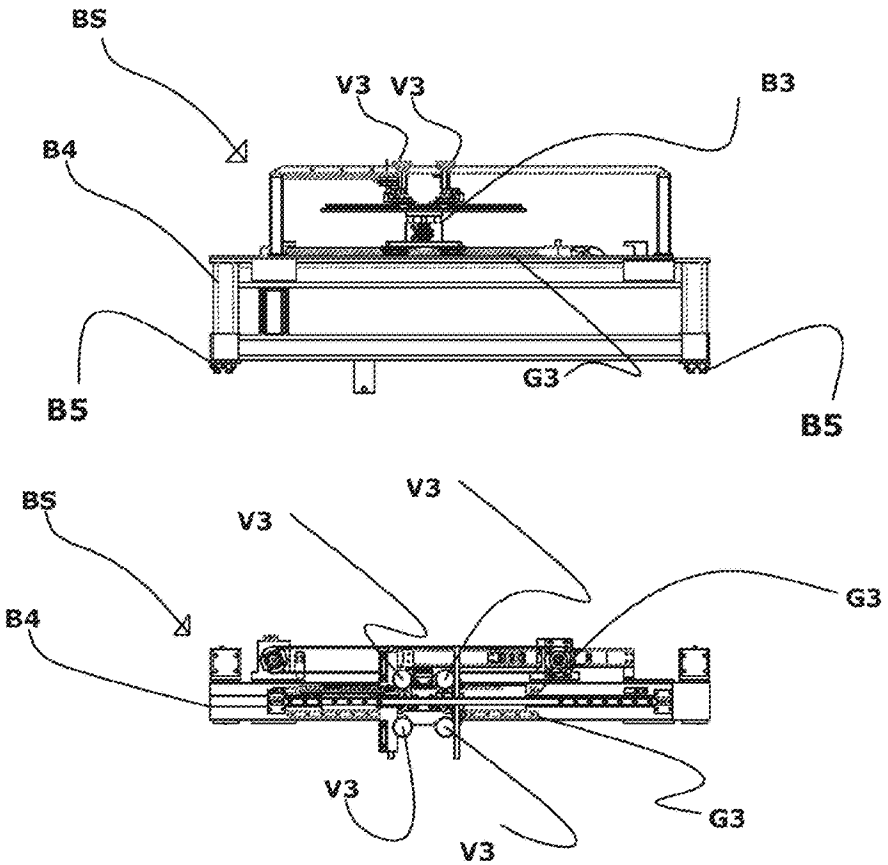
Figure 33:
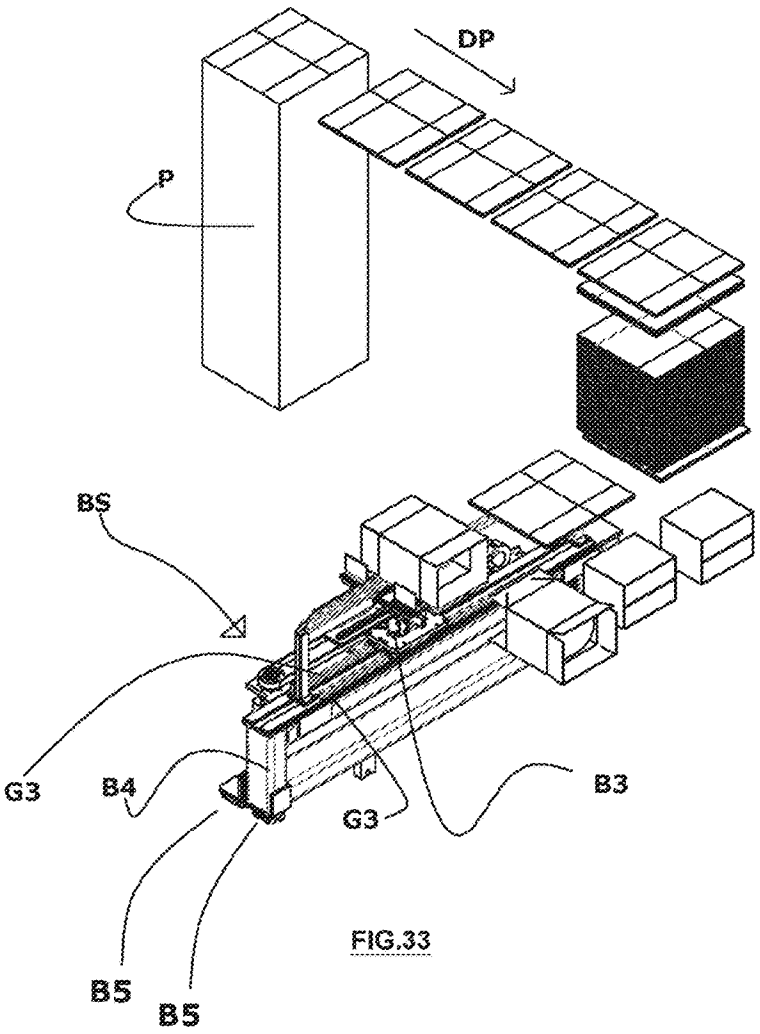
Figure 35:
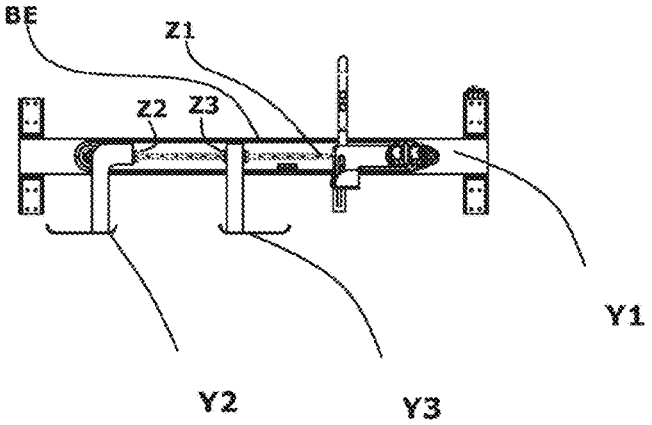
Figure 36:
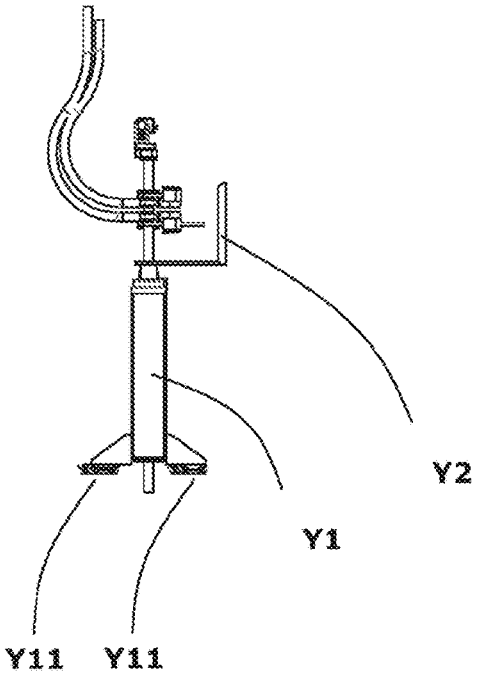
Figure 37:
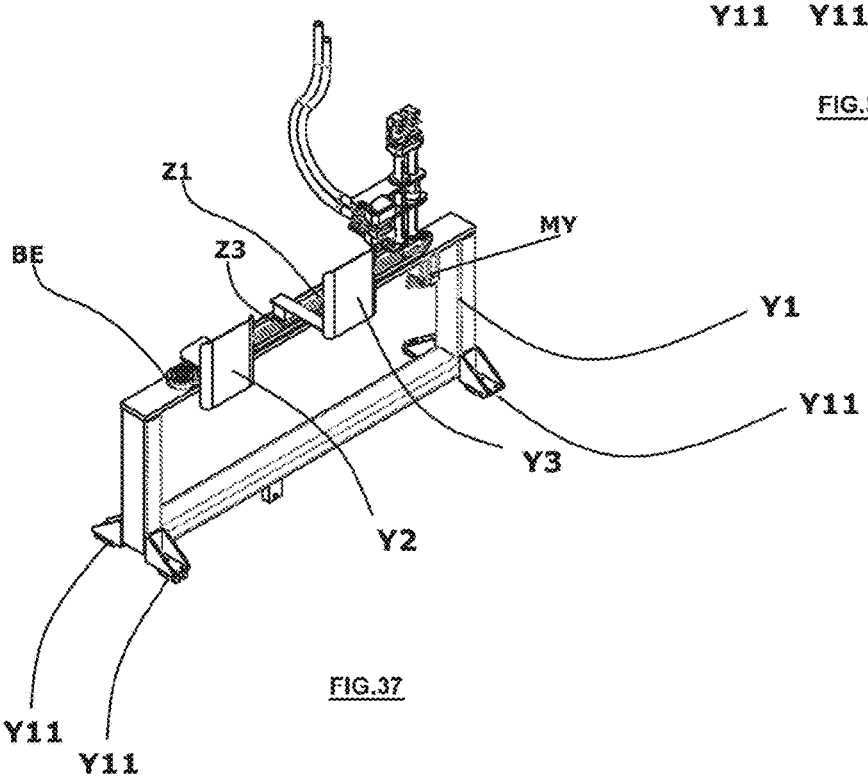
Figure 39:
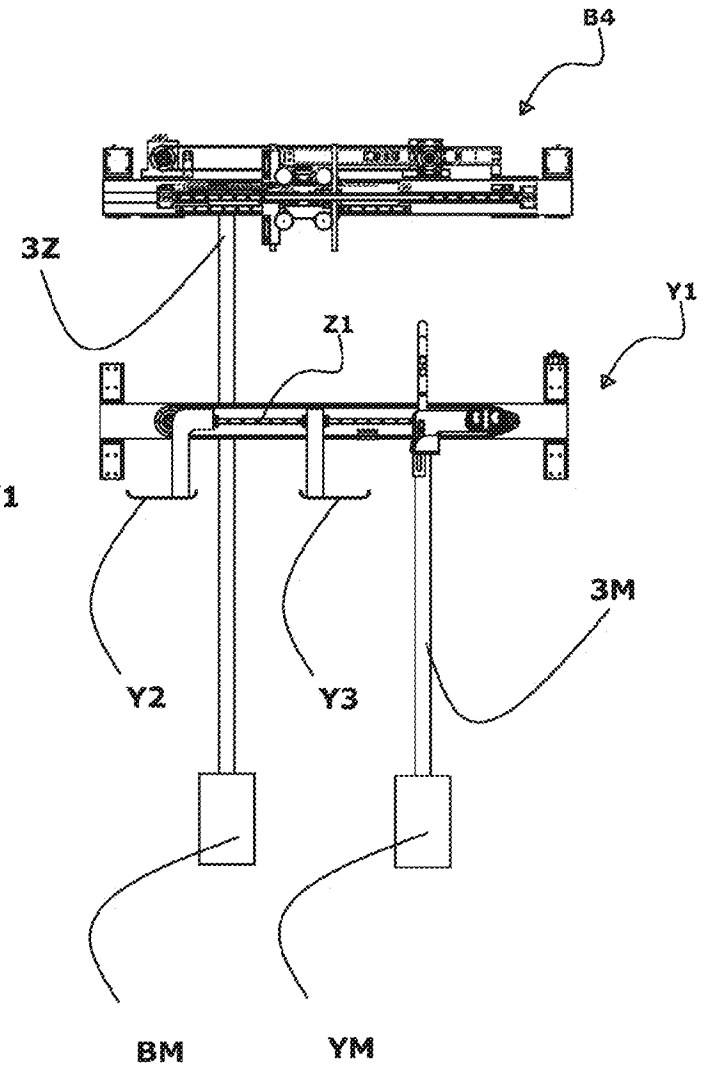
Figure 38:
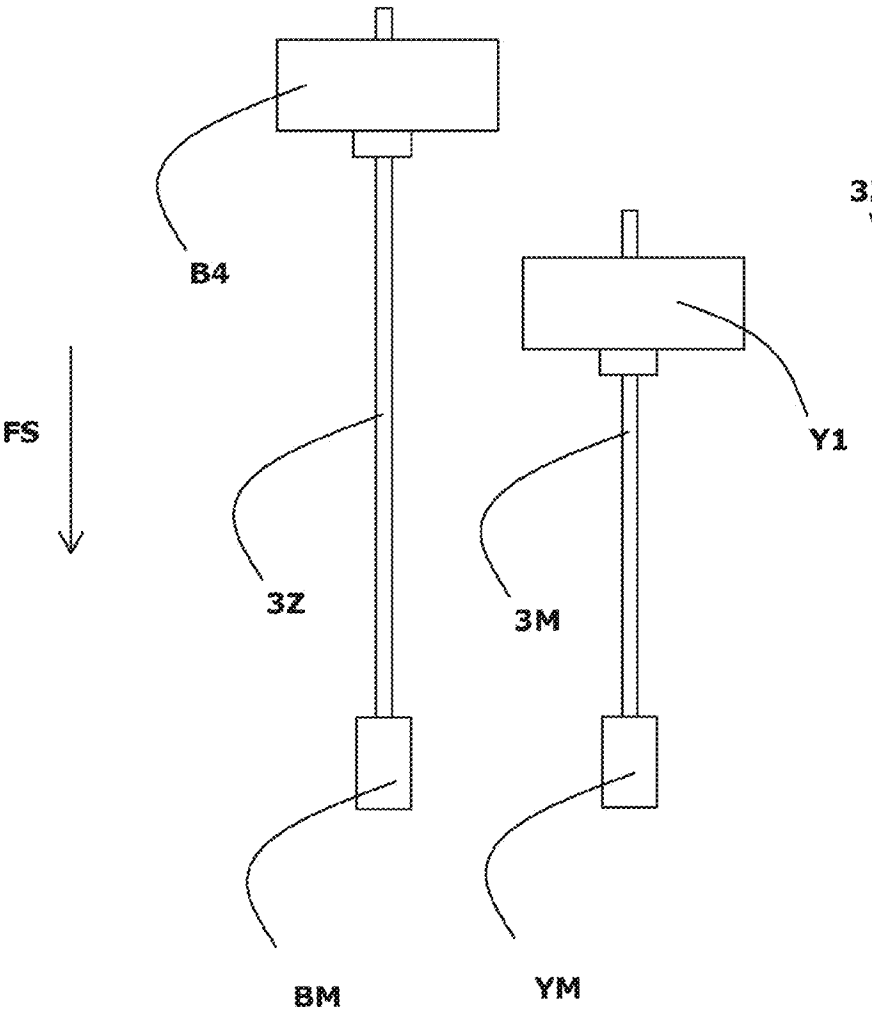
Figure 40:
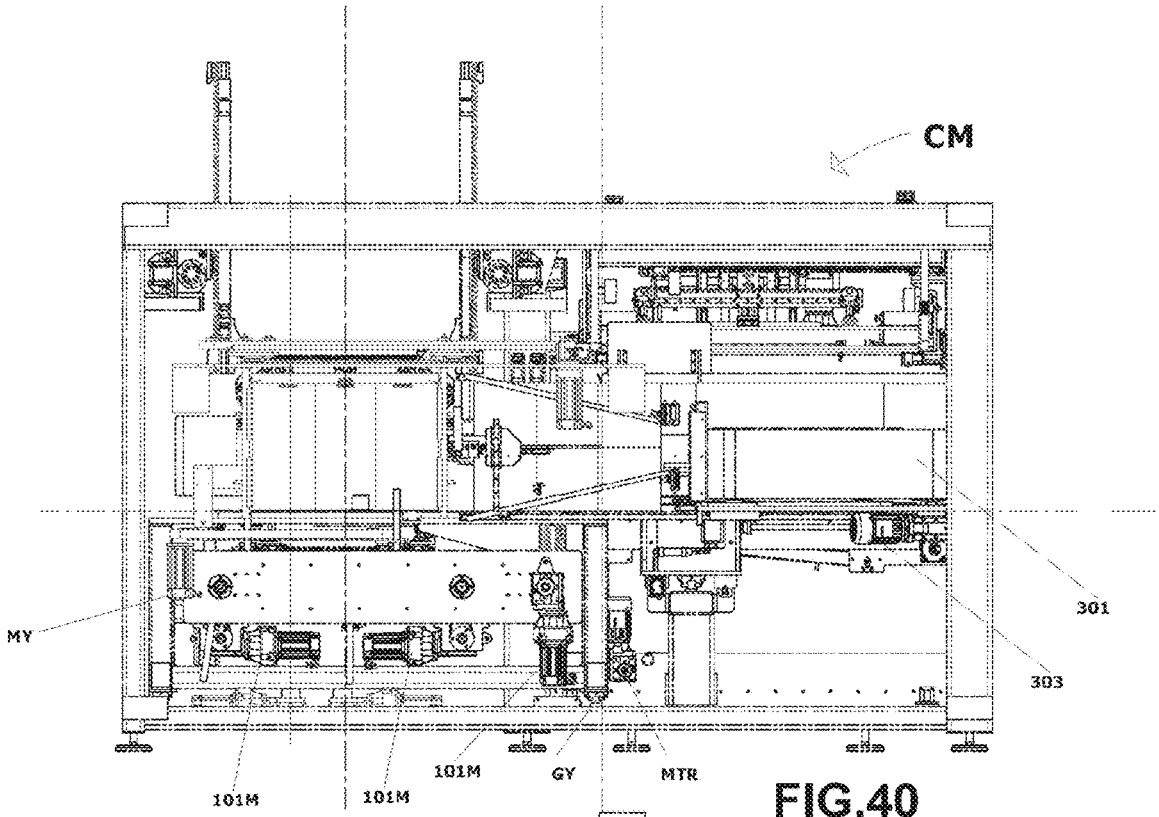
Figure 41:
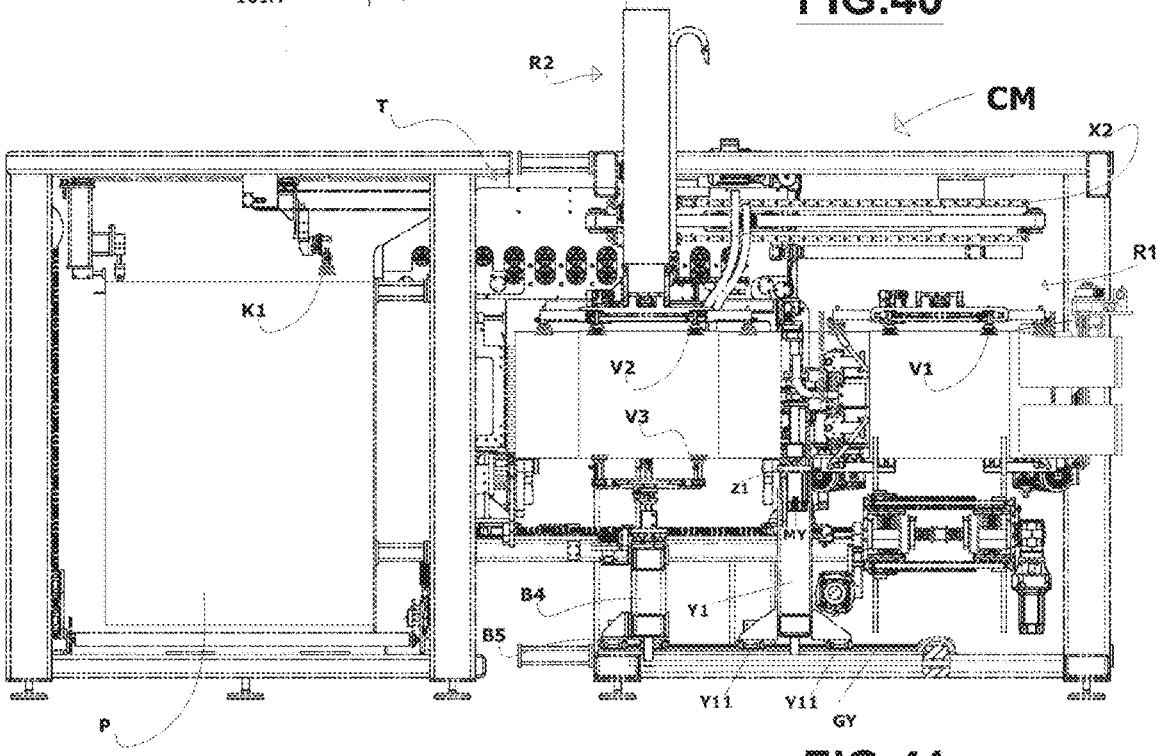
Figure 42:
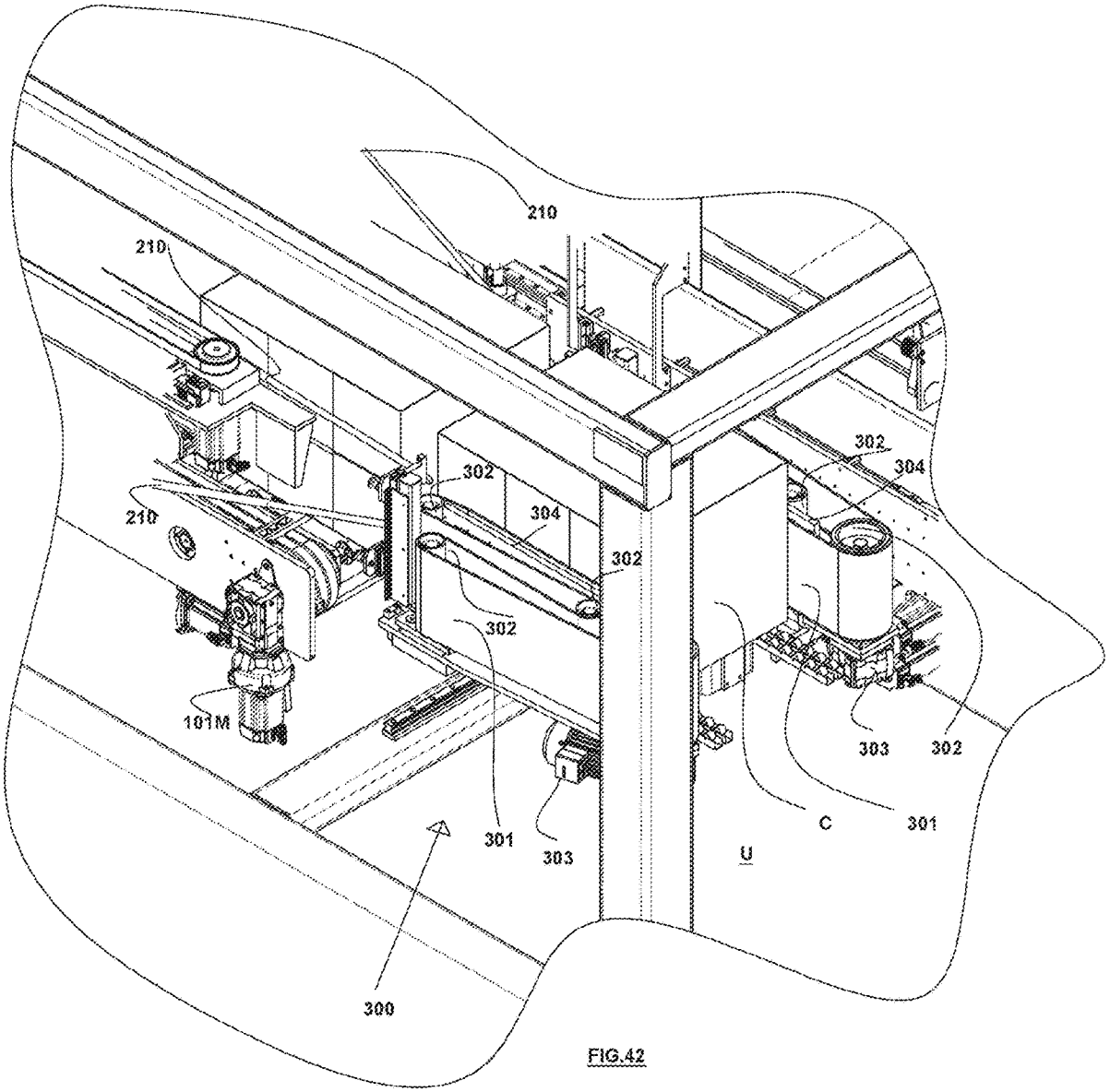
Figure 43:
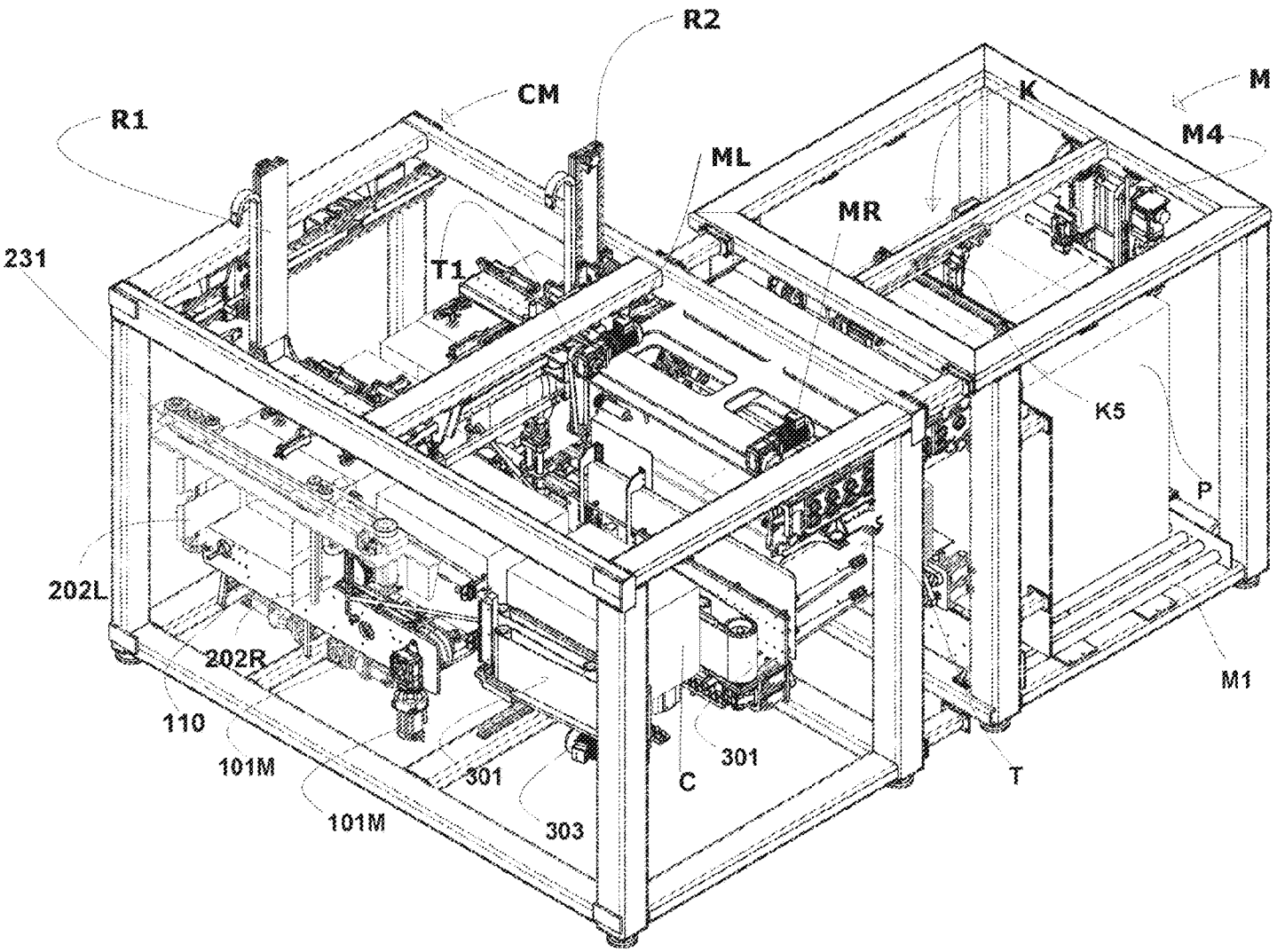
Figure 44:
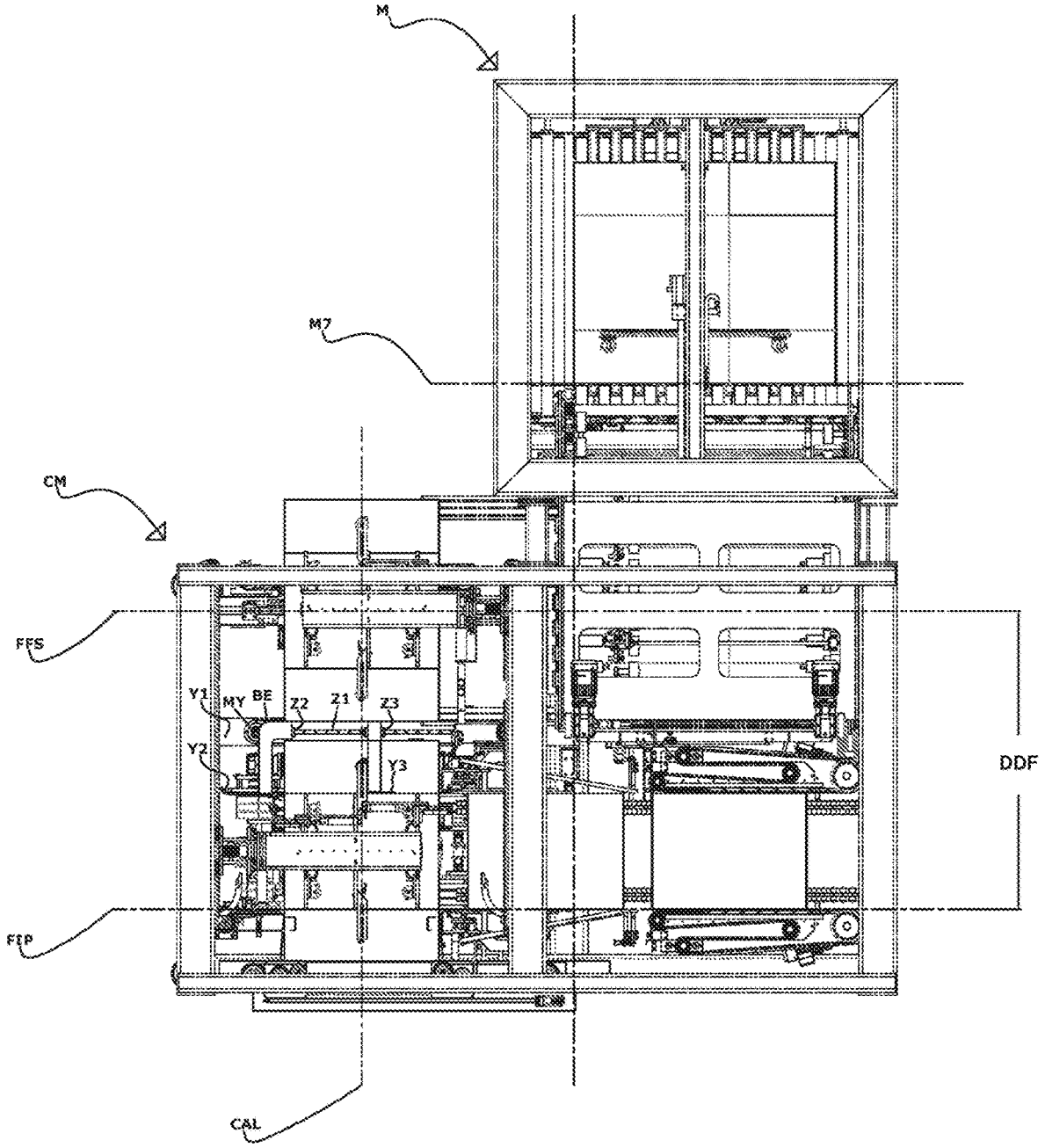
Figure 45:
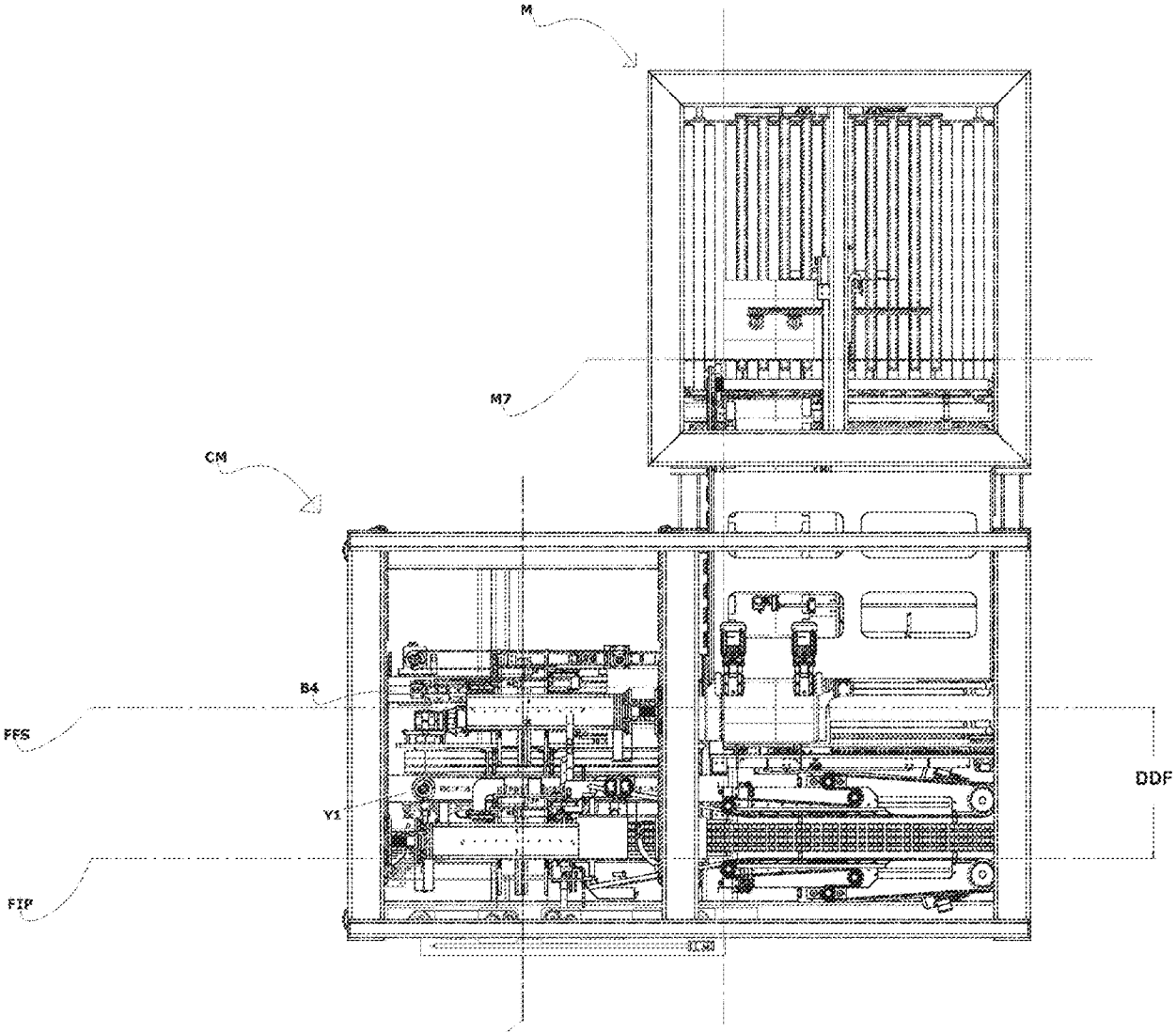
Figure 46:
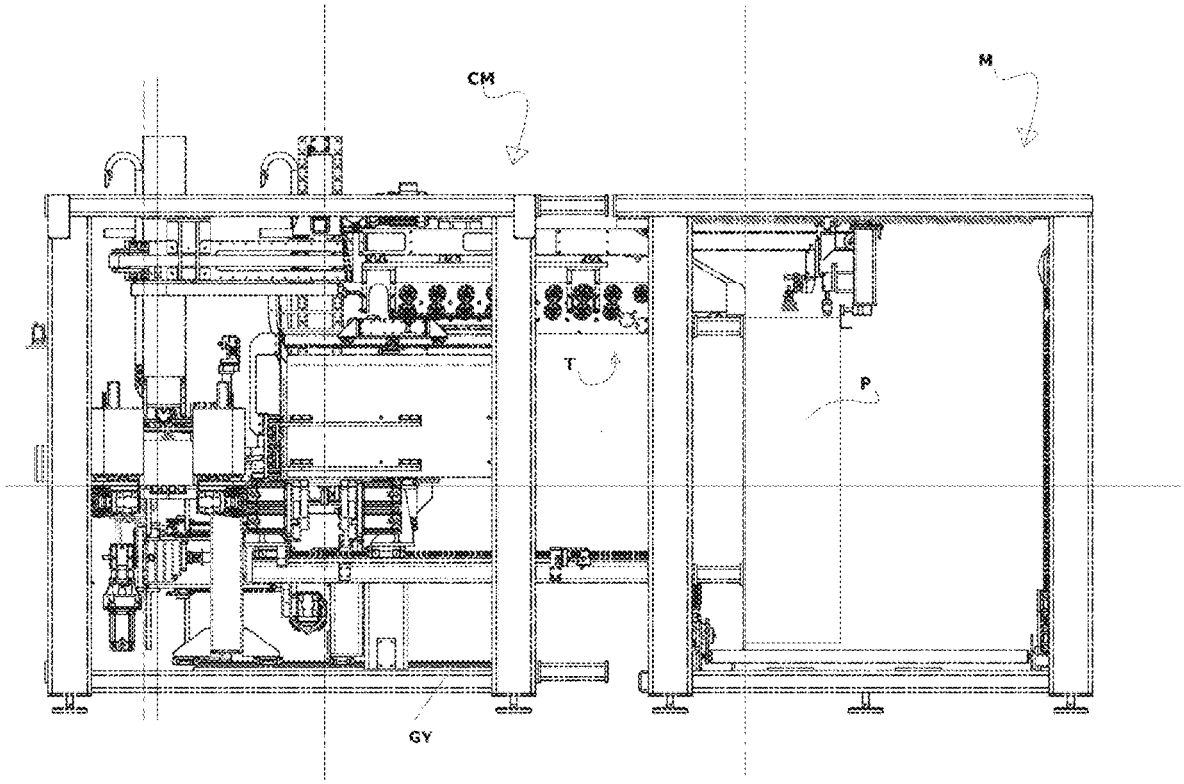
Figure 47:
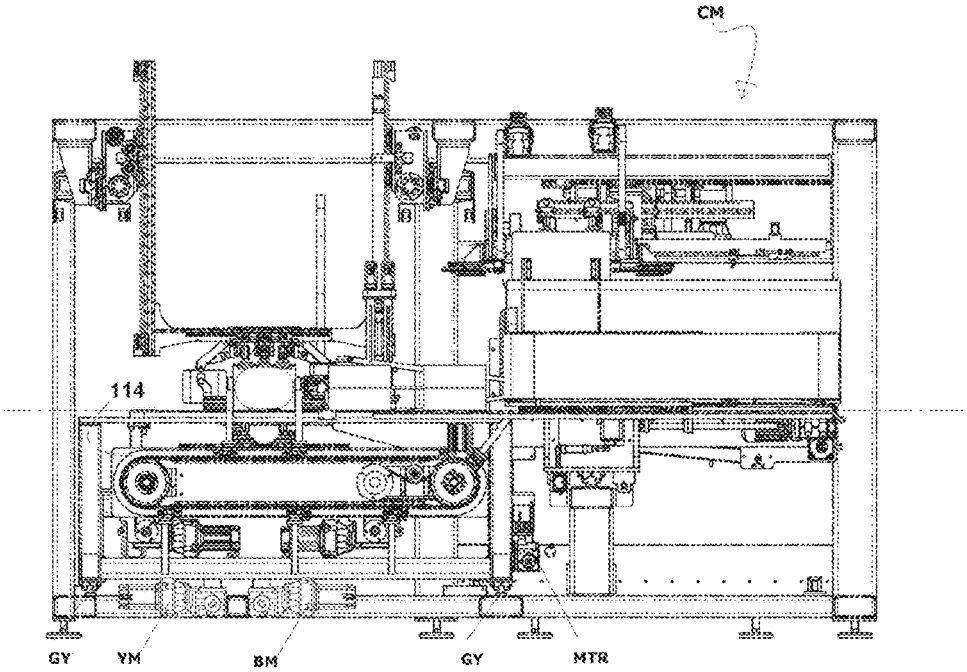
Figure 48:
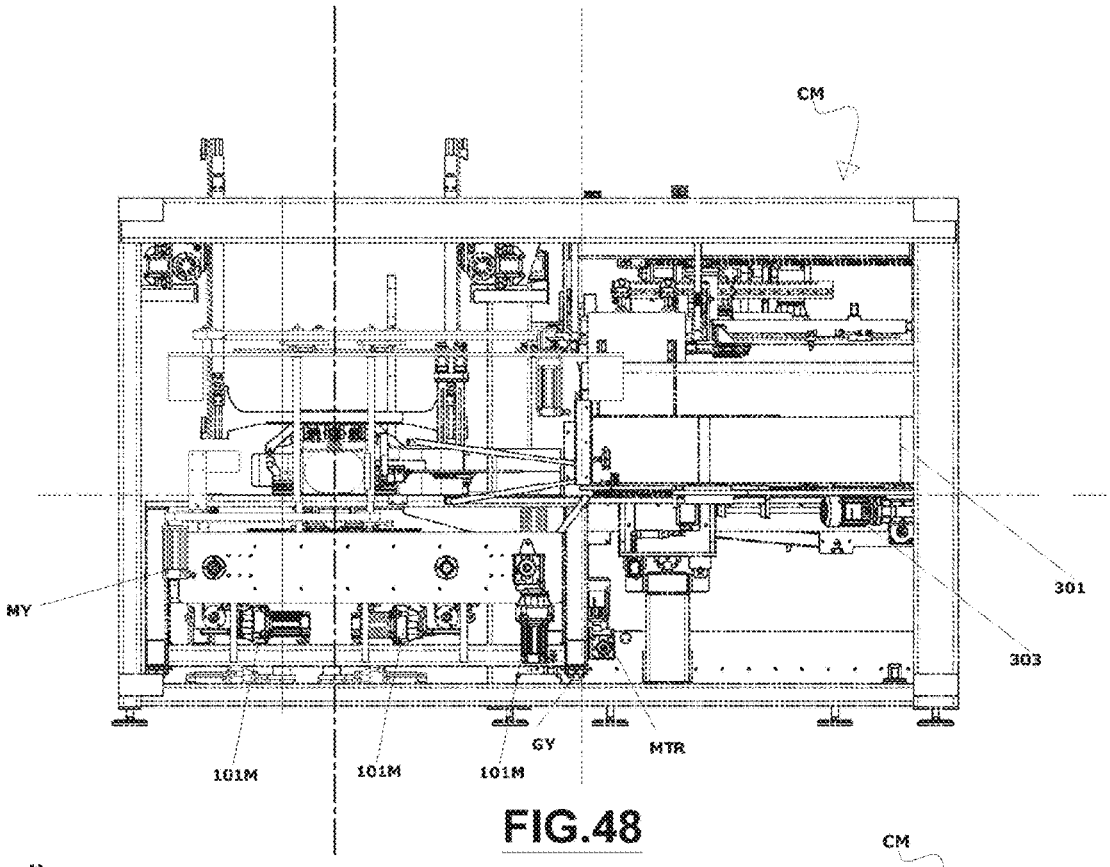
Figure 49:
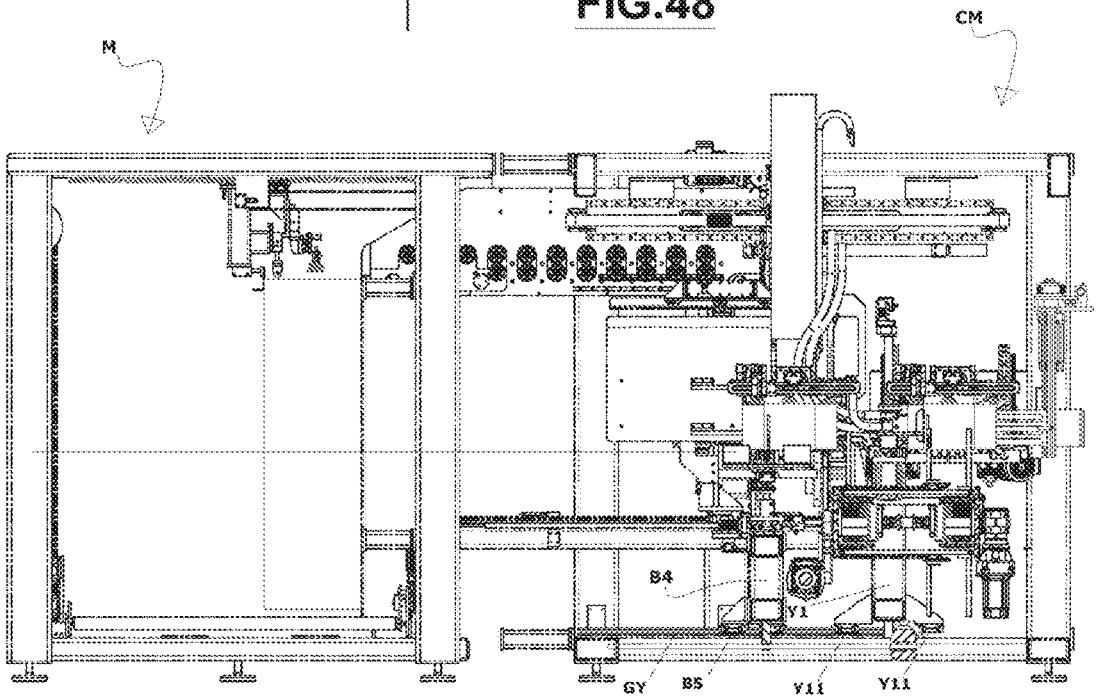
Figure 50:
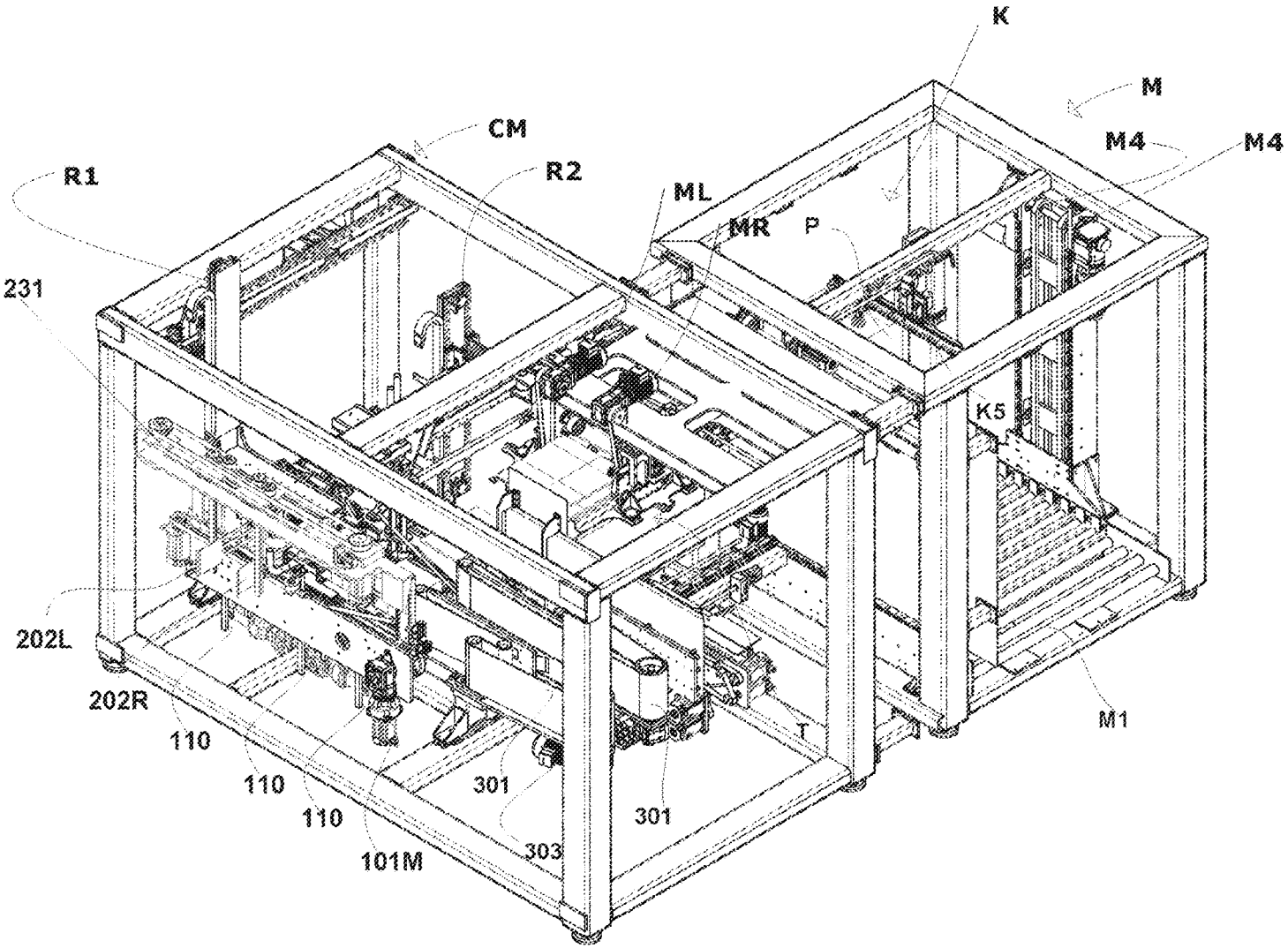
Figure 52:
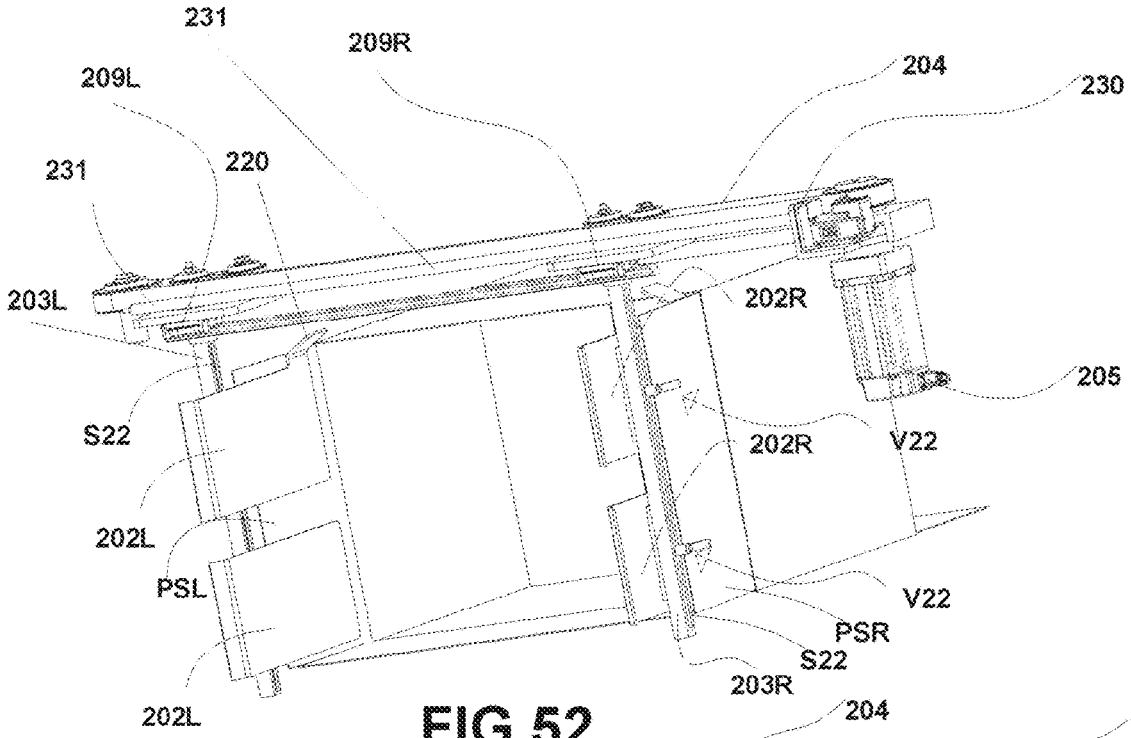
FIGS. 51-59 show a possible embodiment of a product guide system in the product insertion station in a cartoning machine in accordance with the present invention.

The conveyor (CB) comprises two lateral supports (CB1) oriented along a direction (FM) for transporting the blanks unloaded from the collection compartment (VR) and destined to reach the unfolding station(S). Two transport belts (CB2, CB3) are mounted on each lateral support (CB1), so as to form a pair of outermost belts (CB2) and a pair of innermost belts (CB3). On each of the belts (CB2, CB3) there are appendices (CB4, CB5) oriented towards the outside of the same belts, which appendages form each a pusher for the blanks unloaded from the collection compartment (VR). The lateral supports (CB1) are each integral with a respective wall (VRA, VRB) of the collection compartment (VR). This solution makes it possible to adjust the mutual distance of the supports (CB1) according to the format of the blanks while adjusting the position of the walls (VRA, VRB). Consequently, it is also possible to adjust the mutual distance between the pairs of belts mounted on the two lateral supports (CB1). The conveying belts (CB2; CB3) mounted on each lateral support (CB1) can be operated independently of each other. Therefore, the pushers (CB4, CB5) can be arranged side by side (as for example in FIG. 22 for larger format blanks) or staggered by a pre-established value (as for example in FIG. 21 for smaller format blanks) so as to always ensure a correct pushing on the blanks regardless of the format of the latter.

The blanks that reach the unfolding station are then subjected to unfolding. The unfolding can be performed with per se known methods, using unfolding means per se known to those skilled in the art. Similarly, the subsequent filling operations of the boxes obtained by unfolding the blanks and the closing operations of the filled boxes can be performed with methods known to those skilled in the art.

Preferably, in the unfolding station there are two independent upper unfolding units (R1, R2), each of which comprises a support (B1, B2) on which more pneumatic suckers (V1, V2) are mounted and which is mounted on a vertical guide element (G1, G2) to be moved vertically to and from the conveyor (CB) by means of a respective actuator (W1, W2). Each vertical guide element (G1, G2) is in turn constrained to a respective horizontal guide element (X1, X2) to be moved horizontally by means of a corresponding actuator (Y1, Y2). The horizontal guide elements (X1, X2) are arranged at a predetermined distance from each other in the unfolding station(S) and are oriented parallel to the aforementioned direction (DP), i.e. orthogonally with respect to the conveyor (CB). Each upper unfolding unit (R1, R2) is controlled in such a way as to unfold one blank, in cooperation with the lower unfolding base (BS) described below, while the other unfolding unit holds the upper side of a box (C), i.e. an unfolded blank, in the product insertion station. In practice, said upper unfolding units (R1, R2) alternate with each other in the cycle of unfolding the blanks and transporting the unfolded blanks to the product insertion station.

The lower unfolding base (BS) is a unit comprising more pneumatic suckers (V3) mounted on a support (B3) constrained to a guide element (G3) oriented parallel to the conveyor (CB) and arranged in correspondence with the outlet section of the latter. In turn, the support (B3) is mounted on an underlying base structure (B4). In the unfolding phase, each blank is engaged at the bottom by the suckers (V3) of the unfolding base (BS) and the support (B3) is moved along the guide (G3) by a respective actuator while the suckers (V1) or (V2) engage the upper side of the same blank and are lifted. This unfolding method operated in cooperation by a group of suckers (V3) acting on the lower side of the blank and a group of suckers (V1; V2) acting on the upper side of the same blank is per se known to those skilled in the art.

In the station (N) for filling the boxes (C) there is a blade conveyor (TRP), for example configured as described below, which transports the boxes (C) from the same station (N) to the exit section of the machine.

Furthermore, between the unfolding station(S) and the filling station (N) there is a mechanism for closing, or folding, the vertical flaps (PS) of the rear side of the boxes (C). For example, this closing mechanism comprises a support (Y1) which extends behind the station (N) for a predefined length along the direction (FN). Two folders (Y2, Y3) are mounted on an upper side of the support (Y1), each of which is intended for folding a respective flap (PS). Said folders (Y2, Y3) are mounted on corresponding independent carriages sliding, in opposite directions, along a guide formed on the upper side of the support (Y1). In practice, while one folder (Y2) moves towards the exit of the machine, the other folder (Y3) moves in the opposite direction and vice versa. With reference to the drawings, the folder (Y2) is intended to close, or fold, the vertical flap (PS) of the box (C) which in station (N) is more distant from the exit section, while the folder (Y3) is intended to close, or fold, the vertical flap (PS) of the box (C) which in the same station (N) is closest to the exit section of the machine. When a box (C) reaches the station (N), in phase with the insertion of the products into the box, the first folder (Y2) moves towards the exit (U) thus folding the respective flap (PS) by about 90° and is stopped in the folding position. Always in phase with the insertion of the products into the box, the other folder (Y2) moves towards the first one (Y1) causing the fold of about 90° of the other vertical flap (PS). The folders (Y2, Y3) are also elements which temporarily keep the flaps (PS) locked in the folded position during the insertion of the products into the box (C). The folders (Y2, Y3) are driven by a motor (MY) by means of a belt (BE) and are provided with pads (Z2, Z3) sliding on a guide (Z1) formed on the upper side of the support (Y1).

Figure 7:
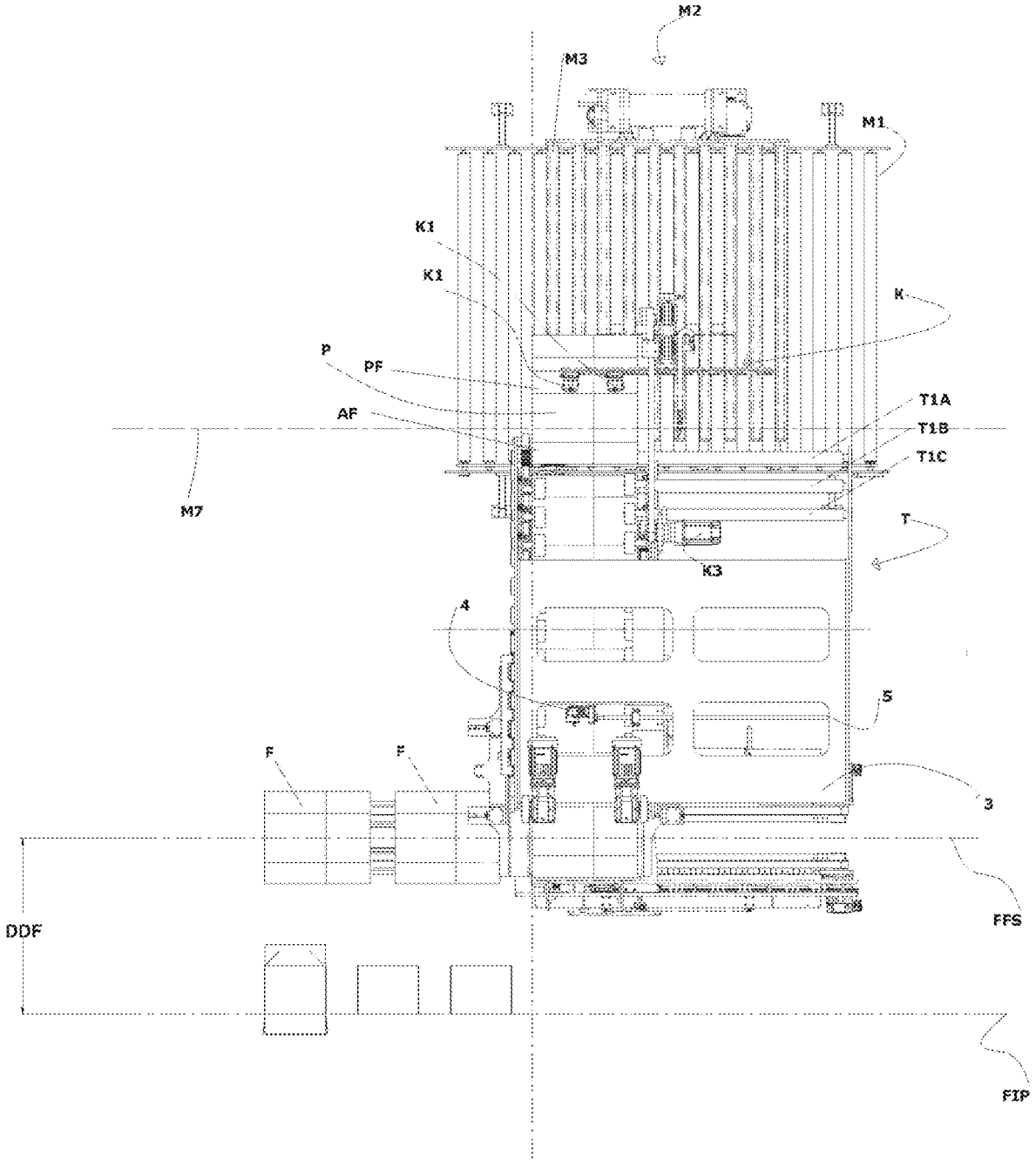
Figure 8:
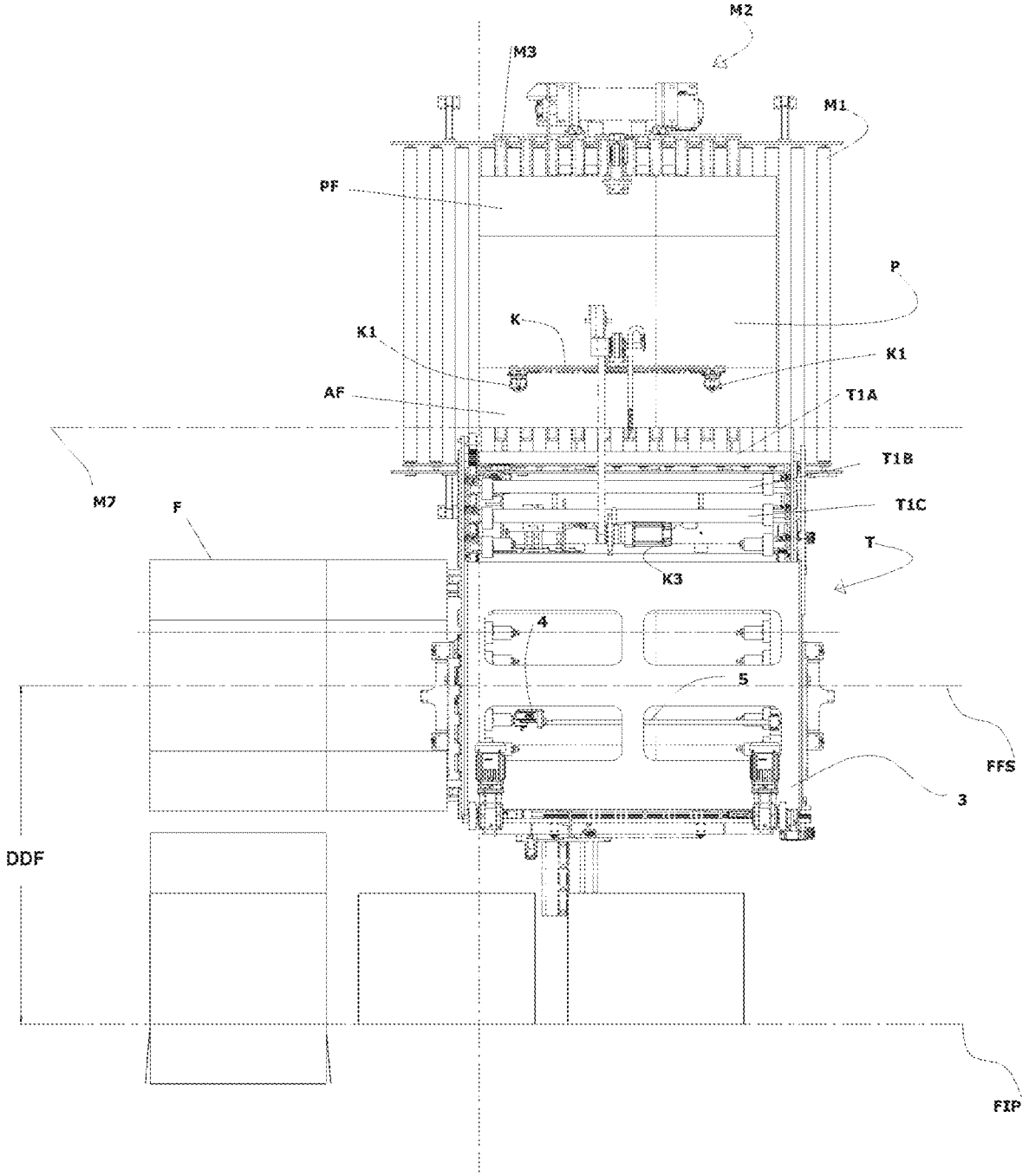
Figure 9:
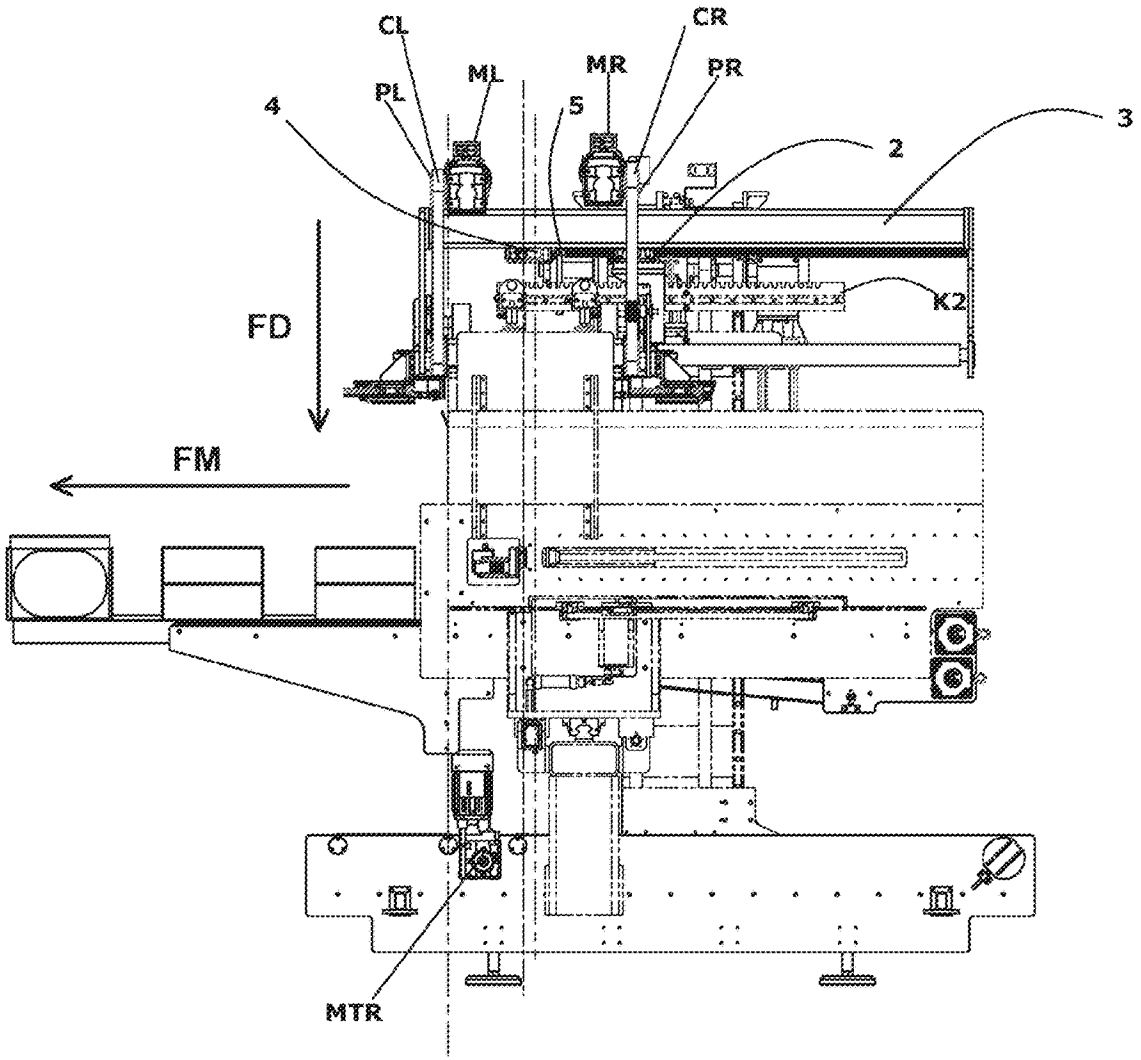
Figure 10:
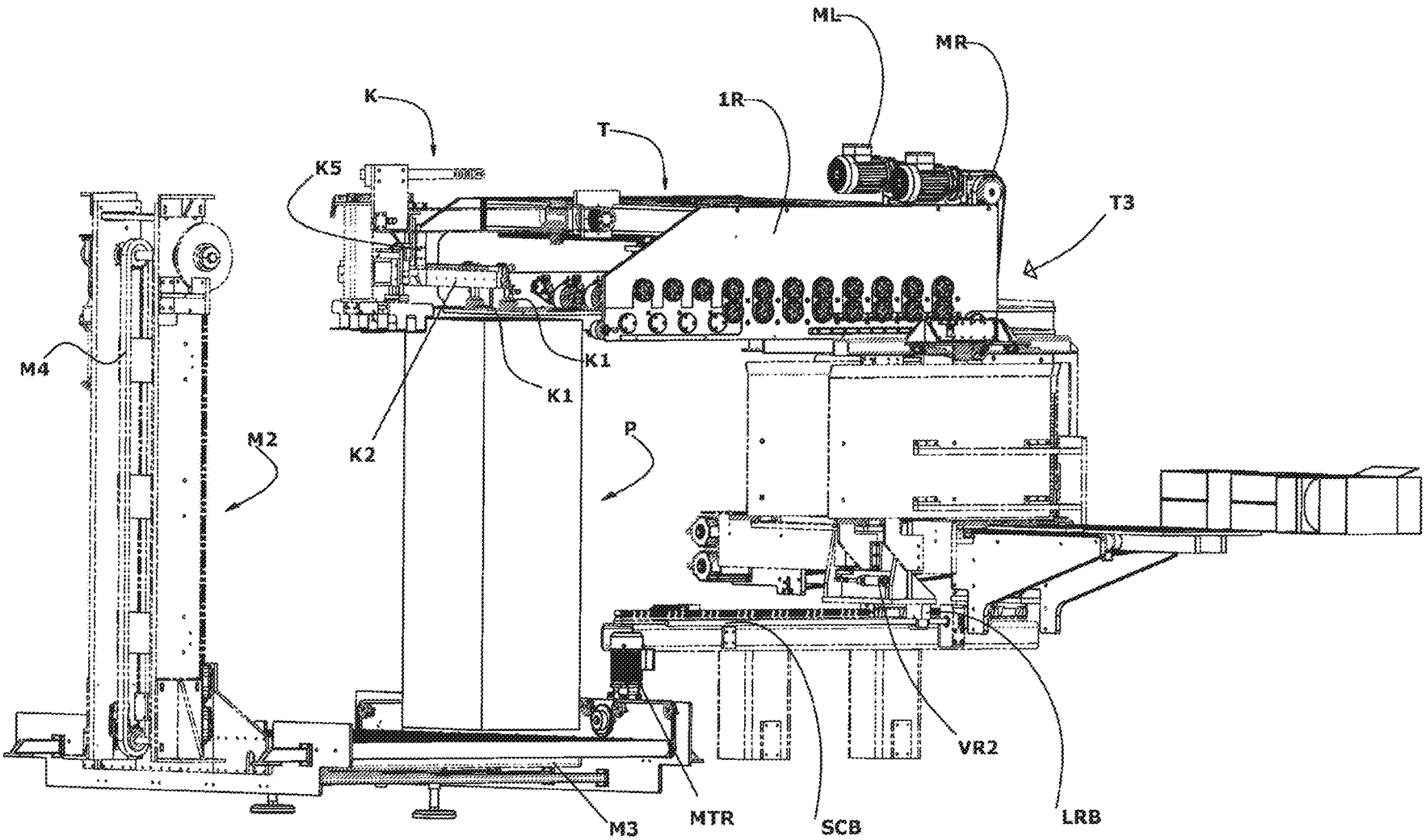

Preferably, the base structure (B4) of the unfolding base and/or the support (Y1) of the aforementioned folding mechanism are slidably mounted along the direction (FS) in such a way that the position of the structure (B4) and/or the position of the support (Y1) can be adjusted, along the direction (FS), to optimize their distance from the arrival point of the products according to the format of the blanks. Preferably, both the structure (B4) and the support (Y1) are mounted sliding along the direction (FS). For example, on the lower side of the structure (B4) and of the support (Y1) there can be provided respective pads (B5; Y11) sliding on guides (GY) oriented along the direction (FS). Said adjustment can be controlled by means of corresponding actuators (BM, YM) through respective actuation screws (3Z, 3M) which engage the lower sides of the structure (B4) and of the support (Y1). As can be seen in FIG. 7 and FIG. 8, the distance (DDF) between the planes (FFS) and (FIP) is adjusted according to the format of the blanks.

As previously mentioned, the boxes (C) are filled in the filling station (N) which, in the operating path followed by the blanks (F) and therefore by the boxes (C), is located downstream of the unfolding station(S).

In practice, in the filling station (N) the blank (F) arrives already unfolded in the form of a box (C) which is in an open configuration, i.e. in a configuration suitable for receiving the products (RC).

In the filling station there is a pusher element (SP) which pushes the products (RC) inside a waiting box (C).

In the configuration shown in the drawings, the box (C) is placed such that its opening delimited by the four flaps which are formed by the appendices of the upper, lower and lateral bases on the front side of the box face the pusher (SP). In practice, the opening of the box (C) intended for the passage for introducing the products (RC) has an upper flap formed by the appendix (PU), a lower flap formed by the appendix (PL), a left side flap formed by the appendix (PSL) and a right side flap formed by the appendix (PSR).

In accordance with the embodiment exemplified in the attached drawings, at least two guide blades (202L, 202R) are provided for the introduction of the products (RC). In the example of FIGS. 52-55 the blades are four in number, two on the right side of the insertion station and two on the left side. The left side of the insertion station (N) is the side most distant from the exit (U).

The blades (202L, 202R) are formed by bodies with a substantially laminar shape mounted on shafts (203L, 203R) with a vertical axis, which are connected via a belt transmission (204) to at least one respective motor (205) to be rotated as further described below. Depending on the activation of the motor (205), the blades (202L, 202R) can be arranged in an "open" configuration (visible in FIGS. 53 and 55) in which they allow the passage and guidance of the products (RC) towards the inside of the box (C) and in a "closed" configuration (visible in FIG. 54), in which they are rotated by about 90° with respect to the open configuration and consequently "close" the passage towards the box (C). Preferably, said blades (202L, 202R) are mounted on the respective shafts (203L, 203R) by means of screw fastening members (V22) which allow their position to be adjusted along the shafts themselves. Preferably, to facilitate the assembly and adjustment of the position of the blades (202L, 202R) along the shafts (203L, 203R), the latter have a square or rectangular cross section and have longitudinal grooves (S22) on their internal side (side where the blades are mounted) and external side (side opposite to the side where the blades are mounted).

The shafts (203L, 203R) are supported by corresponding plates (209L, 209R) connected to a screw transmission member (231) on which a corresponding motor (230) acts. The activation of the motor (230) determines the rotation in one direction or the other of the screw transmission member (231) to which the plates (209L, 209R) are engaged: this determines the possibility of varying the distance between the same shafts (203L, 203R) according to the size of the box (C) to be filled. In practice, the gap defined between the two shafts (203L, 203R) can be changed according to the operational needs of the cartoning machine.

The filling station (N) also comprises a folding device (206) and a gluing device (207) which are placed respectively to the left and to the right in the example shown in the drawings with respect to the insertion station (N).

The folding device (206) comprises a motor (206M) which is connected to and acts on an inverted "L" shaped bracket (206S), to move the same bracket along a direction parallel to that of advancement of the box, indicated by the arrow (FN). In particular, the bracket (206S) can be moved along the forward direction (FN) (from left to right in the drawings) following the movement of the left side flap (PSL) to keep it closed, i.e. adhering to the rest of the box (C). Said bracket (206S) moves along the direction (FN) in a space between said flaps and the front side of the box (C) in the insertion station (N). It goes without saying that the folding device cyclically first moves along the direction (FN) to perform the aforementioned operation and then in the opposite direction to return to its initial position (position of non-interference with the insertion of the products RC).

When the pusher (SP) pushes the products (RC) towards the box (C) the blades (202L, 202R) are in the open position and provide corresponding vertical guide planes to facilitate the entry of the products (RC) into the box (C).

After the products (RC) have been introduced into the box (C), the same box is moved downstream, i.e. towards the exit (U). At the same time, the downstream movement determines the interaction of the advancing flap with the gluing device (207) for the release of the glue for the subsequent closure of the box (C).

When moving downstream, the box (C) is followed by the folding device (206) which keeps the left vertical flap (PSL) close to the same box (C). When, in the downstream movement of the box (C), the folding device (206) is no longer in contact with the left vertical flap (PSL), the latter begins to engage the right blade (202R), which continues in the push action on the flap to keep the latter pushed towards the inside of the box (C). Therefore, the blades (202L, 202R) of the filling station (N) are shaped, sized and motorized, so as to perform two functions: the guidance of the products (RC) in the operation of insertion into the box (C) and the containment of the left vertical flap (PSL) avoiding its reopening during the translation towards the exit (U). In fact, the run of the bracket (206S) does not extend along the entire width of the box, such that the same bracket (206S) could not carry out a containment action on the flap (PSL) once the latter has passed the end-of-run point of the bracket (206S).

In practice, the blades (202L, 202R) are connected to respective movement means which control their positioning in an opening position, in which the belts define guide surfaces for the products (RC) during their insertion into the boxes (C) engaging the inner faces of two of said flaps (PSL, PSR) of each box (C), and respectively in a disengagement closure arrangement of the inner faces of said flaps (PSL, PSR). Said blades moving means control the positioning of the latter such that, after the products have been inserted into the box, the blades are placed in the closed position and subsequently, while the box is being moved towards the exit (U), the blades are again arranged in the open position for a predetermined time thus forming a surface which maintains a flap (PSL) folded towards the inside of the box. It is understood that in this last phase the opening of the flaps (202L, 202R) can also be partial, i.e. not complete as occurs in the phase of inserting the products, since a partial opening of the flaps may be sufficient to keep the flap (PSL) folded towards the inside of the box.

At least one (202R) of said blades (202L, 202R) can be provided with an appendix (220) intended to engage an upper flap (PU) when the box (C) is moved downstream. The closure of the box (C) is substantially completed also thanks to the intervention of fixed folding elements (210), also called "helices", which are arranged and shaped in such a way as to define guides which, when intercepted by the upper (PU) and lower (PL) flaps in the downstream motion of the box, determine its complete closure with their gluing to the flaps (PSL, PSR) which have received the glue on their outer face by the gluing device (207).

Figure 51:
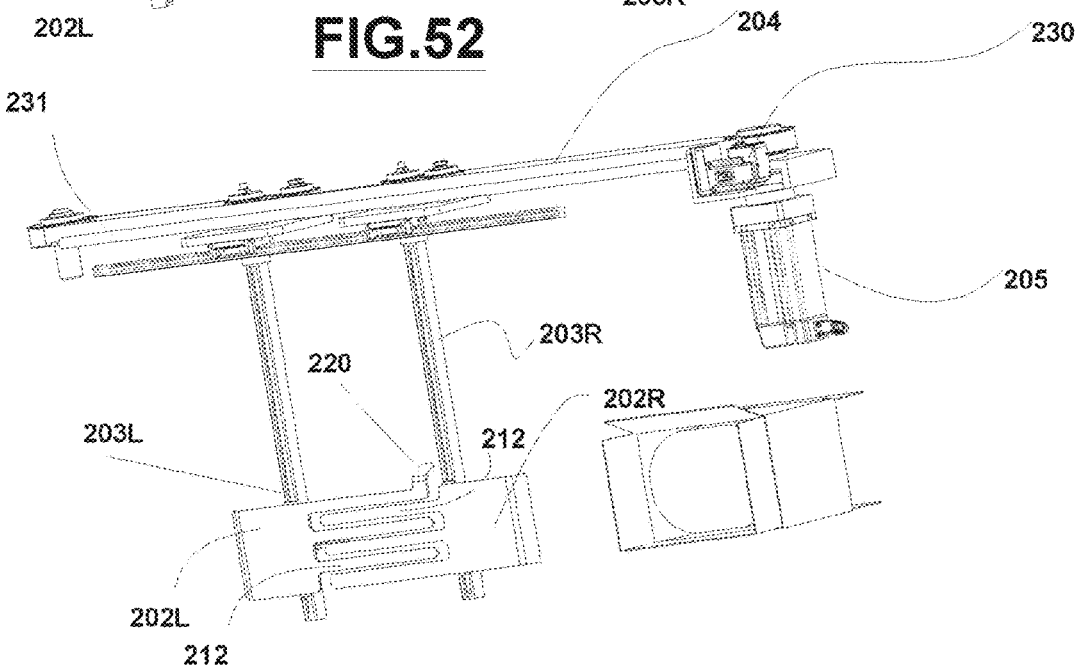
Figure 53:
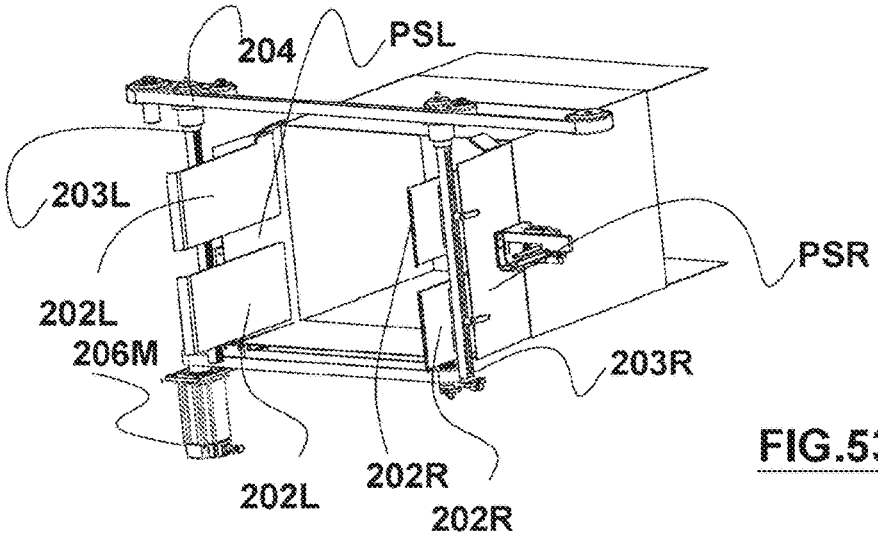
Figure 54:
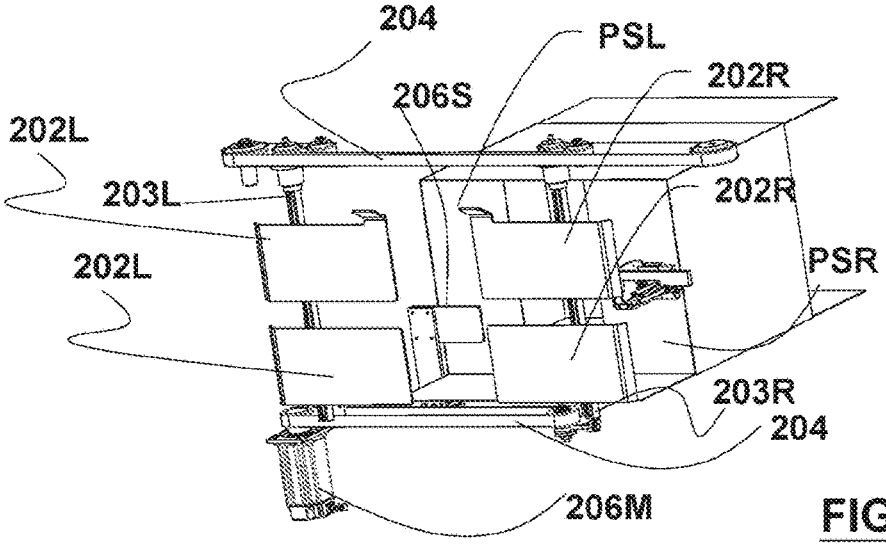
Figure 55:
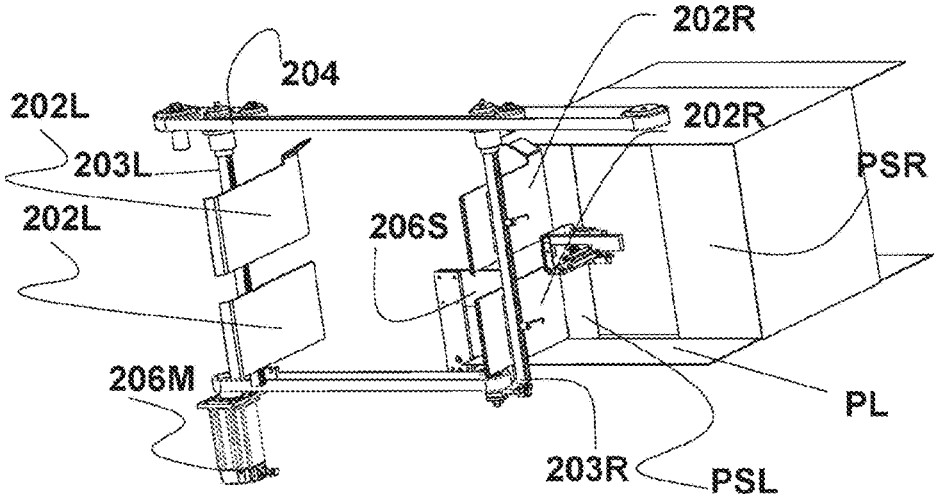
Figure 56:
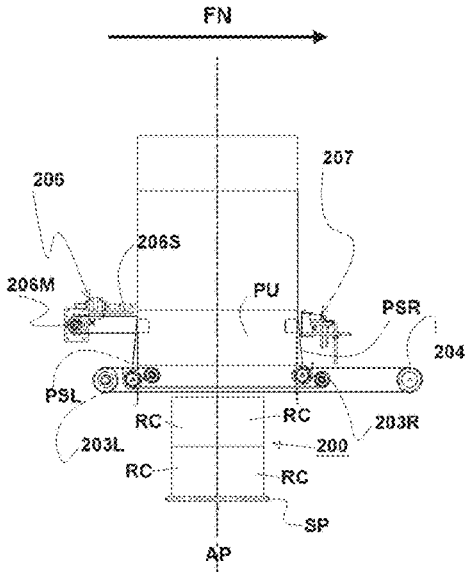
Figure 57:
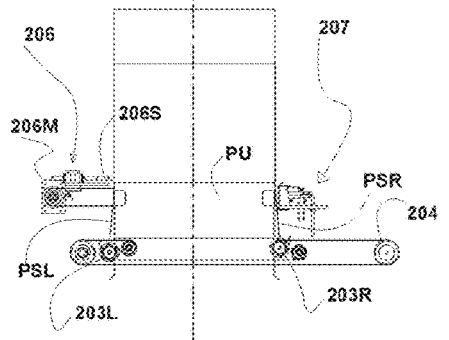
Figure 58:
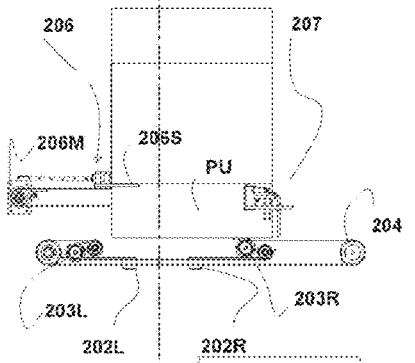
Figure 59:
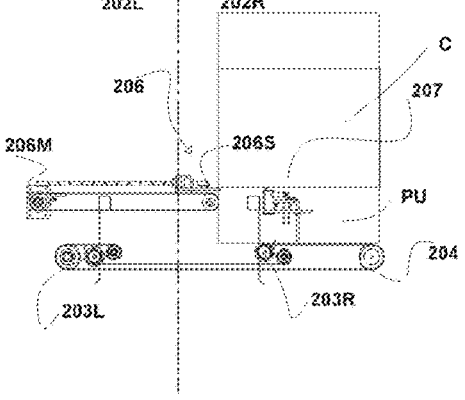
Figure 60:
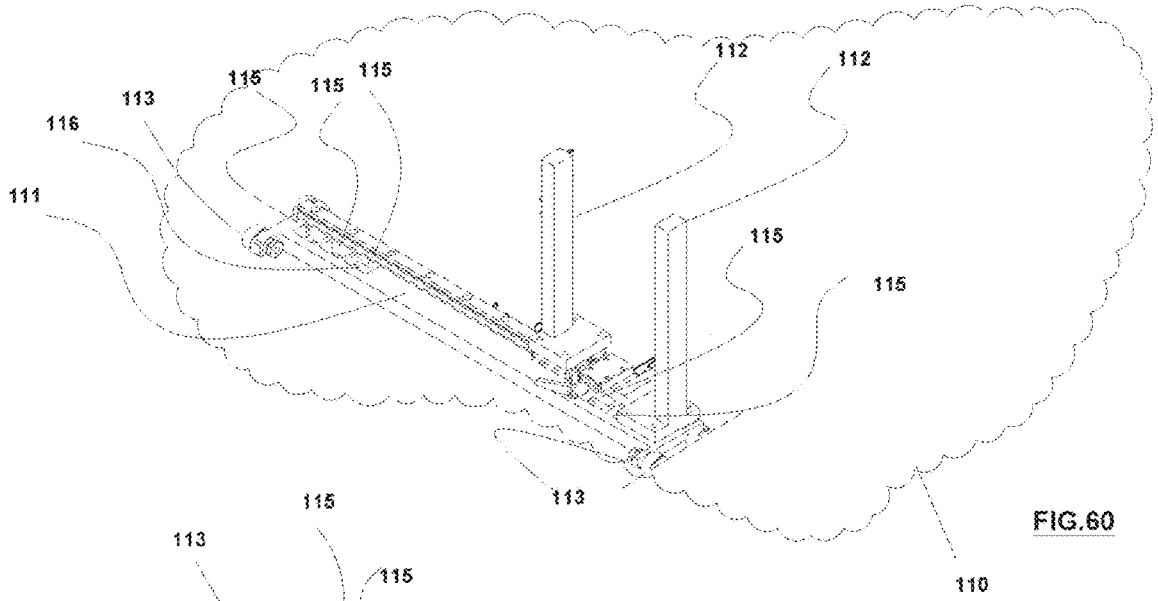
FIGS. 60-72 show a possible embodiment of a system for handling the boxes between the product insertion station and the output station in a cartoning machine in accordance with the present invention.
Figure 61:
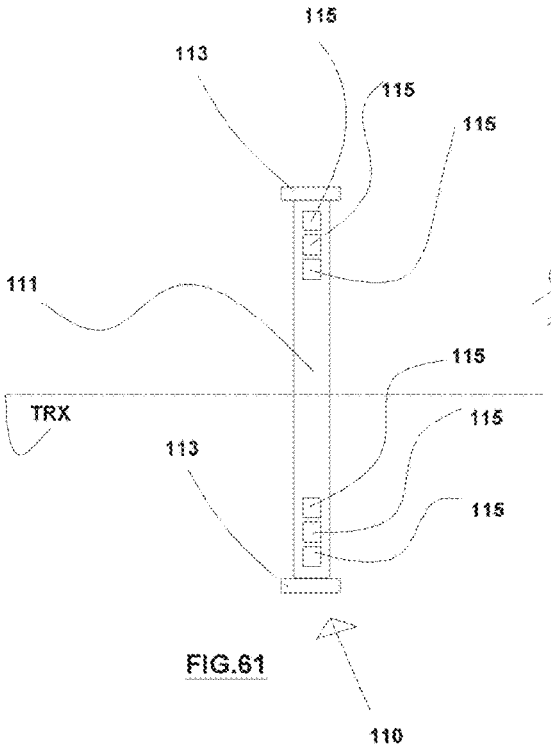
Figure 62:
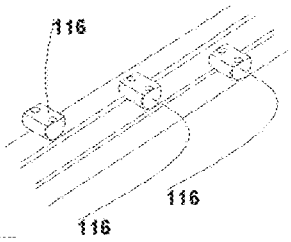
Figure 63:
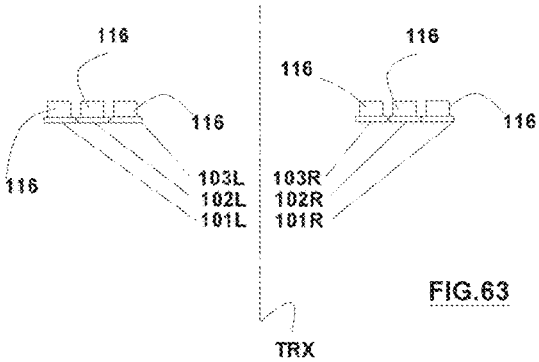

The blades (202L, 202R) can be removed from the shafts (203L, 203R) to allow their replacement. In the case of small format boxes, the blades, whose mutual distance can be adjusted as indicated above, can have their internal edges (212) discontinuous and differentiated between the left (202L) and the right (202R) blade to allow the overlapping of the blades with mutual interpenetration of the respective internal edges (212). In this way it is possible to arrange the blades (202L, 202R) in the "closed" configuration even when the sum of their lengths is greater than the gap between the two shafts (203L, 203R) that support them. FIG. 51 shows such a configuration of the blades (202L, 202R).

Between the filling station (N) of the boxes (C) and the outlet section (U) a paddle conveyor device (TRP) is arranged and acting.

As will be better described below, for example, the paddle conveyor device (TRP) is provided with a plurality of blades (two sets of three pairs in the example) which begin to engage a box (C) being filled in the station (N) to transport it downstream to the outlet conveyor.

The paddles (110) can be arranged in pairs to engage a corresponding edge of the box in two points (as in the illustrated examples) or they can be single to engage the box at its centerline.

The paddles (110), as will be better described hereinafter, can be connected and moved by movement members controlled independently of each other.

Figure 64:
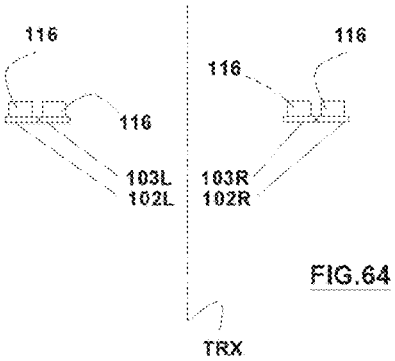
Figure 65:
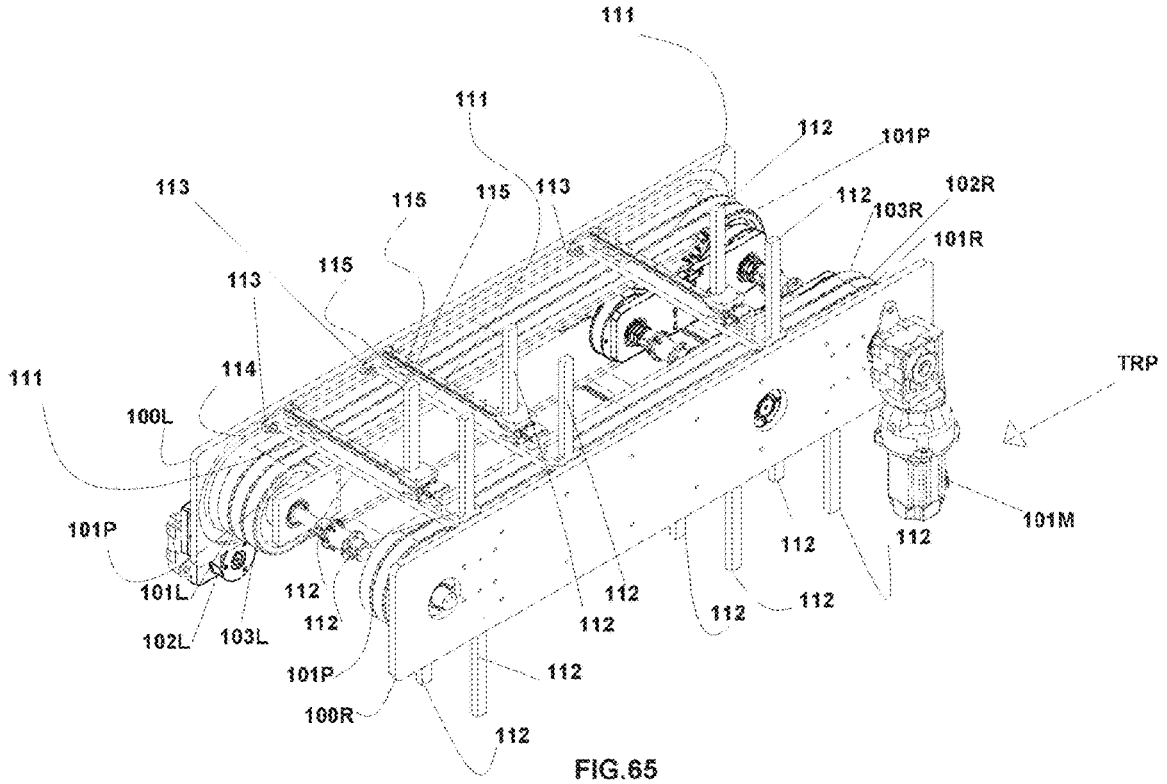
Figure 66:
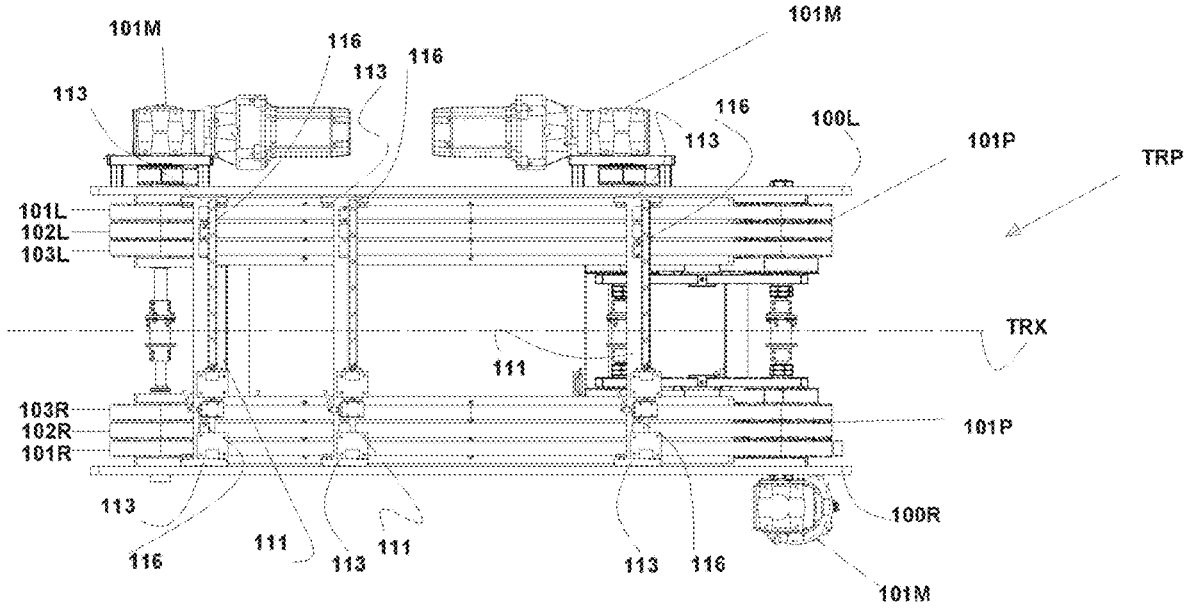

In an embodiment illustrated in the drawings, the conveyor device (TRP) comprises three pairs of motorized belts which move corresponding pairs of paddles (110) which are fixed and integral in motion with the respective belts. FIG. 64 only shows an embodiment in which the paddle conveyor device (TRP) is provided with only two pairs of belts.

In particular, with reference to the example illustrated in FIGS. 65-70, the conveyor device (TRP) comprises a left side (100L) and a right side (100R) inside which, in a symmetrical position with respect to a center line (TRX), the three pairs of belts are placed (101L, 101R), (102L, 102R) and (103L, 103R), which are moved around respective pulleys (101P) with a horizontal axis by means of corresponding motors (101M) that can be operated independently for each pair of belts. In practice, the belts (101-103) are moved along an annular path which has its upper side disposed horizontally along the direction followed by the boxes (C) as they advance towards the outlet section (U).

A first pair of belts (101L, 101R), or pair of external belts, is arranged externally, i.e. with one belt (101L) near the left side (100L) and the other belt (101R) near the right side (100R); a second pair of belts (103L, 103R), or pair of internal belts, is arranged internally with respect to the first pair of belts (101L, 101R), on both sides of the center line (TRX); the belts (102L, 102R) of the third pair of belts, or middle belts, are placed in an intermediate position between the corresponding outer belts (101L, 101R) and inner belts (103L, 103R).

As previously mentioned, the movement of the boxes (C) is obtained through the intervention of suitable paddles (110) moved by the belts (101-103).

Each paddle (110) is formed by a support base (111), which can be fixed to one of the belts (101-103) and by at least one contact portion (112) intended to interact with the boxes (C). The support base (111) is provided with two appendices (113) equipped with idle pins which slide in corresponding grooved guides (114) formed in the inner faces of the sides (100L, 100R). In the example shown in the drawings, each paddle (110) is provided with two contact portions (112) intended to engage the box (C), defining, in practice, the pusher and/or containment members used to hold the box (C) during its filling and to subsequently move it downstream. The value of the distance between the two contact portions (112) can be varied. In the illustrated non-limiting example, a first contact portion (112) is integral with the support base (111) of the paddle (110) while the other contact portion (112) can be moved in the direction transversal to the motion (direction of the belts 101-103) away from or towards the first portion to adapt the conveyor to the corresponding size of the box (C) to be handled.

If the support base (111) of the paddles (110) extends for a value corresponding to the distance between the two sides (100L, 100R), the appendices (113) will slide in guides formed in the sides themselves; in the case in which, on the other hand, the support base (111) of the paddles (110) extends for a value lower than the distance between the two sides (100L, 100R), or is sized so as to extend only over three of the six belts (101-103), the appendices (113) will slide in two guides, one of which is formed in one of the sides (100L, 100R), while the other will be presented by a central side positioned near or in correspondence to the line centerline line (TRX) (This last example is not shown in the drawings).

In the example of the drawings, the support base (111) has six through seats (115) which in the example illustrated have a substantially parallelepiped shape. The six seats (115) can be divided into two groups and are spaced apart by a value corresponding to the distance between the three belts (101L, 102L, 103L; 101R, 102R, 103R) that are positioned between the corresponding side (100L; 100R) and the centerline (TRX). On the external face of each of the belts (101-103), there is provided at least one engagement element (116) shaped so as to be stably coupled with one of the seats (115) provided on the support base (111) so as to make the base and therefore the entire paddle (110) integral with the belt on which the engagement element (116) is provided. Since the motorization of the three pairs of belts (101L, 101R), (102L, 102R), (103L, 103R) is made in such a way as to make each pair independent of the other two, the paddles (110) can be moved independently of each other in function of the machine operation. In this regard, by way of example, three motors could be used in the case of combining the belt (101L) with the belt (101R), the belt (102L) with the belt (102R) and the belt (103L) with the (103R), or with six motors, one for each of the six belts.

In a preferable but not exclusive embodiment, each of the belts (101-103) is provided with two engagement elements (116) such that each belt supports two pairs of paddles (110) which will be diametrically opposite too one another. In this way, there will be a total of six pairs of paddles, which can be divided into two groups of three pairs each, so as to define a plurality of operating cycles interchangeable with each other in correspondence with the movement of the belts. In other words, the paddles supported and moved by each of the pairs of belts (101L, 101R), (102L, 102R) and (103L, 103R) will be able to interact with the boxes (C) without interruption because when a group of three pairs of paddles (110) will be in a non-operating position, the other group of three will be able to engage and move the boxes (C).

Figures 67, 68, 69, 70:
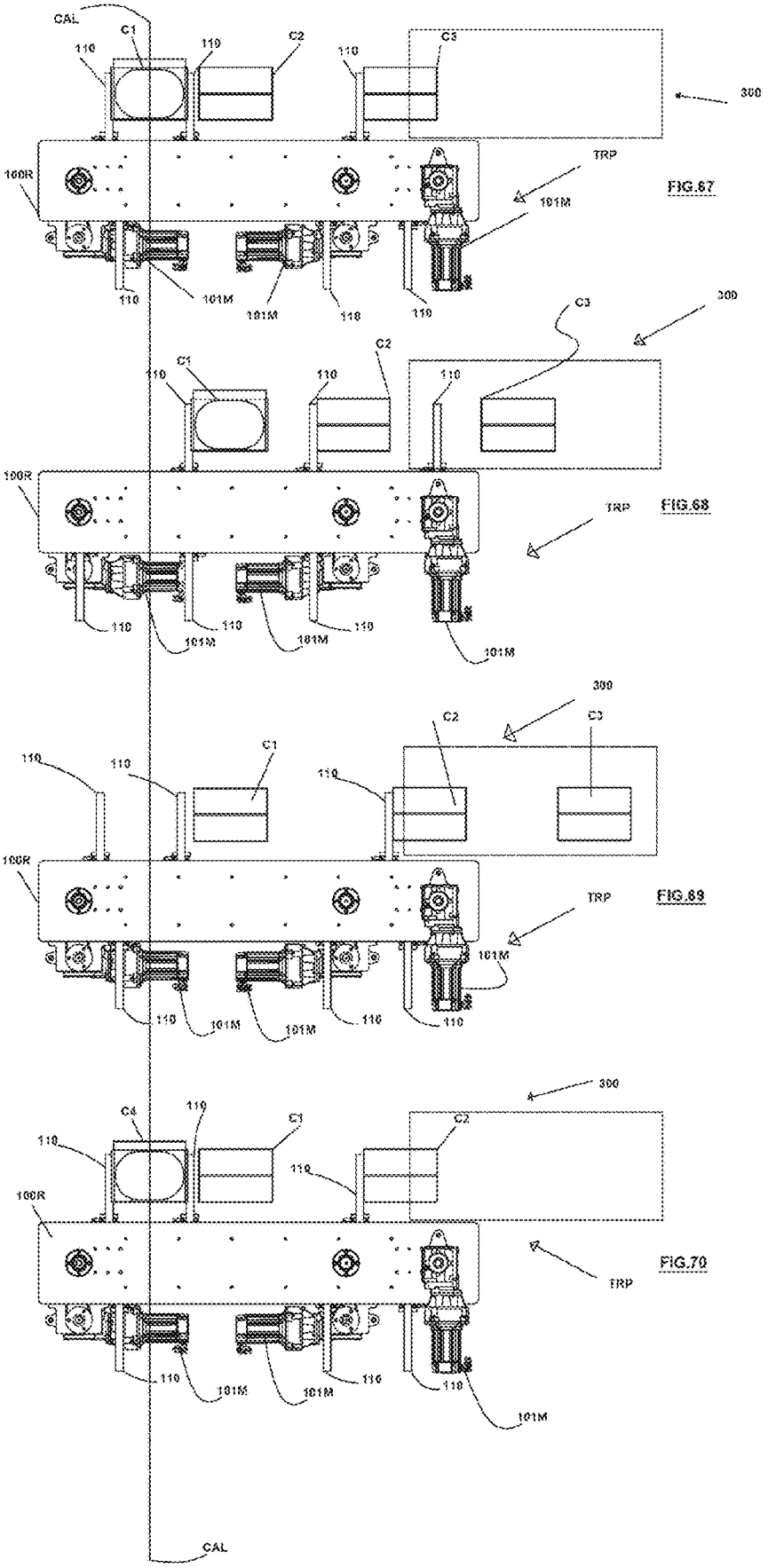
Figure 71:
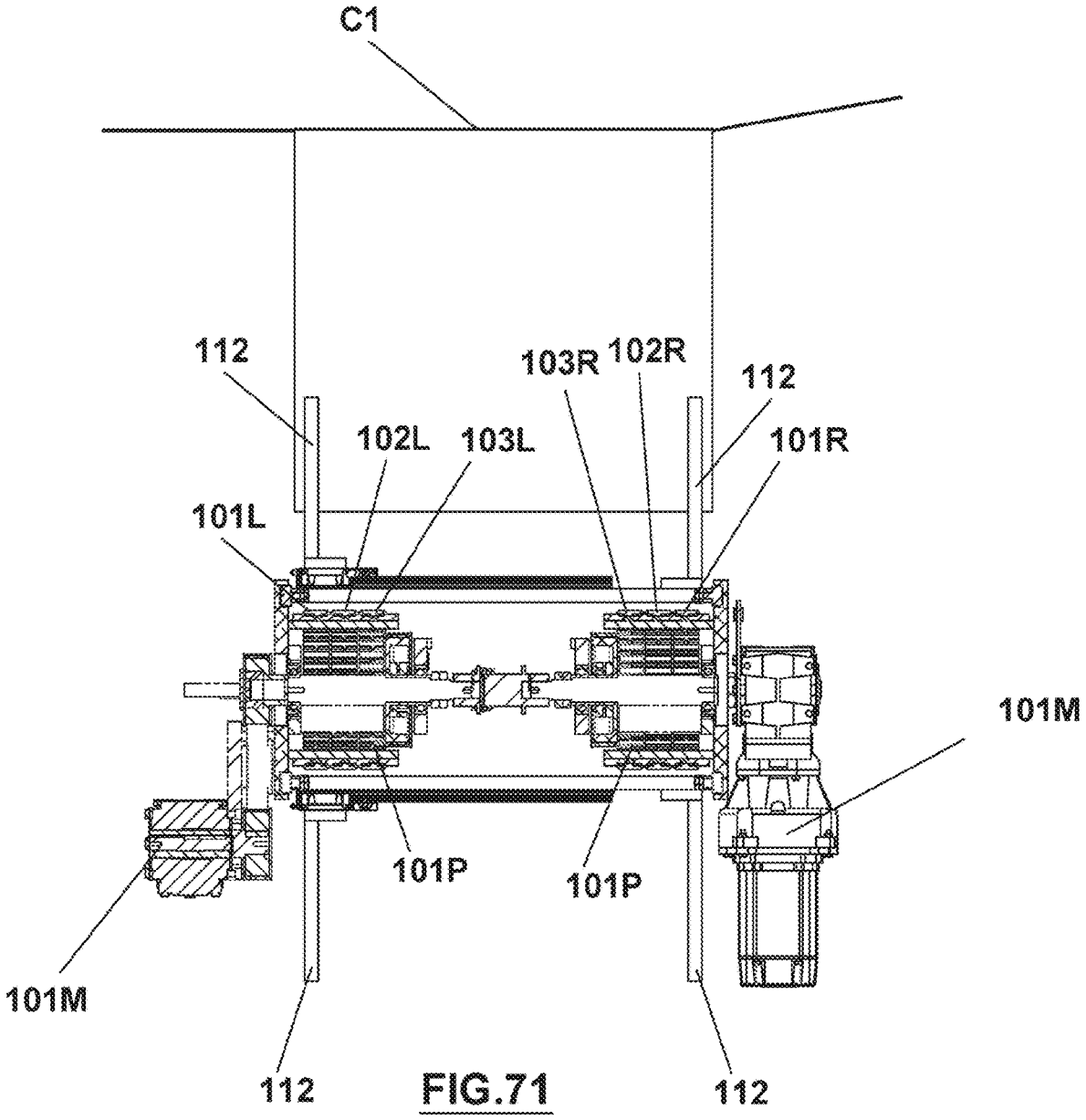
Figure 72:
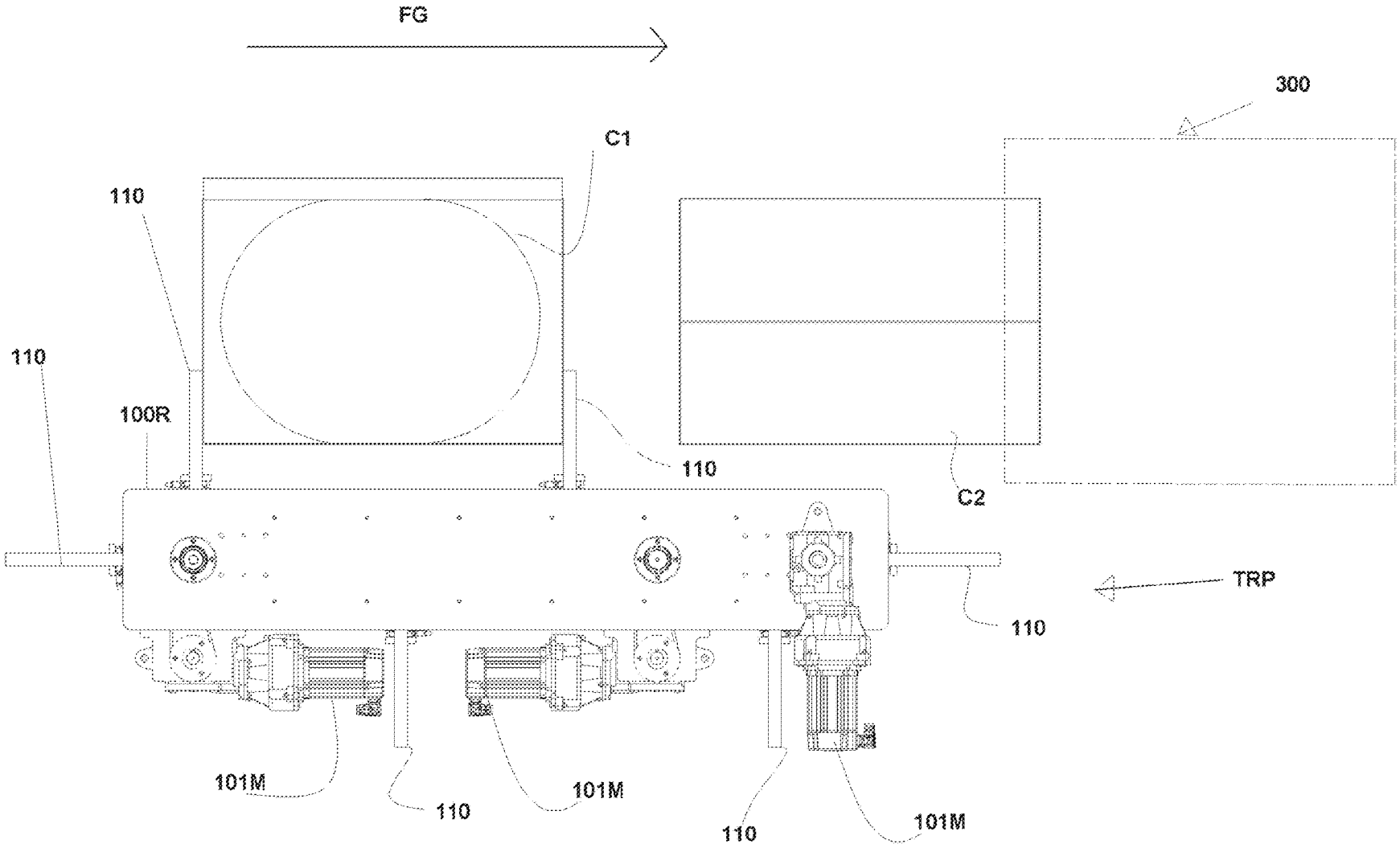

As visible in the diagrams of Figs. from 67 to 70, the paddle conveyor device (TRP) arranges the pairs of paddles (110) in the most suitable position according to the size of the boxes (C) to be handled. By way of example, in FIG. 67, a first box (C1) in the filling phase is shown on the left, with a second box (C2) placed downstream on the right and a third box (C3) still further downstream; in this operating configuration, the first box (C) is held by two pairs of paddles (110) of a first group, one upstream and one downstream, while the third paddle of the first group is in contact with the upstream face of the third box (C3); the second box (C2) is immediately downstream of the paddle (110) which is in contact with the downstream face of the first box (C1). The three paddless (110) of the second group are all in the lower part of the device (TRP), supported by the portions of the belts (101-103) which currently pass below. In the next configuration, shown in FIG. 68, the paddle (110) which was previously in contact with the first box (C1) at the face located downstream has come into contact with the second box (C2) at the face located upstream to accompany it downstream, in the direction of the exit section (U), while the third box is now in the exit station (U). In this configuration, the three paddles (110) of the second group placed in the lower part of the device (TRP) advance, i.e. they move to the left in this drawing. In the configuration shown in FIG. 69, the paddles (110) of the second group which previously was waiting in the leftmost part of the lower portion of the device (TRP) moves downstream, thus defining the paddle placed upstream in the filling station. In other words, there is a "preliminary" configuration in which there are two paddles (110) waiting for the next box, arriving from the unfolding station, to be filled and then moved downstream following the previously filled boxes. The configuration represented in FIG. 70 is then obtained (which corresponds to the configuration initially represented in FIG. 67), but with a fourth box (C) being filled.

Downstream of the filling station (N) a final conveyor (300) is provided in the exit station (U). The final conveyor (300) is formed by a pair of conveyor belts (301) closed in a loop on both sides of the path followed by the boxes (C). In particular, each of the belts (301) is wound around rollers with a vertical axis (302) at least one of which is drive by a corresponding motor (303). To complete the conveyor, guide planes (304) are also provided which support the belts (301).

The boxes (C) leaving the filling (U) and gluing (G) station are engaged on two opposite sides by the conveyor belts (301) which, by exerting a pressure on the opposite sides of the boxes (C), move them towards the machine exit.

Thus, a cartoning machine according to the present invention is a machine comprising:

a store unit (M) configured for storing a stack (P) of cardboard blanks (F);

an unfolding station(S), in which the cardboard blanks (F) are put into shape, assuming the shape of an open box (C);

a product feeding station (A), into which the products (RC) destined to be packaged in the boxes (C) obtained from the cardboard blanks (F) are fed;

an insertion station (N), in which the products (RC) are inserted into the open boxes (C);

an exit station (U) for the packages consisting of boxes (C) with the products (RC) inside them;

wherein between the store unit (M) and the unfolding station(S) are arranged and acting picking up means (K) configured for picking up the individual cardboard blanks (F) from the store unit (M) by moving them along a predefined picking up direction (DP), a conveyor (CB) for conveying the individual cardboard blanks (F) to the unfolding station, and transfer means for transferring the individual cardboard blanks (F) from the store unit (M) to the conveyor (CB);

wherein said transfer means comprise a dragging unit (T) arranged downstream of said picking up means (K) with respect to the picking up direction (DP) and a collection compartment (VR) for the cardboard blanks arranged below the dragging unit (T) from which it receives the cardboard blanks coming from the store unit (M), the collection compartment (VR) being provided with unloading means (VR2) adapted to unload one cardboard blank at a time onto the conveyor (CB);

wherein said dragging unit (T) comprises an active area (TY) in which engagement means (T1, T2) are arranged to engage the cardboard blanks (F) and move them along said direction (DP) of picking up of the cardboard blanks, said engagement means being selectively activated and deactivated along said direction, such that the extension of the active zone (TY) is adjustable according to the size of the cardboard blanks; and wherein the cardboard blanks collection compartment (VR) arranged below the dragging unit (T) is formed by a containment structure with a front wall (VRA) and a rear wall (VRB) whose positions are both adjustable with respect to said direction (DP) both towards and away in relation to the store unit (M).

Furthermore, a cartoning machine according to the present invention may comprise one or more of the following features even combined between them:

the engagement means of the cardboard blanks in the dragging unit (T1, T2) are formed by motorized rollers (T1) and respective counter-rollers (T2) arranged along said direction (DP) and selectively positioned in contact and in non-contact position with the cardboard blanks picked up from the store unit (M).

the collection compartment (VR) is provided with an upper pre-collection area, in which a predetermined number of overlapping cardboard blanks is collected, equipped with means (VR3) of interception of the cardboard blanks selectively positioned in a first operating position of impeded passage and in a second operating position of permitted passage of the cardboard blanks, so that in said pre-collection area a predetermined number of cardboard blanks accumulate when the means of interception (VR3) are in their first operating position and said predetermined number of cardboard blanks is free to pass towards a lower area of the collection compartment when the interception means (VR3) are in the second operating position.

the dragging unit (T) is configured to drag a plurality of cardboard blanks simultaneously according to the size of the cardboard blanks.

said conveyor (CB) comprises two pairs of parallel transport belts (CB2, CB3) controlled independently of each other and provided with appendages protruding towards the outside of the belts themselves and acting as pushers on the cardboard blanks which are discharged onto the conveyor.

said pairs of parallel transport belts are each mounted on a respective support (CB1) and the distance between the supports (CB1) is adjustable.

upstream of the output station (U) there is a station (G) for gluing or closing the boxes C) with the products (RC) inside them.

in an inlet section of the dragging unit (T) there is a motorized roller (T1A) which extends transversely between two sides (1R, 1L) of the same unit and immediately downstream of said motorized roller (T1A) there are two other motorized rollers (T1B, T1C) which also extend transversely between the sides (1R, 1L) and to which respective counter-rollers (T2B, T2C) are opposed.

each support (CB1) is connected to a respective wall (VRA; VRB) of said collection compartment (VR).

said stations are arranged along a "U" or "C" path.

In practice, the execution details can in any case vary in an equivalent way as regards the individual elements described and illustrated, without thereby abandoning the idea of the solution adopted and therefore remaining within the limits of the protection granted by the present patent in accordance with the following claims.

The invention claimed is:

1. A cartoning machine comprising:

a store unit configured for storing a stack of cardboard blanks;

an unfolding station, in which the cardboard blanks are shaped into an open box;

a product feeding station, into which products destined to be packaged in the boxes obtained from the cardboard blanks are fed;

an insertion station, in which the products are inserted into the open boxes;

an exit station for the packages consisting of boxes with the products inside them;

wherein arranged and acting between the store unit and the unfolding station, is a picking up means configured for picking up the individual cardboard blanks from the store unit by moving them along a predefined picking up direction, a conveyor for conveying the individual cardboard blanks to the unfolding station, and a transfer means for transferring the individual cardboard blanks between the store unit and the conveyor;

and wherein said transfer means comprise a dragging unit and a collection compartment, the dragging unit arranged downstream of said picking up means with respect to the picking up direction and the collection compartment for the cardboard blanks arranged below the dragging unit from which it receives the cardboard blanks coming from the store unit, the collection compartment being provided with unloading means adapted to unload one cardboard blank at a time onto the conveyor;

said dragging unit comprises an active zone in which engagement means are arranged to engage the cardboard blanks and move them along said picking up direction of the cardboard blanks, said engagement means being selectively activated and deactivated along said picking up direction, such that extension of the active zone is adjustable according to the size of the cardboard blanks; and the cardboard blanks collection compartment arranged below the dragging unit is formed by a containment structure with a front wall and a rear wall whose positions are both adjustable with respect to said picking up direction both towards and away in relation to the store unit.

2. The cartoning machine according to claim 1, wherein the engagement means of the cardboard blanks in the dragging unit are formed by motorized rollers and respective counter-rollers arranged along said picking up direction and selectively positioned in contact and in non-contact position with the cardboard blanks picked up from the store unit.

3. The cartoning machine according to claim 1, wherein the collection compartment is provided with an upper pre-collection area, in which a predetermined number of overlapping cardboard blanks is collected, equipped with means of interception of the cardboard blanks selectively positioned in a first operating position of impeded passage and in a second operating position of permitted passage of the cardboard blanks, so that in said pre-collection area a predetermined number of cardboard blanks accumulate when the means of interception are in their first operating position and said predetermined number of cardboard blanks is free to pass towards a lower area of the collection compartment when the interception means are in the second operating position.

4. The cartoning machine according to claim 1, wherein the dragging unit is configured to drag a plurality of cardboard blanks simultaneously according to the size of the cardboard blanks.

5. The cartoning machine according to claim 1, wherein said conveyor comprises two pairs of parallel transport belts controlled independently of each other and provided with appendages protruding towards the outside of the belts themselves and acting as pushers on the cardboard blanks which are discharged onto the conveyor.

6. The cartoning machine according to claim 5, wherein said pairs of parallel transport belts are each mounted on a respective support and a distance between the supports is adjustable.

7. The cartoning machine according to claim 1, wherein upstream the exit station there is a station for gluing or closing the boxes with the products inside them.

8. The cartoning machine according to claim 1, wherein in an inlet section of the dragging unit there is a motorized roller which extends transversely between two sides of the dragging unit and immediately downstream of said motorized roller there are two other motorized rollers which also extend transversely between the sides and to which respective counter-rollers are opposed.

9. The cartoning machine according to claim 1, wherein the conveyor comprises two pairs of parallel transport belts controlled independently of each other and provided with appendages protruding towards the outside of the parallel transport belts themselves and acting as pushers on the cardboard blanks which are discharged onto the conveyor, the pairs of parallel transport belts are each mounted on a respective support, the distance between the supports is adjustable, and each support is connected to a respective wall of said collection compartment.

10. The cartoning machine according to claim 1, wherein the unfolding station, the product feeding station, the insertion station and the exit station are arranged along a "U" or "C" path.

* * * * *